US009263177B1

(12) United States Patent
Ikriannikov et al.

(10) Patent No.: US 9,263,177 B1
(45) Date of Patent: Feb. 16, 2016

(54) PIN INDUCTORS AND ASSOCIATED SYSTEMS AND METHODS

(75) Inventors: Alexandr Ikriannikov, Castro Valley, CA (US); Ognjen Djekic, San Francisco, CA (US)

(73) Assignee: Volterra Semiconductor LLC, San Jose, CA (US)

( * ) Notice: Subject to any disclaimer, the term of this patent is extended or adjusted under 35 U.S.C. 154(b) by 734 days.

(21) Appl. No.: 13/423,744

(22) Filed: Mar. 19, 2012

(51) Int. Cl.

| | |
|---|---|
| ***H01F 5/00*** | (2006.01) |
| ***H01F 27/02*** | (2006.01) |
| ***H01F 27/29*** | (2006.01) |
| ***H01F 17/04*** | (2006.01) |
| ***H01F 27/28*** | (2006.01) |
| ***H01F 17/00*** | (2006.01) |

(52) U.S. Cl.
CPC ..... *H01F 17/0013* (2013.01); *H01F 17/0006* (2013.01)

(58) Field of Classification Search
USPC ..... 336/83, 192, 200, 221, 232
See application file for complete search history.

(56) References Cited

U.S. PATENT DOCUMENTS

| | | | | |
|---|---|---|---|---|
| 4,455,545 | A | 6/1984 | Shelly | |
| 4,777,406 | A | 10/1988 | Ross et al. | |
| 4,800,479 | A | 1/1989 | Bupp | |
| 4,935,710 | A | 6/1990 | Yamazaki et al. | |
| 5,023,578 | A | 6/1991 | Kaneko et al. | |
| 5,161,098 | A | 11/1992 | Balakrishnan | |
| 5,204,809 | A | 4/1993 | Andresen | |
| 5,225,971 | A | 7/1993 | Spreen | |
| 5,353,001 | A | 10/1994 | Meinel et al. | |
| 5,469,334 | A | 11/1995 | Balakrishnan | |
| 5,565,837 | A | 10/1996 | Godek et al. | |
| 5,568,111 | A | 10/1996 | Metsler | |
| 5,574,420 | A | 11/1996 | Roy et al. | |
| 5,594,402 | A | 1/1997 | Krichtafovitch et al. | |
| 5,631,822 | A | 5/1997 | Silberkleit et al. | |
| 5,694,030 | A * | 12/1997 | Sato et al. | 323/282 |
| 5,939,966 | A | 8/1999 | Shin' Ei | |
| 6,060,977 | A | 5/2000 | Yamamoto et al. | |

(Continued)

FOREIGN PATENT DOCUMENTS

| | | |
|---|---|---|
| EP | 1 833 165 | 9/2007 |
| JP | 2002057049 | 2/2002 |
| WO | WO 2006/026674 | 3/2006 |

OTHER PUBLICATIONS

Dong et al., The Short Winding Path Coupled Inductor Voltage Regulators, Applied Power Electronics Conference and Exposition, pp. 1446-1452, Feb. 24-28, 2008.

(Continued)

*Primary Examiner* — Tsz Chan
(74) *Attorney, Agent, or Firm* — Lathrop & Gage LLP

(57) ABSTRACT

A magnetic device includes a magnetic core and N windings wound at least partially around respective portions of the magnetic core. Each of the N windings has opposing first and second ends. Each first end forms a first connector, and each second end forms a second connector. Each first connector is adapted for coupling to a first substrate in a first plane, and each second connector is adapted for coupling to a second substrate in a second plane, where the second plane is different from the first plane. N is an integer greater than zero. An electrical assembly includes a substrate and a power supply module including a magnetic device. The magnetic device at least partially electrically couples the power supply module to the substrate.

32 Claims, 34 Drawing Sheets

(56) References Cited

U.S. PATENT DOCUMENTS

| | | | | |
|---|---|---|---|---|
| 6,114,932 | A | 9/2000 | Wester et al. | |
| 6,198,375 | B1 | 3/2001 | Shafer | |
| 6,204,744 | B1 | 3/2001 | Shafer et al. | |
| 6,242,996 | B1 * | 6/2001 | Sato et al. | 336/200 |
| 6,342,778 | B1 | 1/2002 | Catalano et al. | |
| 6,356,179 | B1 | 3/2002 | Yamada | |
| 6,362,986 | B1 | 3/2002 | Schultz et al. | |
| 6,377,155 | B1 | 4/2002 | Allen et al. | |
| 6,420,953 | B1 | 7/2002 | Dadafshar | |
| 6,449,829 | B1 | 9/2002 | Shafer | |
| 6,460,244 | B1 | 10/2002 | Shafer et al. | |
| 6,477,414 | B1 | 11/2002 | Silvian | |
| 6,549,111 | B1 | 4/2003 | De Graaf et al. | |
| 6,578,253 | B1 | 6/2003 | Herbert | |
| 7,034,645 | B2 | 4/2006 | Shafer et al. | |
| 7,187,263 | B2 | 3/2007 | Vinciarelli | |
| 7,199,695 | B1 | 4/2007 | Zhou et al. | |
| 7,239,530 | B1 | 7/2007 | Djekic et al. | |
| 7,248,139 | B1 | 7/2007 | Podlisk et al. | |
| 7,280,025 | B2 | 10/2007 | Sano | |
| 7,315,463 | B2 | 1/2008 | Schrom et al. | |
| 7,317,305 | B1 | 1/2008 | Stratakos et al. | |
| 7,352,269 | B2 | 4/2008 | Li et al. | |
| 7,492,246 | B2 | 2/2009 | Chang | |
| 7,498,920 | B2 | 3/2009 | Sullivan et al. | |
| 7,525,406 | B1 | 4/2009 | Cheng | |
| 7,567,163 | B2 | 7/2009 | Dadafshar et al. | |
| 7,859,238 | B1 | 12/2010 | Stratakos et al. | |
| 7,965,165 | B2 | 6/2011 | Ikriannikov et al. | |
| 7,994,888 | B2 | 8/2011 | Ikriannikov | |
| 8,040,212 | B2 | 10/2011 | Ikriannikov | |
| 8,102,233 | B2 | 1/2012 | Ikriannikov | |
| 8,153,473 | B2 | 4/2012 | Lotfi et al. | |
| 8,283,789 | B2 | 10/2012 | Zeng et al. | |
| 8,624,701 | B2 | 1/2014 | Zeng et al. | |
| 2002/0067234 | A1 | 6/2002 | Kung | |
| 2002/0093413 | A1 | 7/2002 | Shin'ei | |
| 2003/0134612 | A1 | 7/2003 | Nakayama et al. | |
| 2004/0017276 | A1 | 1/2004 | Chen et al. | |
| 2004/0263285 | A1 * | 12/2004 | Suzuki et al. | 333/181 |
| 2005/0128040 | A1 | 6/2005 | Gray et al. | |
| 2006/0049907 | A1 | 3/2006 | Liu | |
| 2006/0145804 | A1 * | 7/2006 | Matsutani et al. | 336/200 |
| 2006/0158297 | A1 | 7/2006 | Sutardja | |
| 2007/0175701 | A1 | 8/2007 | Xu et al. | |
| 2007/0176726 | A1 | 8/2007 | Xu et al. | |
| 2007/0268104 | A1 | 11/2007 | Chan et al. | |
| 2007/0285202 | A1 | 12/2007 | Ito et al. | |
| 2007/0296533 | A1 * | 12/2007 | Springett | 336/200 |
| 2008/0169769 | A1 | 7/2008 | Lee | |
| 2008/0205098 | A1 | 8/2008 | Xu et al. | |
| 2008/0237790 | A1 * | 10/2008 | Yabuzaki et al. | 257/531 |
| 2008/0303125 | A1 * | 12/2008 | Chen et al. | 257/676 |
| 2008/0309442 | A1 * | 12/2008 | Hebert | 336/65 |
| 2009/0175014 | A1 * | 7/2009 | Zeng et al. | 361/782 |
| 2009/0231081 | A1 | 9/2009 | Ikriannikov et al. | |
| 2009/0237197 | A1 | 9/2009 | Ikriannikov et al. | |
| 2010/0007457 | A1 | 1/2010 | Yan et al. | |
| 2010/0026443 | A1 | 2/2010 | Yan et al. | |
| 2010/0328010 | A1 * | 12/2010 | Noma et al. | 336/200 |
| 2011/0032068 | A1 | 2/2011 | Ikriannikov | |
| 2011/0043317 | A1 | 2/2011 | Ikriannikov | |
| 2011/0050191 | A1 * | 3/2011 | Tsuji et al. | 323/282 |
| 2011/0148560 | A1 | 6/2011 | Ikriannikov | |
| 2011/0169476 | A1 | 7/2011 | Ikriannikov et al. | |
| 2011/0279100 | A1 | 11/2011 | Ikriannikov | |
| 2012/0026706 | A1 | 2/2012 | Ikriannikov | |
| 2012/0056703 | A1 | 3/2012 | Ikriannikov | |

OTHER PUBLICATIONS

Dong et al., Twisted Core Coupled Inductors for Microprocessor Voltage Regulators, Power Electronics Specialists Conference, pp. 2386-2392, Jun. 17-21, 2007.

Panasonic, Power Choke Coil datasheet, 2 pages, Jan. 2008.

Pulse Product News Press Release dated Nov. 25, 2008.

Pulse, SMT Power Inductors datasheet, 2 pages, Nov. 2007.

Vishay, Low Profile, High Current IHLP Inductor, 3 pages, Jan. 21, 2009.

* cited by examiner

PIN INDUCTORS AND ASSOCIATED SYSTEMS AND METHODS

BACKGROUND

Inductors are commonly used for filtering and energy storage in power supplies, such as in DC-to-DC converters. For example, a buck DC-to-DC converter includes an inductor which, in cooperation with one or more capacitors, filters a switching waveform. Power supplies including multiple power stages often include at least one inductor per power stage. Some power supplies, however, use a coupled inductor in place of multiple discrete inductors, such as to improve power supply performance, reduce power supply size, and/or reduce power supply cost. Examples of coupled inductors and associated systems and methods are found in U.S. Pat. No. 6,362,986 to Schultz et al., which is incorporated herein by reference.

Electronic equipment, such as information technology equipment, is often powered by one or more power supply modules. Power supply modules that perform DC-to-DC power conversion are sometimes referred to as "voltage regulation modules," or "VRMs." VRMs are used extensively in computing equipment.

For example, FIG. 1 shows a side plan view of a prior art electrical assembly 100 including a conventional power supply module 102. Module 102 has a buck-type topology and includes an output filter inductor 104 affixed to a module substrate 106. Additional components 108-116, such as switching circuits, controllers, and passive devices, are also affixed to module substrate 106. Inductor 104 is typically significantly taller than the other components of module 102. Module 102 is coupled to an assembly substrate 120, such as an information technology device motherboard, via conductive pins 122, only some of which are labeled for illustrative clarity. Conductive pins 122 provide an electrical interface between module 102 and assembly substrate 120. For example, module input and output current flows between module 102 and assembly substrate 120 via pins 122. As another example, pins 122 may couple data signals, such as control signals, between module 102 and assembly substrate 120.

SUMMARY

In an embodiment, an electrical assembly includes opposing first and second substrates and an inductor. The inductor includes a magnetic core and N windings wound at least partially around respective portions of the magnetic core. Each of the N windings has opposing first and second ends, where each first end is electrically coupled to the first substrate and each second end is electrically coupled to the second substrate. N is an integer greater than zero.

In an embodiment, an electrical assembly includes a first substrate and a power supply module. The power supply module includes a magnetic device, which is either an inductor, a transformer, or a combination of an inductor an a transformer. The magnetic device at least partially electrically couples the power supply module to the first substrate.

In an embodiment, a magnetic device includes a magnetic core having opposing first and second outer surfaces. The magnetic device further includes N windings wound at least partially around respective portions of the magnetic core. Each of the N windings has opposing first and second ends. Each first end forms a first solder tab along the first outer surface, and each second end forms a second solder tab along the second outer surface. N is an integer greater than zero.

In an embodiment, a magnetic device includes a magnetic core and N windings wound at least partially around respective portions of the magnetic core, where N is an integer greater than zero. Each of the N windings has opposing first and second ends. Each first end forms a first connector, and each second end forms a second connector. Each first connector is adapted for coupling to a first substrate in a first plane, and each second connector is adapted for coupling to a second substrate in a second plane that is different from the first plane.

DETAILED DESCRIPTION OF THE EMBODIMENTS

Figure 1:
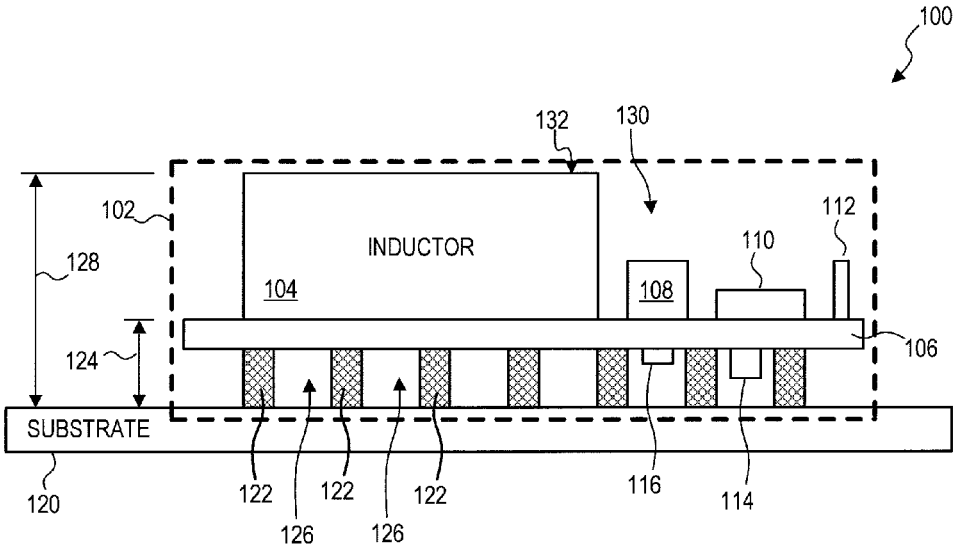
(PRIOR ART) FIG. 1
FIG. 1 shows a side plan view of a prior art electrical assembly including a power supply module.

As discussed above, conductive pins typically interface a power supply module with a substrate, such as shown in FIG. 1. However, it has been discovered that such pins can be reduced or eliminated by using one or more magnetic devices, such as inductors and/or transformers, to interface a power supply module to a substrate.

Figure 2:
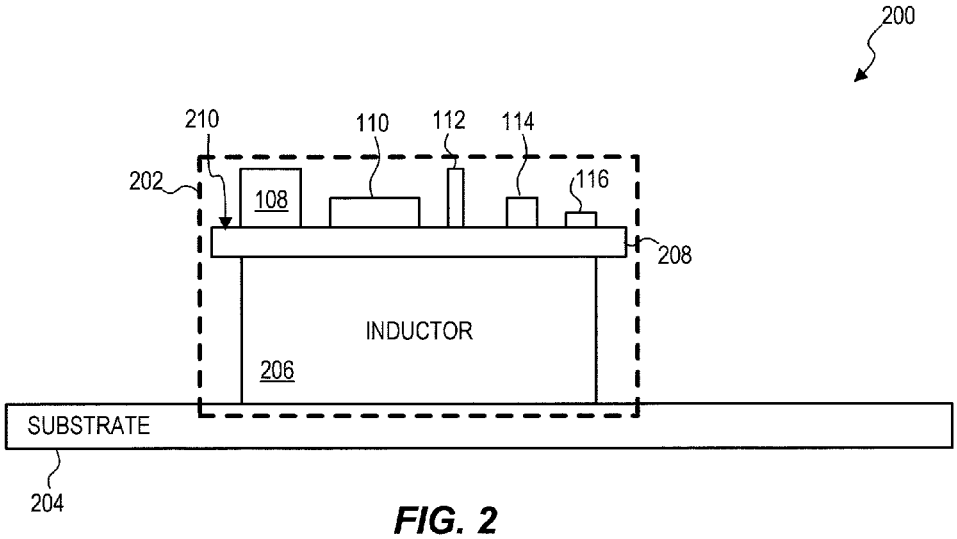
FIG. 2 shows a side plan view of an electrical assembly including a power supply module electrically coupled to a substrate by an inductor, according to an embodiment.

For example, FIG. 2 shows a side plan view of an electrical assembly 200, including a power supply module 202 electrically coupled to an assembly substrate 204 via an inductor 206. Inductor 206 includes a magnetic core (not shown) and N windings (not shown) wound at least partially around respective portions of the magnetic core, where N is an integer greater than zero. Power supply module 202 includes, for example, one or more of an isolated DC-to-DC converter, a non-isolated DC-to-DC converter, an AC-to-DC converter, or an inverter. In some embodiments, power supply module 202 includes a DC-to-DC converter having a buck-type, boost-type, or buck-boost-type topology. Assembly substrate 204 is, for example, an information technology device printed circuit board, such as a computing device motherboard or a telecommunication device motherboard.

Inductor 206 performs at least two functions. First, inductor 206 performs electrical filtering and/or energy storage functions for power supply module 202. Second, inductor 206 at least partially electrically couples assembly substrate 204 and power supply module 202. For example, in some embodiments, inductor 206 includes one or more conductors (not shown) to interface module 202 with a power source and/or a load on assembly substrate 204, or with a power source and/or or a load electrically coupled to assembly substrate 204. As another example, in certain embodiments, inductor 206 includes one or more data conductors (not shown) to couple one or more data signals, such as control, status, and/or sense signals, between assembly substrate 204 and module 202. Examples of possible data signals include (a) a signal to control power supply module 202, and (b) a signal indicating status of one more or more aspects of electrical assembly 200. Thus, inductor 206 performs both inductive and electrical interface functions. Accordingly, inductor 206 is sometimes referred to as a "pin inductor" to reflect its ability to potentially replace conductive pins electrically coupling a module to a substrate. Inductor 104 of conventional power supply module 102 (FIG. 1), in contrast, merely performs inductive functions.

Power supply module 202 further includes a module substrate 208 coupled to inductor 206. Additional power supply components, such as switching circuits, controllers, and/or passive components, as required to form at least part of a power supply, are disposed on substrate 208. For example, some embodiments include additional components 108-116 as shown, although the number and type of additional components may vary without departing from the scope hereof.

Certain embodiments of power supply module 202 achieve one or more advantages that could not be realized by conventional power supply modules, such as conventional module 102 of FIG. 1. For example, module 202's use of inductor 206 as an interface between module 202 and assembly substrate 204 promotes a low impedance connection between inductor 206 and substrate 204, thereby helping reduce impedance-induced losses and voltage distortion. In particular, in some embodiments, one or more windings of inductor 206 are directly connected to assembly substrate 204, thereby essentially eliminating impedance between the windings and substrate 204. In conventional module 102 (FIG. 1), in contrast, inductor 104 is separated from assembly substrate 120 by distance 124, and inductor 104 is electrically coupled to assembly substrate 120 via module substrate 106 and pins 122. Thus, inductor-to-assembly substrate impedance may be significantly lower in certain embodiments of module 202 than in conventional module 102.

Module 202's use of inductor 206 as an electrical interface also promotes efficient use of space. In particular, use of inductor 206 as an interface may reduce or eliminate the need for conductive pins, thereby reducing or eliminating unused space between adjacent pins and space occupied by the pins themselves. For example, space 126 between pins 122 in conventional power supply module 102 is largely unused, as shown in FIG. 1. In certain embodiments of module 202, however, inductor 206 partially or completely replaces conductive pins, thereby reducing or eliminating space between adjacent pins.

Additionally, use of inductor 206 as an electrical interface promotes component height similarity, thereby further promoting efficient space use. In many applications, a power supply module's maximum length, width, and height dictate how close other system components can be placed to the module. Thus, component height disparity promotes inefficient space use because, in many applications, space above shorter components is unused due to tall components limiting how close other system components can be placed to the module.

In many power supply modules, an inductor is the tallest module component. For example, inductor 104 is significantly taller than additional components 108-112 in conventional module 102, such that module 102's maximum height 128 is defined by inductor 104. Thus, in many systems, space 130 above additional components 108-112, but below inductor top surface 132, is unused.

In module 202, on the other hand, inductor 206 is used an interface with assembly substrate 204. Thus, in certain embodiments, module substrate's top surface 210 is free of inductors and instead includes components of approximately the same height, such as additional components 108-116, thereby promoting efficient space use.

The space saving potential of certain embodiments of module 202 can be appreciated by comparing a rectangular cross-section of module 202, which is approximated by dashed lines in FIG. 2, to a rectangular cross-section of conventional module 102, which is approximated by dashed lines in FIG. 1. Modules 102 and 202 each include the same additional components 108-116. Additionally, inductor 104 of module 102 has approximately the same size as inductor 206 of module 202. However, module 202's rectangular cross-sectional area is only about 60% of that of module 102, thereby showing the space saving potential of certain module 202 embodiments.

Furthermore, use of inductor 206 an electrical interface results in inductor 206 being sandwiched between module substrate 208 and assembly substrate 204. Each of substrates 204, 208 typically includes metallic electrical conductors, such as conductive traces, which shield inductor 206. Thus, the configuration of assembly 200 promotes electromagnetic compatibility by shielding inductor 206, which is a potential electromagnetic interference source, from other components of system 200.

Moreover, use of inductor 206 as an electrical interface may promote assembly 200 cooling. For example, disposing inductor 206 between module substrate 208 and assembly substrate 204 leaves module substrate top surface 210 free of tall components in certain embodiments, thereby promoting unimpeded airflow and unobstructed area for one or more optional heatsinks. As another example, in some embodiments, inductor 206 includes electrical conductors attached to both module substrate 208 and assembly substrate 204. Such conductors, which may be in open air, serve as heatsinks which cool inductor 206 and module substrate 208.

In some alternate embodiments, module 202 extends into an aperture of assembly substrate 204, such that module 202 is a drop-in module.

Discussed below are a number of examples of pin inductors and electrical assemblies including one or more pin inductors. However, it should be understood that pin inductor 206 and electrical assembly 200 of FIG. 2 are not limited to the examples below. Additionally, the pin inductors discussed below are not limited to use in the electrical assemblies disclosed herein.

Figure 3:
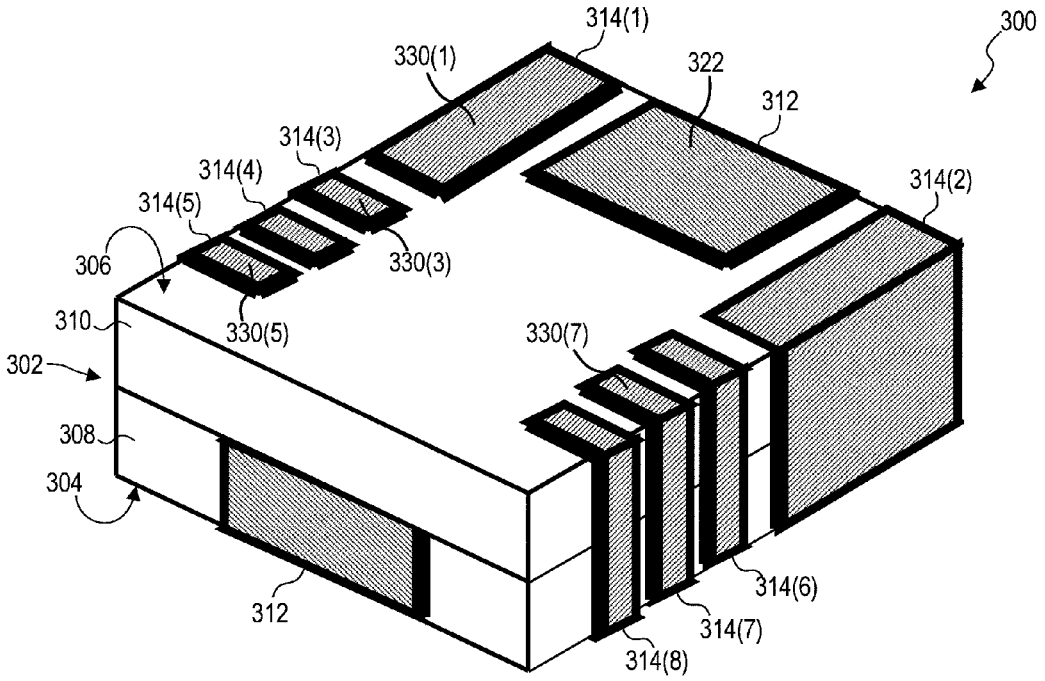
FIG. 3 shows a perspective view of a pin inductor.
Figure 4:
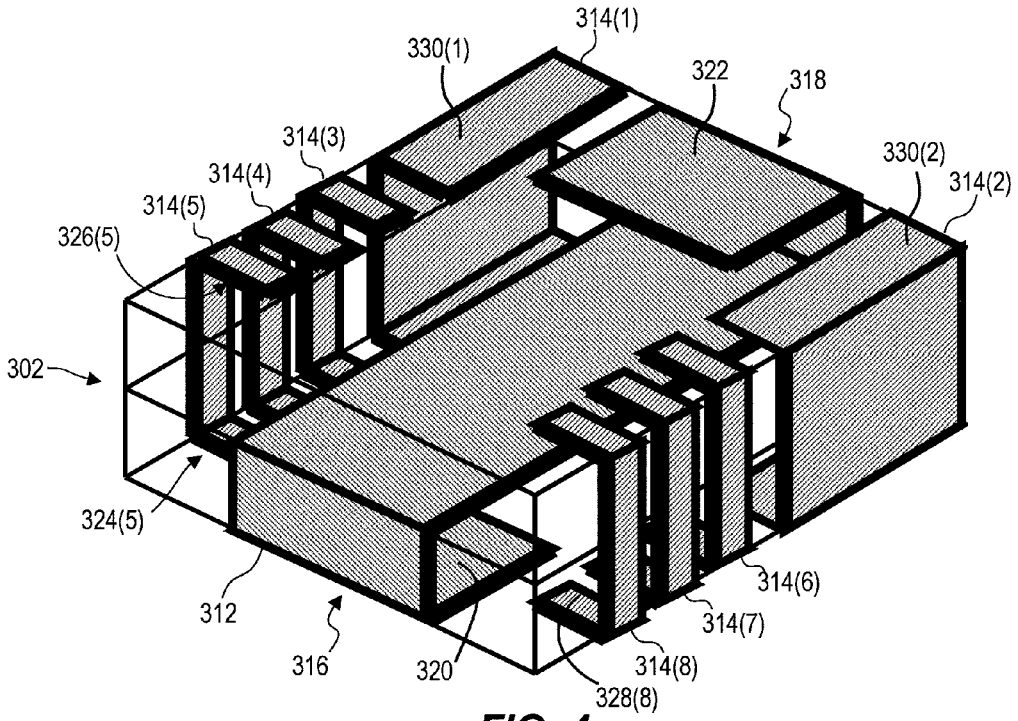
FIG. 4 shows a perspective view of the FIG. 3 pin inductor with its magnetic core shown as transparent, according to an embodiment.

FIG. 3 shows a perspective view of a pin inductor 300. Inductor 300 includes a magnetic core 302 having opposing first and second outer surfaces 304, 306. Magnetic core 302 is shown as being formed of first and second magnetic elements 308, 310, which in some embodiments are ferrite or powder iron magnetic elements. However, the configuration of magnetic core 302 may vary. For example, in some alternate embodiments, magnetic core 302 is formed of two or more other magnetic elements, such as magnetic elements formed of ferrite or a similar magnetic material, which are joined together. As another example, in some other alternate embodiments, magnetic core 302 is a single-piece block core, such as formed of a molded magnetic material. FIG. 4 shows a perspective view of inductor 300 with magnetic core 302 shown as transparent, and FIG. 5 shows an exploded perspective view of inductor 300 without magnetic core 302.

Inductor 300 further includes a winding 312 and additional conductors 314. Winding 312 is wound around a portion of magnetic core 302 such that winding 312 is wound through magnetic core 302. Additional conductors 314, however, are not wound through magnetic core 302, and magnetic core 302 does not form a magnetic path loop around additional conductors 314. Thus, inductance associated with winding 312 is typically much greater than inductance associated with additional conductors 314. Although inductor 300 is shown as including eight additional conductors 314, the number and configuration of additional conductors 314 can be varied, such as discussed below with respect to FIG. 9.

Figure 5:
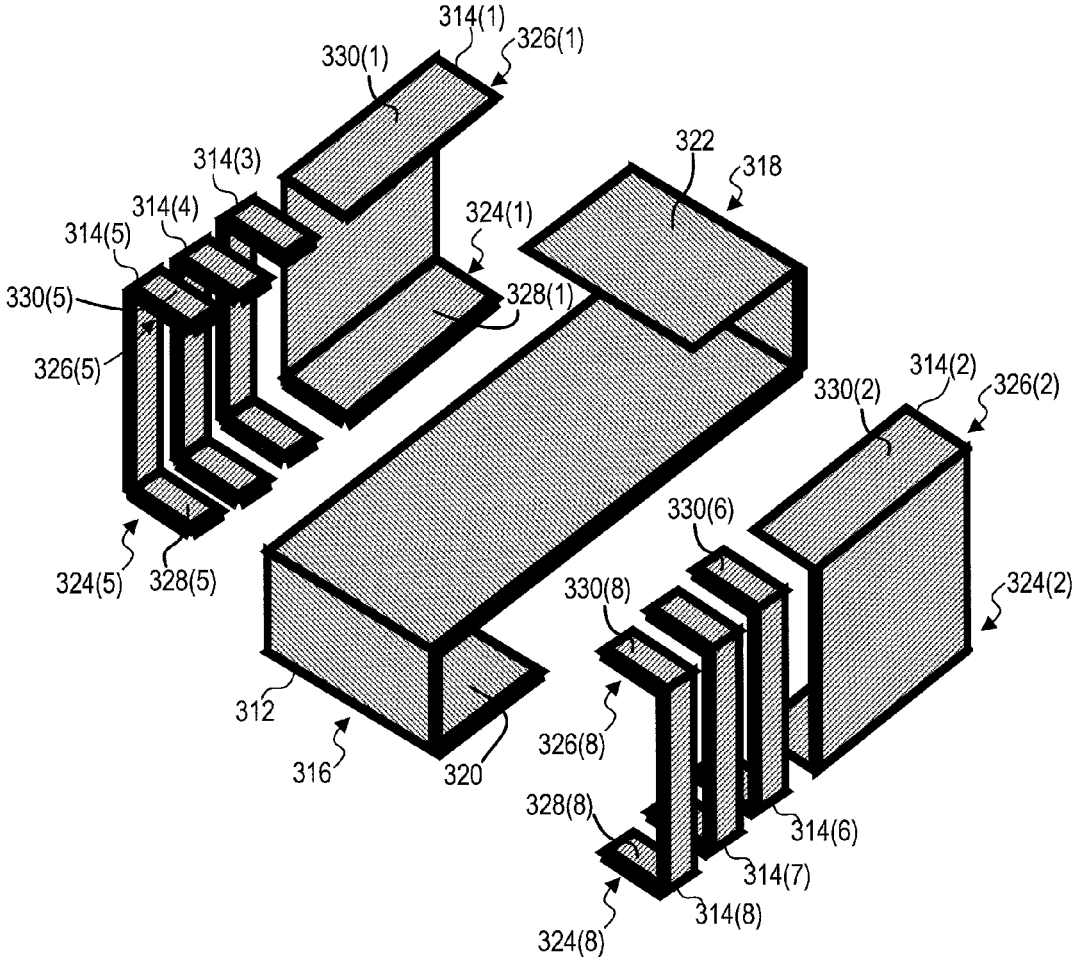
FIG. 5 shows an exploded perspective view of the FIG. 3 pin inductor without its magnetic core.

Winding 312 has opposing first and second ends 316, 318 (see FIGS. 4 and 5). First end 316 forms a first solder tab 320 on magnetic core first outer surface 304, and second end 318 forms a second solder tab 322 on magnetic core second outer surface 306. Similarly, each additional conductor 314 has respective opposing first and second ends 324, 326. Each first end 324 forms a respective first solder tab 328 on magnetic core first outer surface 304, and each second end 326 forms a respective second solder tab 330 on magnetic core second outer surface 306. Thus, first solder tabs 320, 328 are each adapted for surface mount soldering to a first substrate in a first plane, and second solder tabs 322, 330 are each adapted for surface mount soldering to a second substrate in a second plane, where the second plane is different from the first plane. Only some of first and second ends 324, 326 and first and second solder tabs 328, 330 are labeled for illustrative clarity.

Figure 6:
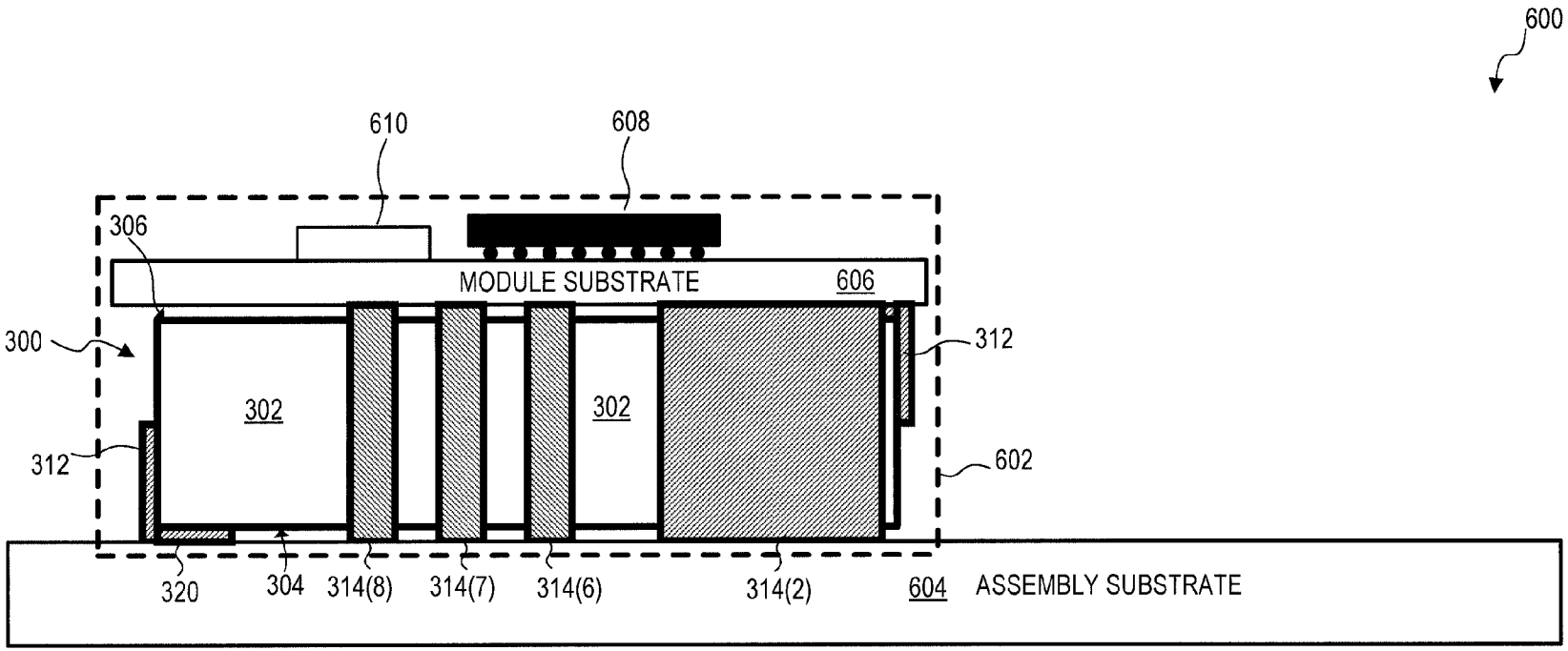
FIG. 6 shows a side plan view of an electrical assembly including an instance of the pin inductor of FIG. 3, according to an embodiment.
Figure 7:
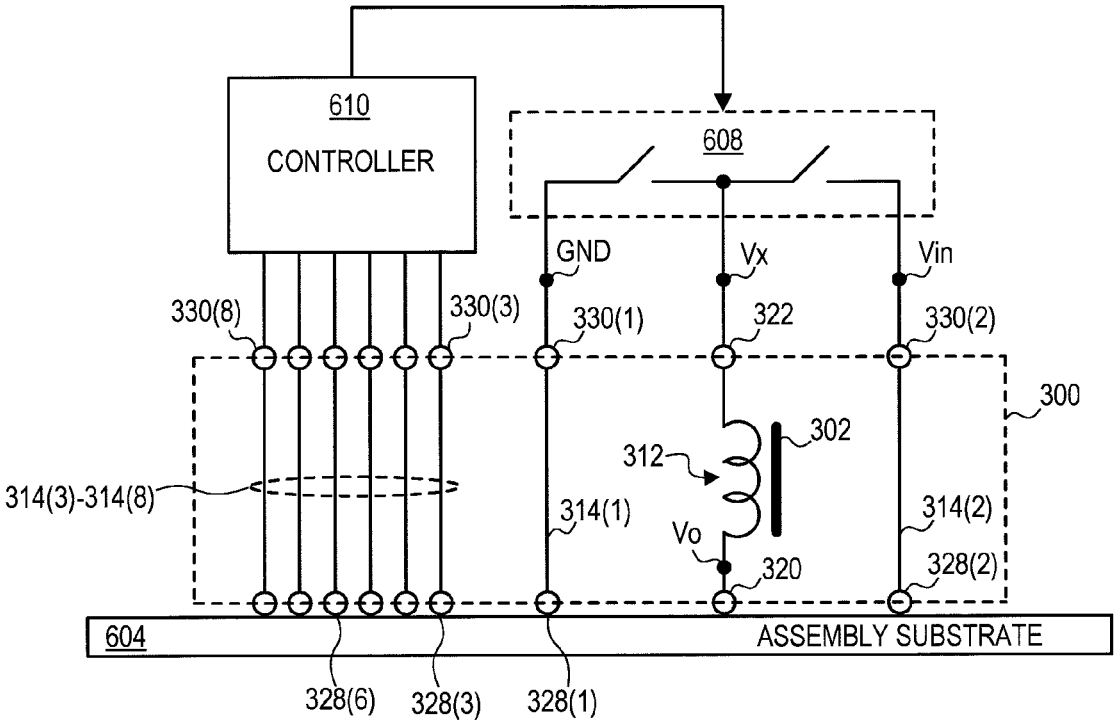
FIG. 7 shows a schematic of a power supply module of the FIG. 6 electrical assembly.

FIG. 6 shows one possible application of pin inductor 300. Specifically, FIG. 6 shows a side plan view of an electrical assembly 600 including a power supply module 602 coupled to an assembly substrate 604. Assembly substrate 604 is, for example, a printed circuit board, such as an information technology device motherboard. Power supply module 602, for example, provides power to at least one component of assembly substrate 604. FIG. 7 shows a schematic of power supply module 602, which has a buck-type topology. FIGS. 6 and 7 are best viewed together in the following discussion.

Power supply module 602 includes an instance of pin inductor 300, a module substrate 606, a switching circuit 608, and a controller 610. Controller 610 is adapted to control switching circuit 608, such as to cause switching circuit 608 to repeatedly switch winding second end 318 between two different voltage levels, namely between a positive input voltage and ground, at a frequency of at least one kilohertz. Switching circuit 608 includes at least one switching device, and in some embodiments, further includes one or more diodes. In the context of this disclosure, a switching device includes, but is not limited to, a bipolar junction transistor, a field effect transistor (e.g., a N-channel or P-channel metal oxide semiconductor field effect transistor, a junction field effect transistor, a metal semiconductor field effect transistor), an insulated gate bipolar junction transistor, a thyristor, or a silicon controlled rectifier. In some alternate embodiments, controller 610 and switching circuit 608 are combined in a single package. In some other alternate embodiments, controller 610 is omitted from power supply module 602, and switching circuit 608 is controlled by a device external to module 602, such as a controller on assembly substrate 604. Power supply module 602 typically includes additional components (not shown), such as capacitors, as required to form a buck-type DC-to-DC converter.

Pin inductor 300 electrically couples power supply module 602 to assembly substrate 604, and inductor 300 is sandwiched between assembly substrate 604 and module substrate 606, where assembly substrate 604 and module substrate 606 are each disposed in different planes. Accordingly, magnetic core first outer surface 304 faces assembly substrate 604, and magnetic core second outer surface 306 faces module substrate 606. Each first solder tab 320, 328 is soldered to a respective pad of assembly substrate 604, and each second solder tab 322, 330 is soldered to respective pad of module substrate 606.

Additional conductors 314(1), 314(2) are adapted to respectively couple module 602 to negative and positive nodes of an input power source. Thus, first solder terminal 328(1), second solder terminal 330(1), and additional conductor 314(1) form part of a negative input power node (GND). On the other hand, first solder terminal 328(2), second solder terminal 330(2), and additional conductor 314(2) form part of a positive input power node (Vin). Winding first solder terminal 320, in turn, is electrically coupled to an output node (Vo), while winding second solder terminal 322 is electrically coupled to a switching node (Vx).

In some embodiments, at least some of additional conductors 314(3)-314(8) are adapted to serve as data conductors electrically coupling analog and/or digital data signals between power supply module 602 and assembly substrate 604, such as shown in FIG. 7. Some examples of possible data signals include (1) signals generated by controller 610 indicating status of power supply module 602, such as module temperature, module load, and/or module voltage, (2) signals from assembly substrate 604 to module 602 providing status of assembly 600, such as voltage at a node of assembly 600 or current through a component of assembly 600, and (3) signals from assembly substrate 604 to module 602 controlling one or more aspects of module 602, such as a module on/off signal, a signal to control switching of switching circuit 608, or a module output voltage magnitude control signal, such as a voltage-identification ("VID") signal.

Although power supply module 602 is shown as having a buck-type topology, alternate embodiments having different topologies are possible. For example, in some alternate embodiments, first solder tabs 320, 328(1), 328(2) are respectively coupled to a positive input power node, a negative input power node, and an output power node, such that module 602 has a boost-type topology. As another example, in some other alternate embodiments, first solder tabs 320, 328(1), 328(2) are respectively coupled to a negative input power node, a positive input power node, and an output power node, such that module 602 has buck-boost-type topology. The number and configuration of additional conductors 314 may also be varied as a design choice. For example, in certain alternate embodiments, power supply module 602 does not communicate with assembly substrate 604 and additional conductors 314(3)-314(8) are therefore optionally omitted.

Figure 8:
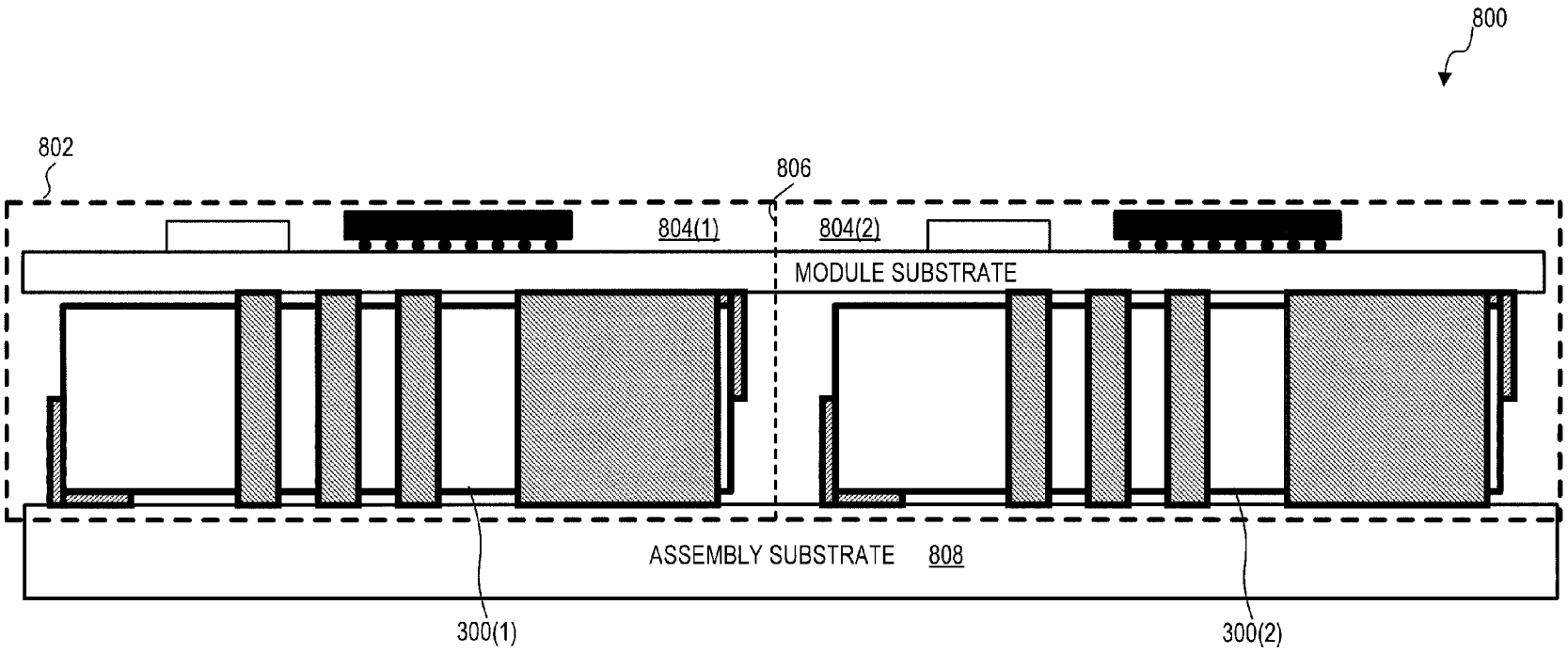
FIG. 8 shows a side plan view of an electrical assembly including two instances of the FIG. 3 pin inductor, according to an embodiment.

Additionally, module 602 can be modified to have additional power stages, where each power stage includes an instance of pin inductor 300. For example, FIG. 8 shows a side plan view of an electrical assembly 800, which is similar to assembly 600 (FIG. 6), but includes a power supply module 802 having two power stages 804, which are delineated by dashed line 806 in FIG. 8. Each power stage 804 includes a respective instance of pin inductor 300 and has a schematic like that of FIG. 7. Module 802 is coupled to an assembly substrate 808, such as an information technology device motherboard, via pin inductors 300. In some embodiments, electrical assembly 800 is configured such that each power stage 804 provides a separate power rail for assembly substrate 808, such as two power rails at different voltage levels. In some other embodiments, electrical assembly 800 is configured such that power stages 804 are electrically coupled in parallel on assembly substrate 808, such as to provide a high current power rail. In these embodiments, the parallel coupled power stages 804 are optionally adapted to switch out of phase with respect to each other to promote low ripple current magnitude and fast transient response.

Figure 9:
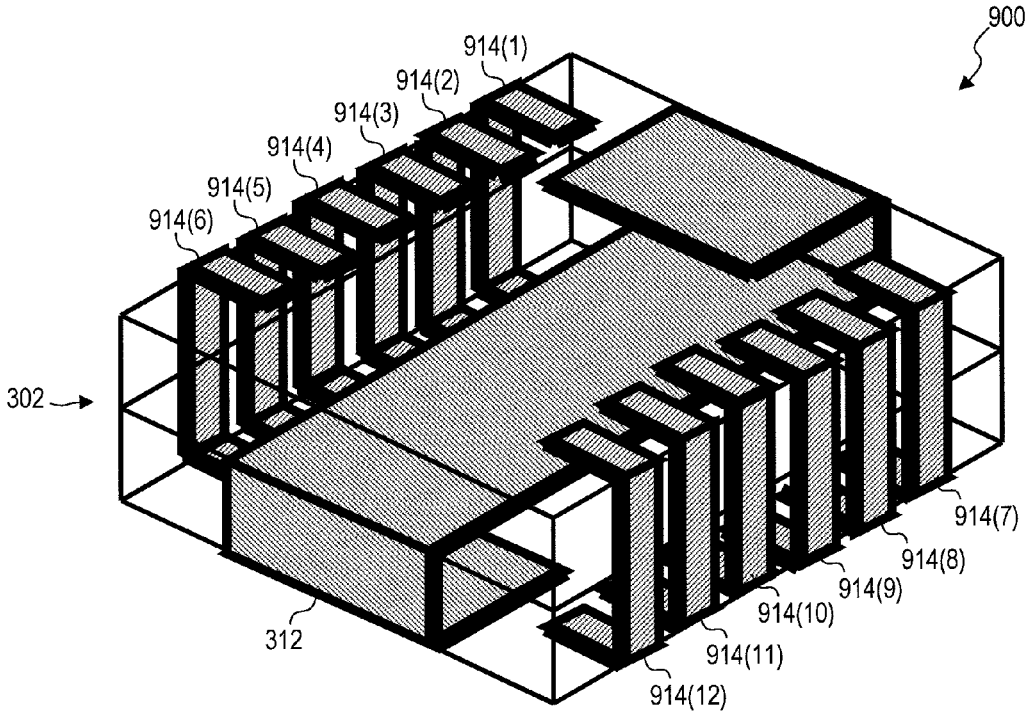
FIG. 9 shows a perspective view of alternate embodiment of the FIG. 3 pin inductor.

FIG. 9 shows a perspective view of a pin inductor 900 with magnetic core 302 shown as transparent. Pin inductor 900 is similar to pin inductor 300 (FIG. 3), but includes additional conductors 914 in place of additional conductors 314. Additional conductors 914 are like additional conductors 314, but each instance of additional conductor 914 has the same configuration, thereby promoting manufacturing simplicity. Additionally, the fact that each additional conductor 914 has the same configuration may promote printed circuit board layout simplicity in applications where inductor 900 is coupled to one or more circuit boards, such as in an application similar to that discussed above with respect to FIG. 6.

In certain applications, two or more instances of additional conductor 914 are electrically coupled in parallel to provide low impedance coupling. For example, in a buck-type DC-to-DC converter application with a large input voltage to output voltage ratio, input current magnitude will be relatively small. Accordingly, in such DC-to-DC converter applications of inductor 900, the converter is optionally configured such that a relatively small number of additional conductor 914 instances couple input current, while a relatively large number of additional conductor 914 instances couple higher magnitude current, such as return current. For example, one alternate embodiment of electrical assembly 600 (FIG. 6) includes pin inductor 900 in place of pin inductor 300. In this embodiment, four instances of additional conductor 914 are used to couple module 902 to a negative input power source node, while only two instances of additional conductor 914 are used to couple module 902 to a positive input power source node.

Although the pin inductor examples discussed above have foil windings, the pin inductors disclosed herein are not limited to foil windings. For example, the windings could alternately be formed of conductive film, such as in cases where the magnetic core is formed of multiple layers of magnetic film. As another example, the windings could alternately be wire windings. Both conductive film and wire windings may facilitate forming multiple turns. Multiple turn windings promote low magnetic flux density, thereby potentially lowering core losses and/or enabling use of a lower magnetic permeability core material, compared to embodiments with single-turn windings.

Figure 10:
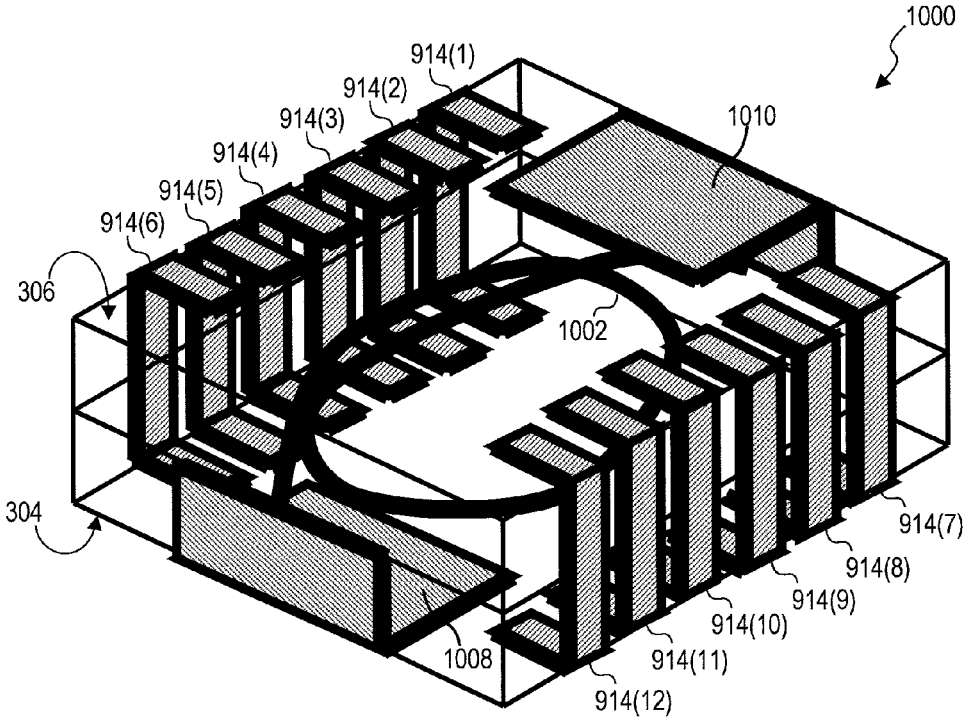
FIG. 10 shows a perspective view of a pin inductor similar to that of FIG. 9, but with a wire winding, according to an embodiment.
Figure 11:
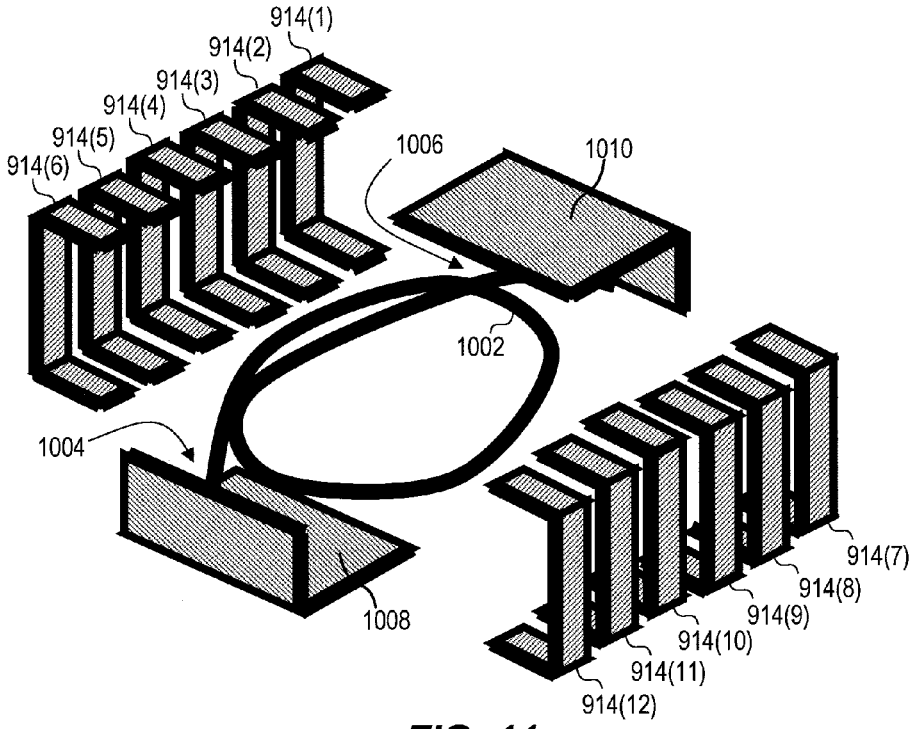
FIG. 11 shows an exploded perspective view of the FIG. 10 pin inductor without its magnetic core.

FIG. 10 shows one example of a pin inductor including a wire winding. In particular, FIG. 10 shows a perspective view of a pin inductor 1000, which is similar to pin inductor 900 (FIG. 9), but includes a wire winding 1002 in place of foil winding 312. Magnetic core 302 is shown as transparent in FIG. 10, and FIG. 11 shows an exploded perspective view of inductor 1000 without magnetic core 302. Opposing first and second ends 1004, 1006 of winding 1002 are electrically coupled to first and second solder tabs 1008, 1010, respectively (see FIG. 11). First solder tab 1008 forms a surface on magnetic core first outer surface 304 that is adapted for surface mount soldering to a substrate, and second solder tab 1010 forms a surface on magnetic core second outer surface 306 that is adapted for surface mount soldering to a substrate. Thus, first solder tab 1008 is adapted for surface mount soldering to a first substrate in a first plane, and second solder tab 1010 is adapted for surface mount soldering to a second substrate in a second plane, where the second plane is different from the first plane.

Figure 12:
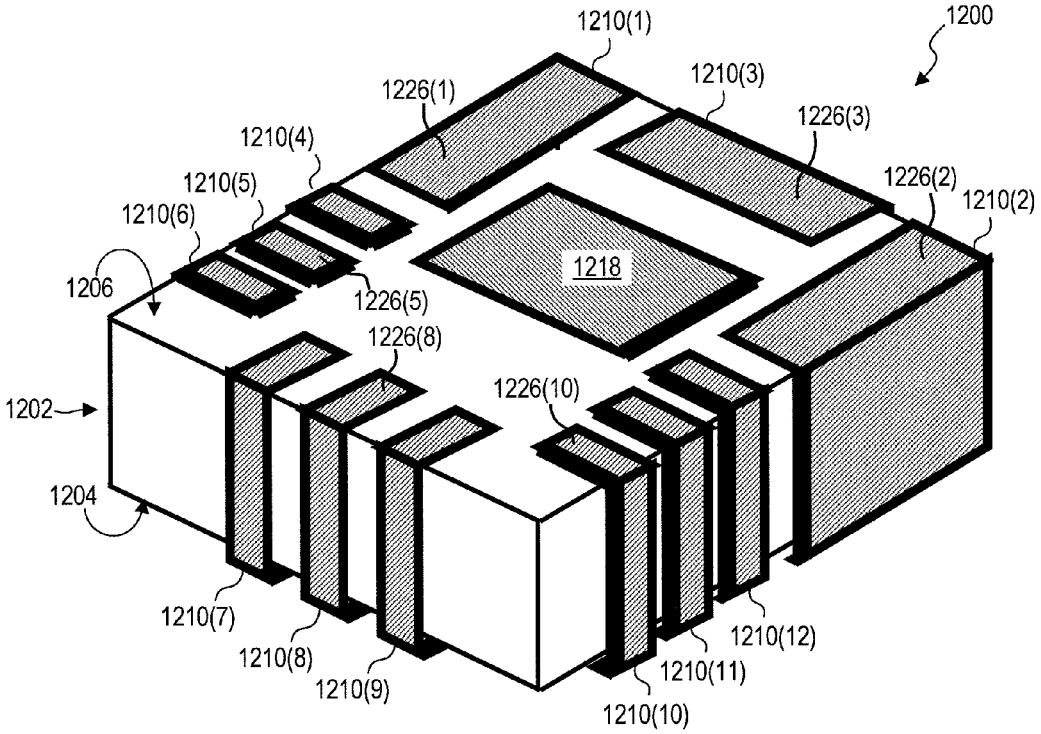
FIG. 12 shows a perspective view of another pin inductor.
Figure 13:
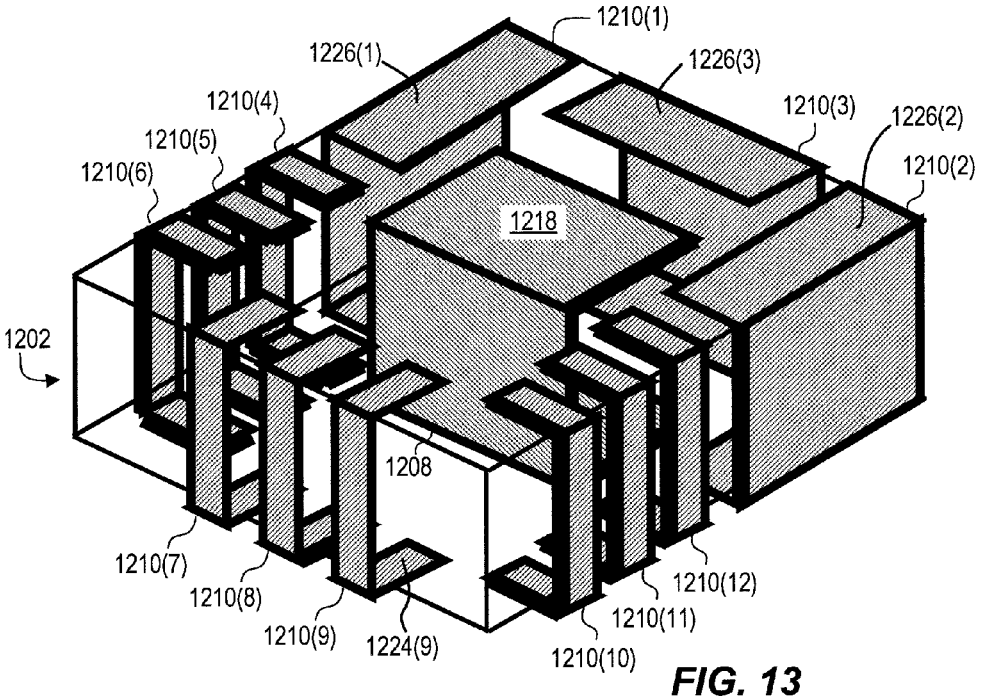
FIG. 13 shows a perspective view of the FIG. 12 pin inductor with its magnetic core shown as transparent, according to an embodiment.
Figure 14:
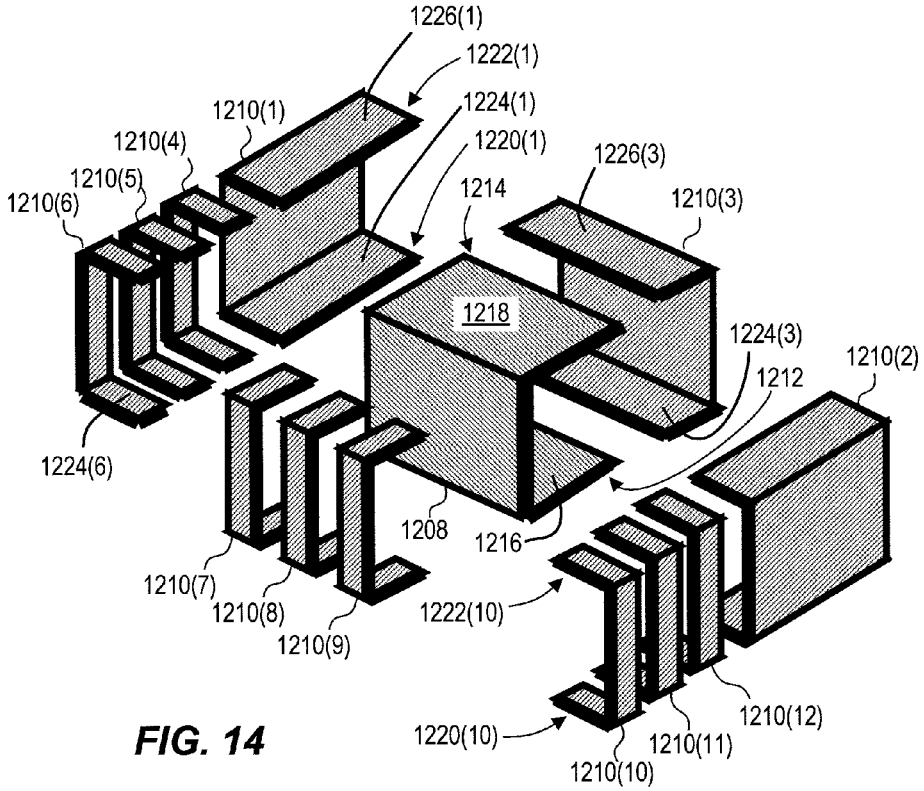
FIG. 14 shows an exploded perspective view of the FIG. 12 pin inductor without its magnetic core.

FIG. 12 shows a perspective view of a pin inductor 1200 including a magnetic core 1202. FIG. 13 shows a perspective view of inductor 1200 with magnetic core 1202 shown as transparent, and FIG. 14 shows an exploded perspective view of inductor 1200 without magnetic core 1202. Magnetic core 1202 has opposing first and second outer surfaces 1204, 1206.

Pin inductor 1200 further includes a winding 1208 and additional conductors 1210. Winding 1208 is around a portion of magnetic core 1202 such that winding 1208 is wound through magnetic core 1202. Additional conductors 1210, however, are not wound through magnetic core 1202, and magnetic core 1202 does not form a magnetic path loop around additional conductors 1210. Thus, inductance associated with winding 1208 is typically significantly greater than inductance associated with additional conductors 1210. Although inductor 1200 is shown as including twelve additional conductors 1210, the number and configuration of additional conductors 1210 can be varied.

Winding 1208 has opposing first and second ends 1212, 1214 (see FIGS. 13 and 14). First end 1212 forms a first solder tab 1216 on magnetic core first outer surface 1204, and second end 1214 forms a second solder tab 1218 on magnetic core second outer surface 1206. Similarly, each additional conductor 1210 has respective opposing first and second ends 1220, 1222. Each first end 1220 forms a respective first solder tab 1224 on magnetic core first outer surface 1204, and each second end 1222 forms a respective second solder tab 1226 on magnetic core second outer surface 1206. Thus, first solder tabs 1216, 1224 are each adapted for surface mount soldering to a first substrate in a first plane, and second solder tabs 1218, 1226 are each adapted for surface mount soldering to a second substrate in a second plane, where the second plane is different from the first plane. Only some of first and second ends 1220, 1222 and first and second solder tabs 1224, 1226 are labeled for illustrative clarity.

One possible application of pin inductor 1200 is an electrical assembly similar to that of FIG. 6 or 8. For example, some alternate embodiments of electrical assembly 600 (FIG. 6) include pin inductor 1200 in place of pin inductor 300. In certain of these embodiments, additional conductors 1210(1), 1210(2) couple module 602 to a negative input power supply node, additional conductor 1210(3) couples module 602 to a positive input power supply node, and winding 1208 is electrically coupled between switching node Vx and input power node Vin. Some or all of additional conductors 1210(4)-1210(12) couple data signals between assembly substrate 604 and module 602 in certain of these embodiments.

Figure 15:
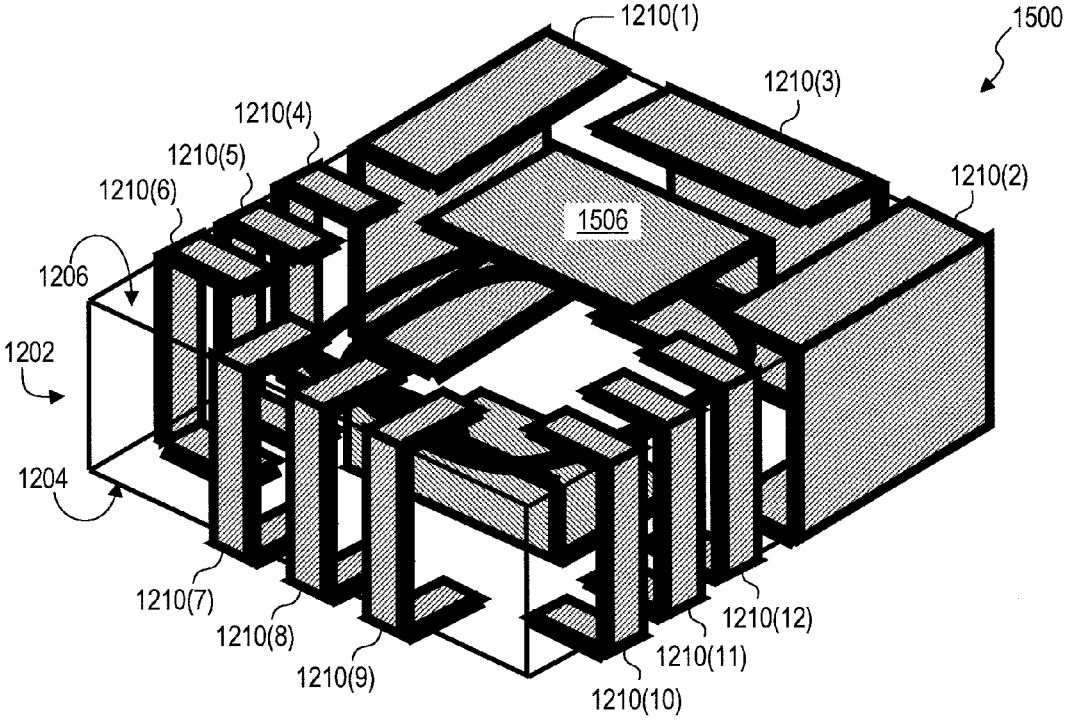
FIG. 15 shows a perspective view of a pin inductor similar to that of FIG. 12, but with a wire winding, according to an embodiment.
Figure 16:
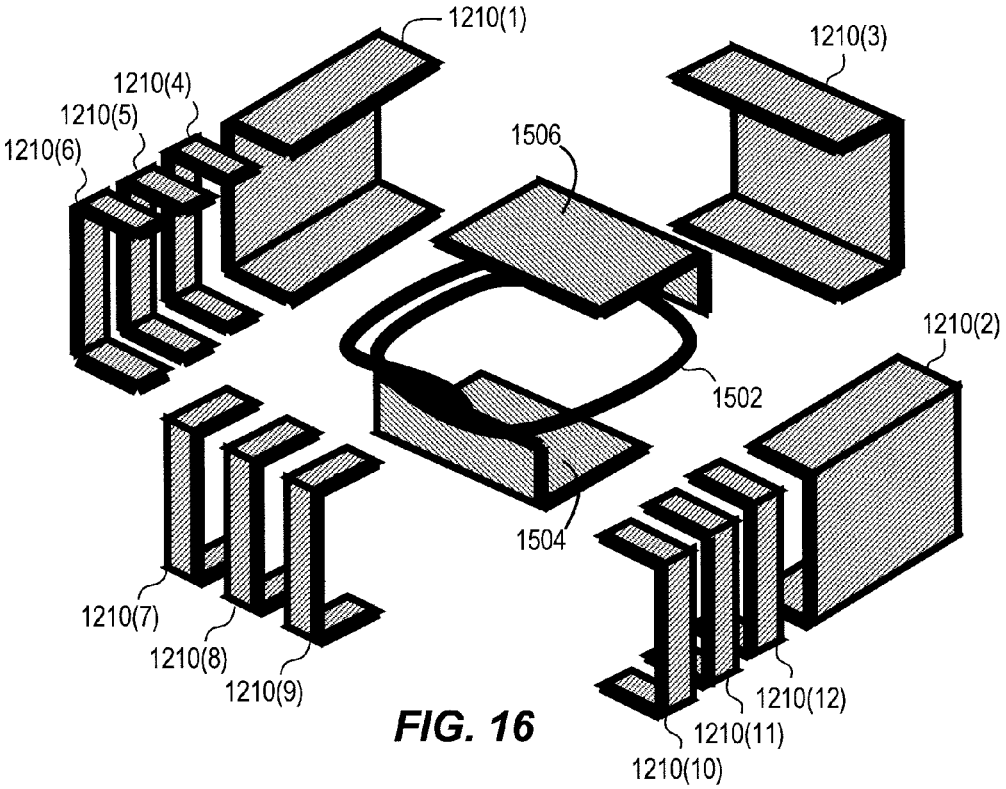
FIG. 16 shows an exploded perspective view of the FIG. 15 pin inductor without its magnetic core.

FIG. 15 shows a perspective view of a pin inductor 1500, which is similar to inductor 1200 (FIG. 12), but with foil winding 1208 replaced with a wire winding 1502. Opposing ends of wire winding 1502 are electrically coupled to first and second solder tabs 1504, 1506 (see FIG. 16). First solder tab 1504 forms a surface on magnetic core first outer surface 1204 adapted for surface mount soldering to a first substrate in a first plane, and second solder tab 1506 forms a surface on magnetic core second outer surface 1206 adapted for surface mount soldering to a second substrate in a second plane, where the second plane is different from the first plane. Magnetic core 1202 is shown as transparent in FIG. 15, and FIG. 16 shows an exploded perspective view of pin inductor 1500 with magnetic core 1202 omitted.

Figure 17:
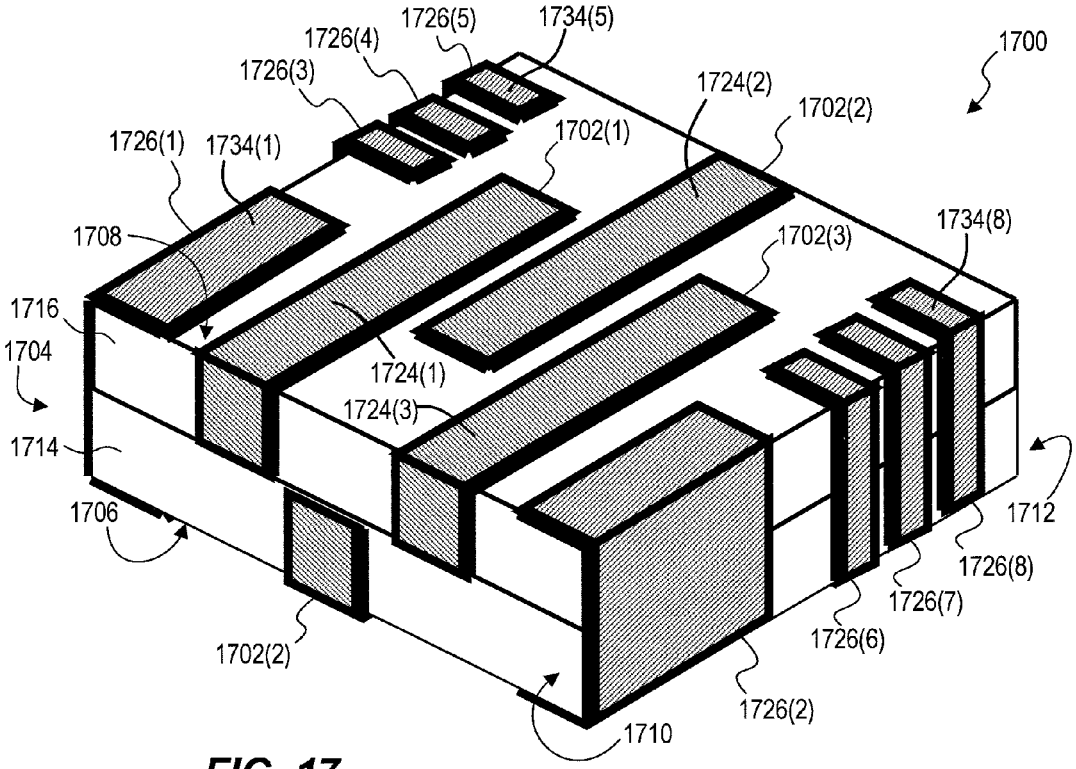
FIG. 17 shows a perspective view of a pin inductor including multiple windings.
Figure 18:
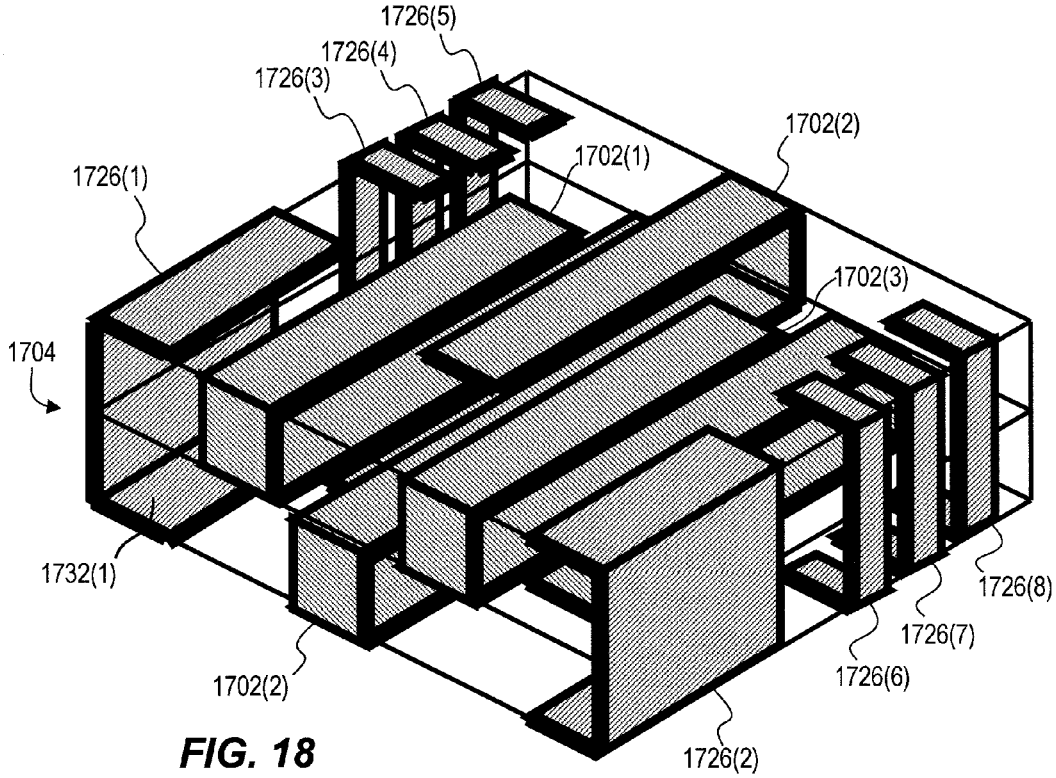
FIG. 18 shows a perspective view of the FIG. 17 inductor with its magnetic core shown as transparent, according to an embodiment.
Figure 19:
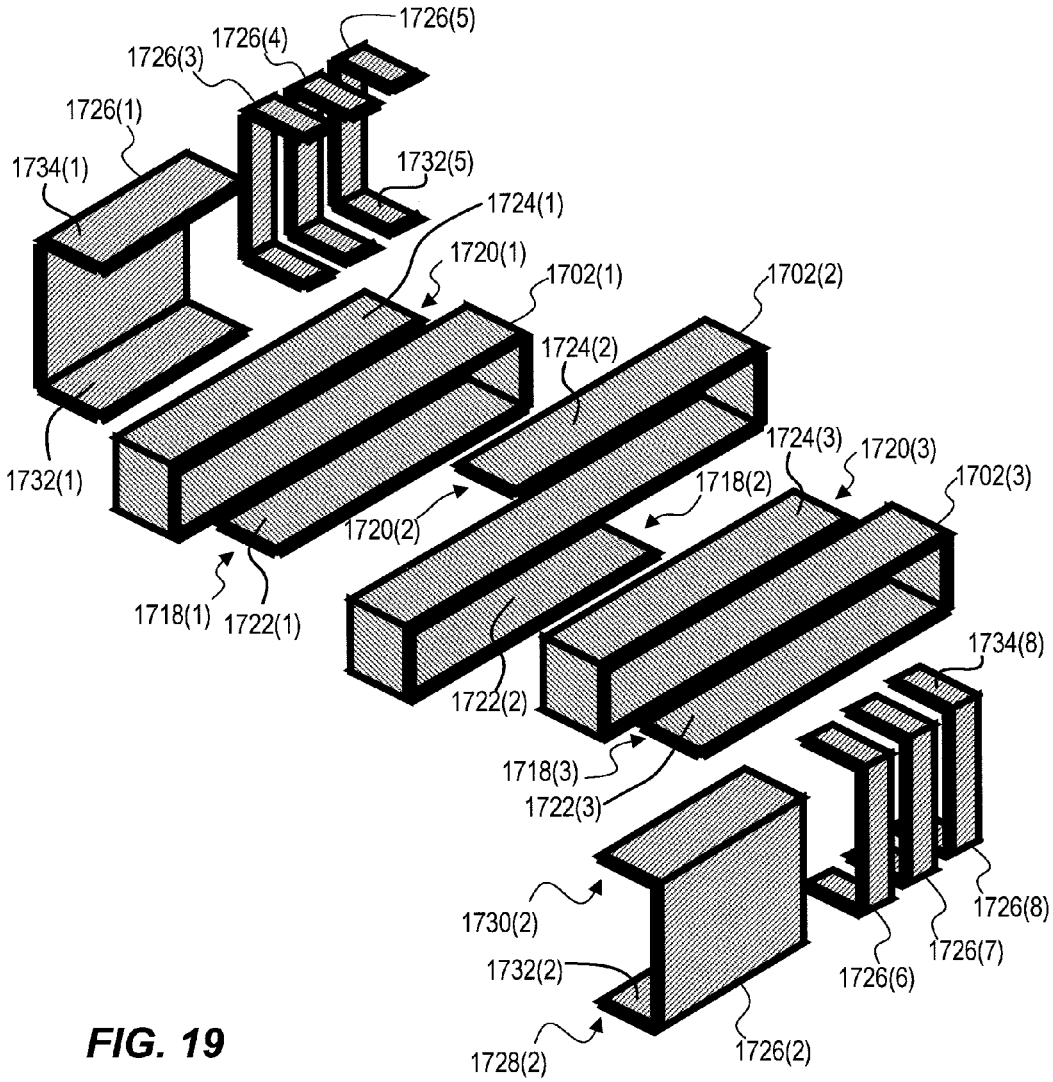
FIG. 19 shows an exploded perspective view of the FIG. 17 pin inductor without its magnetic core.

The pins inductors discussed above with respect to FIGS. 3-16 each include one winding. However, some pin inductor embodiments include multiple windings. For example, FIG. 17 shows a perspective view of a pin inductor 1700 including multiple windings 1702, where each winding 1702 is wound around a respective portion of a magnetic core 1704, such that each winding 1702 is wound through a magnetic core 1704. Although inductor 1700 is shown with three windings 1702, inductor 1700 could be modified to have any number of windings greater than one. FIG. 18 shows a perspective view of inductor 1700 with magnetic core 1704 shown as transparent, and FIG. 19 shows an exploded perspective view of inductor 1700 without magnetic core 1704. Magnetic core 1704 has opposing first and second outer surfaces 1706, 1708 and opposing first and second sides 1710, 1712. Magnetic core 1704 is shown as being formed of first and second magnetic elements 1714, 1716, which in some embodiments are ferrite or powder iron magnetic elements. However, the configuration of magnetic core 1704 may vary. For example, in certain alternate embodiments, magnetic core 1704 is formed of two or more other magnetic elements, such as magnetic elements formed of ferrite or a similar magnetic material, which are joined together. As another example, in some other alternate embodiments, magnetic core 1704 is a single-piece block core, such as formed of a molded magnetic material.

Each winding 1702 has opposing first and second ends 1718, 1720 (see FIG. 19). Each first end 1718 forms a first solder tab 1722 on magnetic core first outer surface 1706, and each second end 1720 forms a second solder tab 1724 on magnetic core second outer surface 1708. Windings 1702 are wound through magnetic core 1704 in alternating opposing directions. Thus, winding first ends 1718 wrap around alternating opposing sides 1710, 1712 of magnetic core 1704, and winding second ends 1720 also wrap around alternating opposing sides 1710, 1712 of magnetic core 1704. For example, winding 1702(1) first end 1718(1) wraps around core second side 1712, winding 1702(2) first end 1718(2) wraps around core first side 1710, and winding 1702(3) first end 1718(3) wraps around core second side 1712.

Pin inductor 1700 further includes additional conductors 1726, each having opposing first and second ends 1728, 1730. Each first end 1728 forms a respective first solder tab 1732 on magnetic core first outer surface 1706, and each second end 1730 forms a respective second solder tab 1734 on magnetic core second outer surface 1708. Only some of first and second ends 1728, 1730 and first and second solder tabs 1732, 1734 are labeled to promote illustrative clarity. First solder tabs 1722, 1732 are each adapted for surface mount soldering to a first substrate in a first plane, and second solder tabs 1724, 1734 are each adapted for surface mount soldering to a second substrate in a second plane, where the second plane is different from the first plane Magnetic core 1704 does not form a magnetic path loop around additional conductors 1726. Thus, inductance associated with windings 1702 will typically be significantly greater than inductance associated with additional conductors 1726. Although inductor 1700 is shown including eight additional conductors 1726, the number and configuration of additional conductors 1726 may varied.

Figure 20:
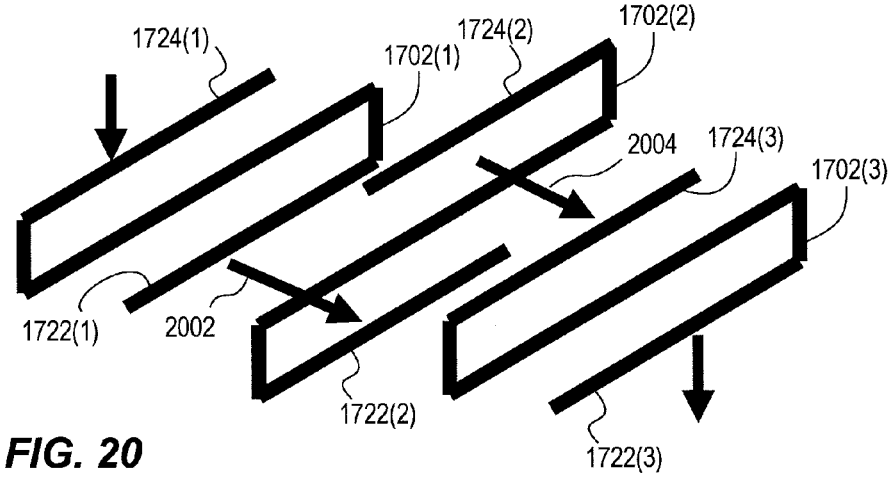
FIG. 20 symbolically shows one possible manner of connecting the FIG. 17 pin inductor's windings to form a multi-turn inductor, according to an embodiment.

Pin inductor 1700 is used as a multi-turn inductor in some applications by electrically coupling windings 1702 in series. For example, in some applications, first solder tabs 1722(1) and 1722(2) are electrically coupled by a first conductor 2002, and second solder tabs 1724(2) and 1724(3) are electrically coupled by a second conductor 2004, as symbolically shown in FIG. 20. In multi-turn applications where pin inductor 1700 is sandwiched between first and second substrates, first conductor 2002 can be embodied by a conductive trace on the first substrate, and second conductor 2004 can be embodied by a conductive trace on the second substrate. For example, another alternate embodiment of electrical assembly 600 (FIG. 6) includes pin inductor 700 configured as a multi-turn inductor in place of pin inductor 300. In this embodiment, first solder tabs 1722(1) and 1722(2) are electrically coupled by a conductor on assembly substrate 604, and second solder tabs 1724(2) and 1724(3) are electrically coupled by a conductor on module substrate 606. Additionally, second solder tab 1724(1) is electrically coupled to switching node Vx on module substrate 606, and first solder tab 1724(3) is electrically coupled to output node Vo on assembly substrate 604, in this embodiment.

Figure 21:
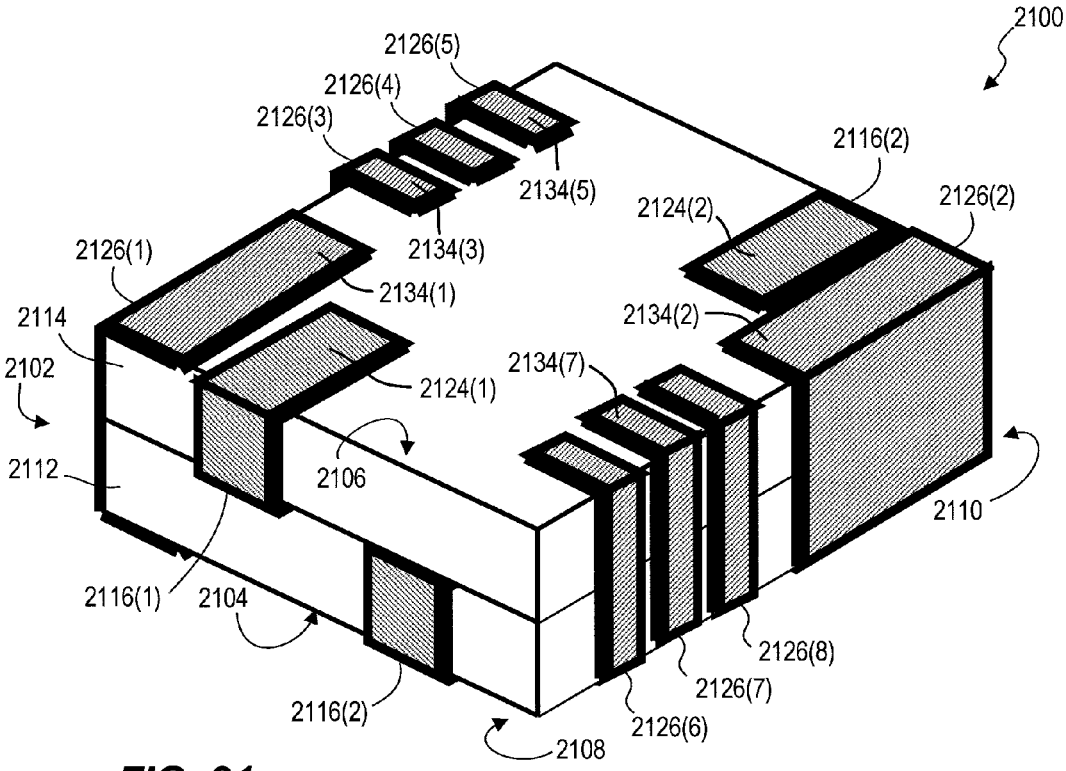
FIG. 21 shows a perspective view of a pin coupled inductor.
Figure 22:
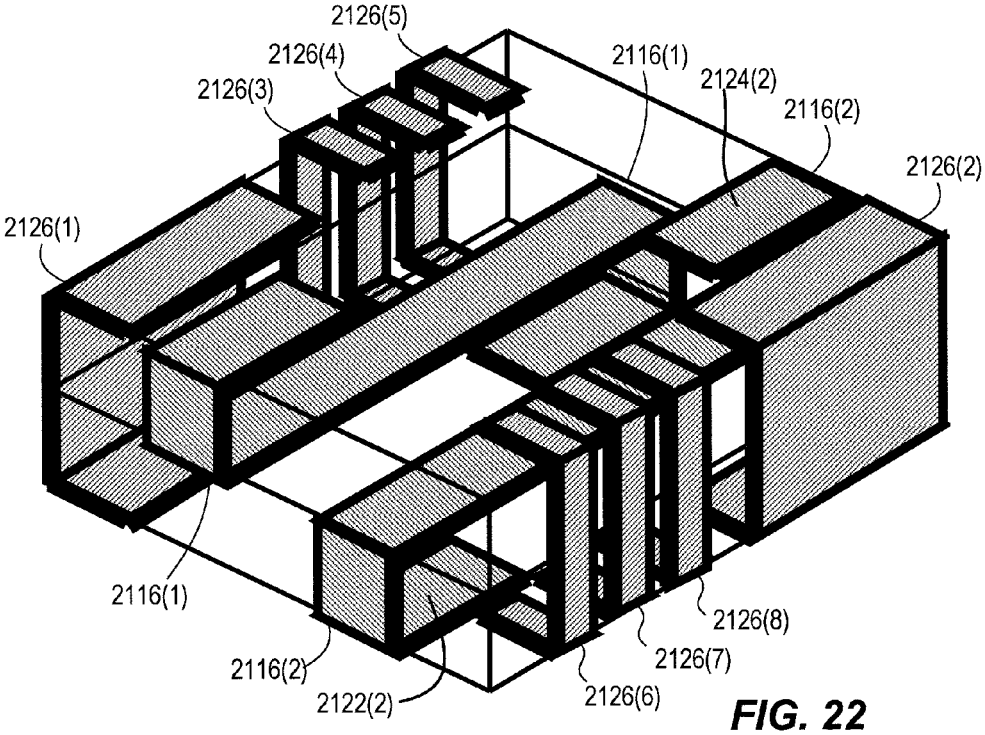
FIG. 22 shows a perspective view of the FIG. 21 inductor with its magnetic core shown as transparent, according to an embodiment.
Figure 23:
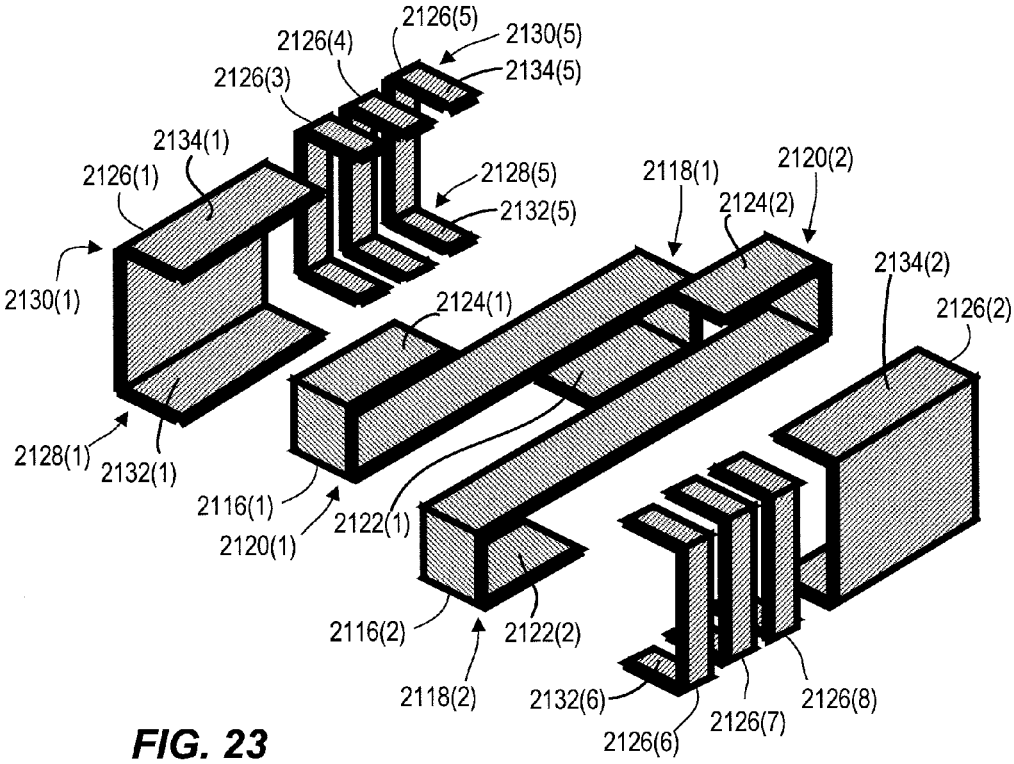
FIG. 23 shows an exploded perspective view of the FIG. 21 pin coupled inductor without its magnetic core.

Some pin inductor embodiments are coupled inductors. For example, FIG. 21 shows a perspective view of a pin coupled inductor 2100. Coupled inductor 2100 includes a magnetic core 2102 having opposing first and second outer surfaces 2104, 2106 and opposing first and second sides 2108, 2110. FIG. 22 shows a perspective view of coupled inductor 2100 with magnetic core 2102 shown as transparent, and FIG. 23 shows an exploded perspective view of inductor 2100 without magnetic core 2102. Magnetic core 2102 is shown as being formed of first and second magnetic elements 2112, 2114, which in some embodiments are ferrite or powder iron magnetic elements. However, the configuration of magnetic core 2102 may vary. For example, in certain alternate embodiments, magnetic core 2102 is formed of two or more other magnetic elements, such as magnetic elements formed of ferrite or a similar magnetic material, which are joined together. As another example, in some other alternate embodiments, magnetic core 2102 is a single-piece block core, such as formed of a molded magnetic material.

Pin coupled inductor 2100 includes two windings 2116 wound around respective portions of magnetic core 2102, such that each winding 2116 is wound through magnetic core 2102. Each winding 2116 has opposing first and second ends 2118, 2120 (see FIG. 23). Each winding first end 2118 forms a respective first solder tab 2122 on magnetic core first outer surface 2104, and each winding second end 2120 forms a respective second solder tab 2124 on magnetic core second outer surface 2106. Windings 2116 are wound through magnetic core 2102 in opposite directions. In particular, winding 2116(1) first end 2118(1) is wound around core second side 2110, while winding 2116(2) first end 2118(2) is wound around core first side 2108. Winding 2116(1) second end 2120(1), on the other hand, is wound around core first side 2108, while winding 2116(2) second end 2120(2) is wound around core second side 2110. Consequentially, current of increasing magnitude flowing into winding 2116(1) first end 2118(1) induces current of increasing magnitude flowing into winding 2116(2) first end 2118(2).

Pin coupled inductor 2100 further includes at least one additional conductor 2126. Although FIGS. 21-23 show an embodiment with eight additional conductors 2126, the number and configuration of additional conductors 2126 may be varied. Magnetic core 2102 does not form a magnetic path loop around additional conductors 2126. Thus, inductance associated with windings 2116 will typically be significantly greater than inductance associated with additional conductors 2126. Each additional conductor 2126 has opposing first and second ends 2128, 2130 (see FIG. 23). Each first end 2128 forms a respective first solder tab 2132 on magnetic core first outer surface 2104, and each second end forms a respective second solder tab 2134 on magnetic core second outer surface 2106. Only some of first and second ends 2128, 2130 and first and second solder tabs 2132, 2134 are labeled to promote illustrative clarity. Each first solder tab 2122, 2132 is adapted for surface mount soldering to a first substrate in a first plane, and each second solder tab 2124, 2134 is adapted for surface mount soldering to a second substrate in a second plane, where the second plane is different from the first plane.

Figure 24:
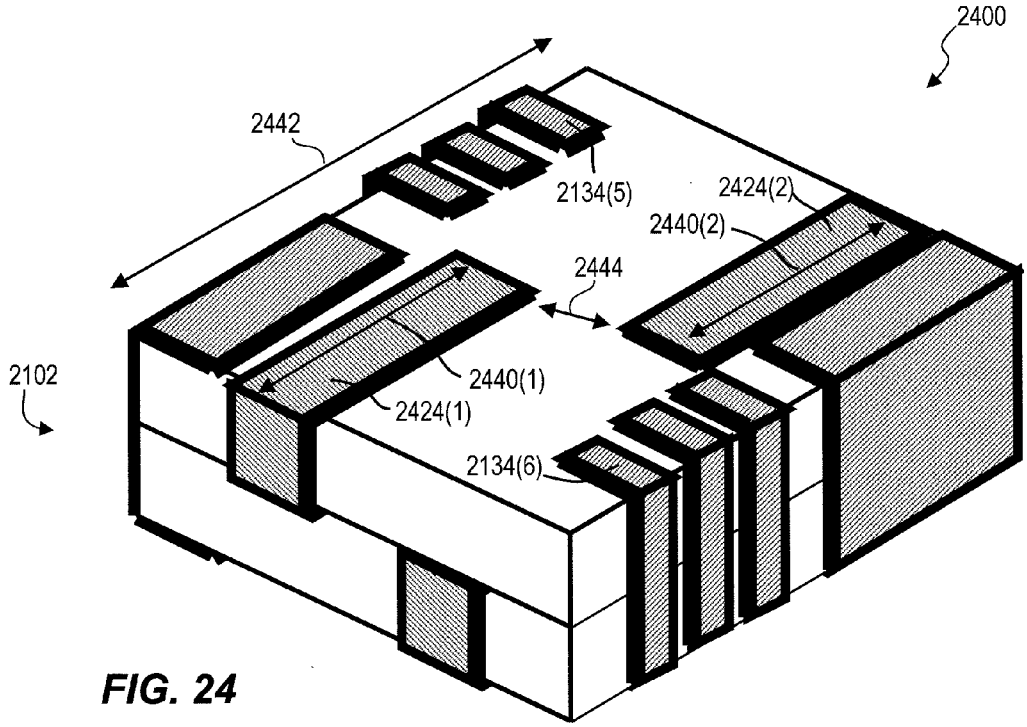
FIG. 24 shows a perspective view of a pin coupled inductor similar to that of FIG. 21, but having longer winding solder tabs, according to an embodiment.

FIG. 24 shows a perspective view of a pin coupled inductor 2400. Coupled inductor 2400 is similar to coupled inductor 2100 (FIG. 21), but coupled inductor 2400 includes winding second solder tabs 2424 in place of winding second solder tabs 2124. Second solder tabs 2424 are longer than solder tabs 2124, and in some embodiments, each solder tab 2424 has a respective length 2440 that is at least 40% of magnetic core 2102 depth 2442. The relatively long length 2440 of solder tabs 2424 promotes small separation distance 2444 between solder tabs 2424, which may be desirable in applications where both second solder tabs 2424 are electrically coupled to common circuitry. In particular, a relatively short solder tab separation distance 2444 promotes short conductor length between solder tab tabs 2424 and the common circuitry, thereby helping to minimize conductor impedance induced losses and voltage distortion.

Figure 25:
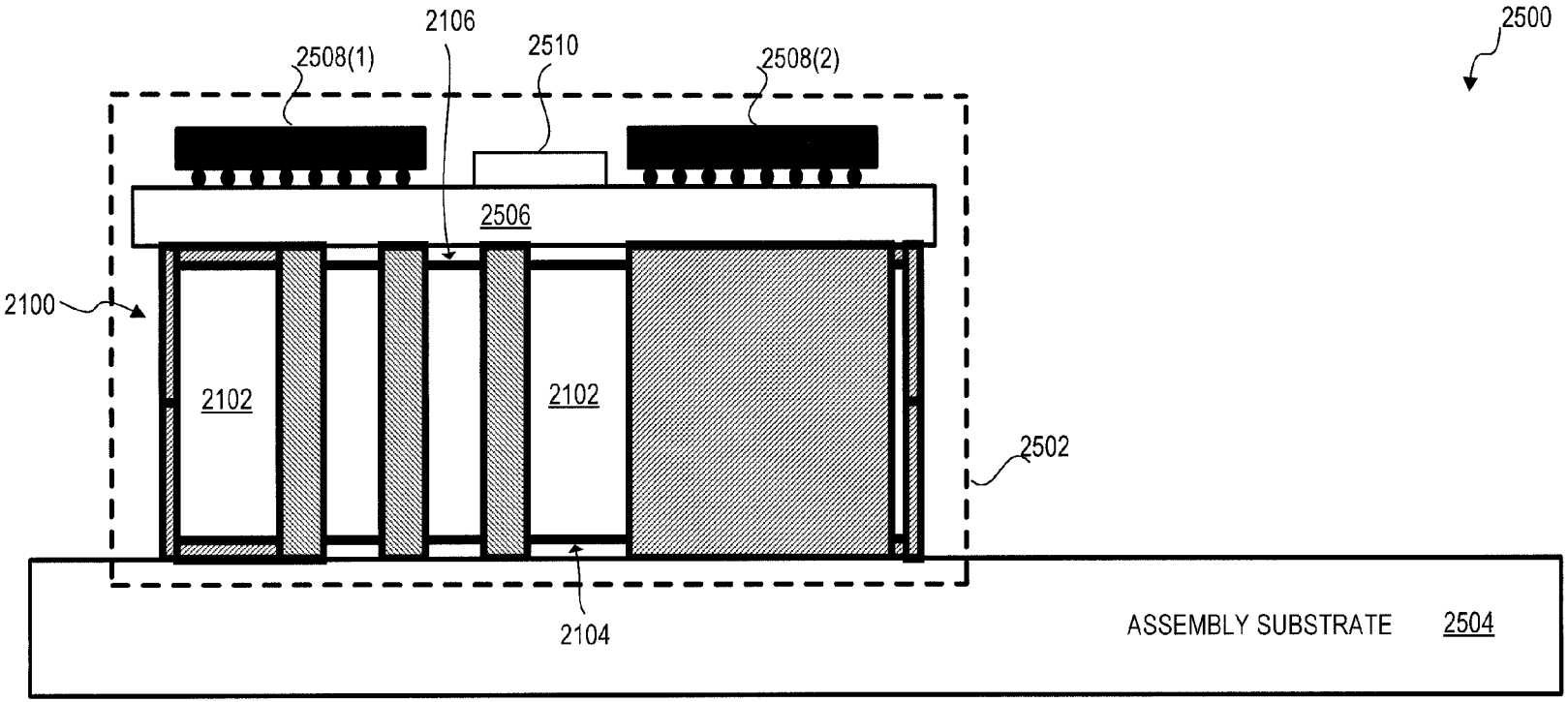
FIG. 25 shows a side plan view of an electrical assembly including an instance of the pin coupled inductor of FIG. 21, according to an embodiment.
Figure 26:
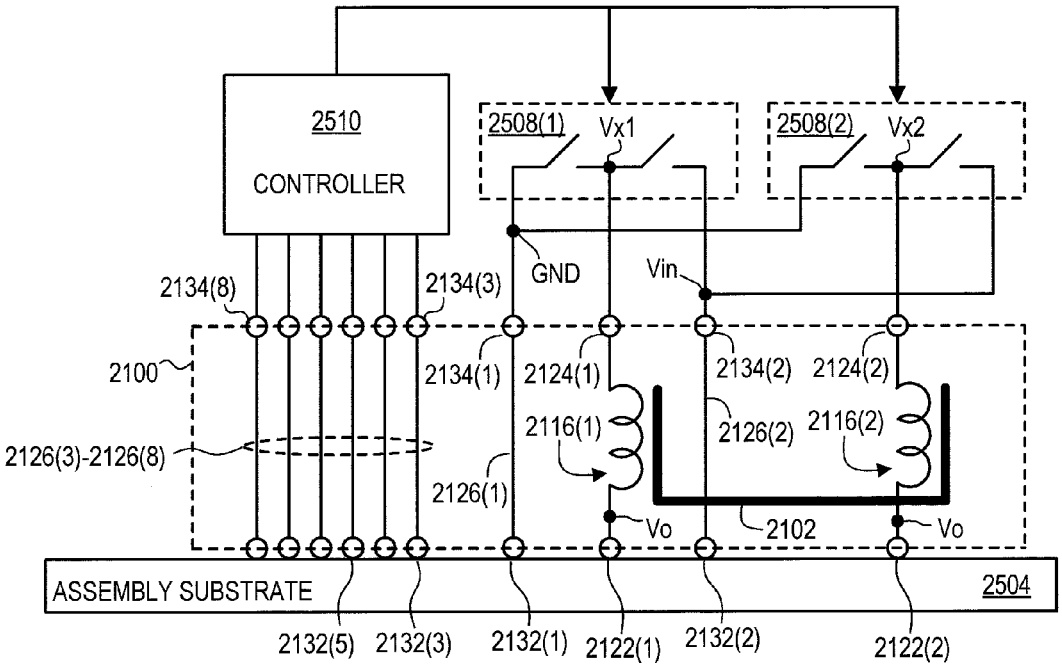
FIG. 26 shows a schematic of a power supply module of the FIG. 25 electrical assembly.

FIG. 25 shows one possible application of pin coupled inductor 2100. Specifically, FIG. 25 shows a side plan view of an electrical assembly 2500 including a power supply module 2502 coupled to an assembly substrate 2504. Assembly substrate 2504 is, for example, a printed circuit board, such as an information technology device motherboard. Power supply module 2502, for example, provides power to at least one component of assembly substrate 2504. FIG. 26 shows a schematic of power supply module 2502, which has a two-phase buck-type topology. FIGS. 25 and 26 are best viewed together in the following discussion.

Power supply module 2502 includes an instance of pin inductor 2100, a module substrate 2506, two switching circuits 2508, and a controller 2510. Switching circuit 2508(1) and first winding 2116(1) collectively form part of a first phase, and switching circuit 2508(2) and second winding 2116(2) collectively form part of a second phase. Controller 2510 is adapted to cause switching circuit 2508(1) to switch first winding 2116(1) second end 2120(1) between two different voltage levels, namely between a positive input voltage and ground, at a frequency of at least one kilohertz. Controller 2510 is also adapted to cause switching circuit 2508(2) to switch second winding 2116(2) second end 2120(2) between the positive input voltage and ground, at a frequency of at least one kilohertz. In some embodiments, controller 2510 is adapted to cause switching devices 2508 to switch out of phase with respect to each other to promote low ripple current magnitude and fast transient response. Each switching circuit 2508 includes at least one switching device, and in some embodiments, further includes one or more diodes. In some alternate embodiments, controller 2510 is omitted from power supply module 2502, and switching circuits 2508 are controlled by a device external to module 2502, such as a controller on assembly substrate 2504. In some other alternate embodiments, controller 2510 and switching circuits 2508(1) and 2508(2) are combined into a single package or a single monolithic integrated circuit. Power supply module 2502 typically includes additional components (not shown), such as capacitors, as required to form a buck-type DC-to-DC converter.

Pin inductor 2100 electrically couples power supply module 2502 to assembly substrate 2504, and inductor 2100 is sandwiched between assembly substrate 2504 and module substrate 2506, where assembly substrate 2504 and module substrate 2506 are disposed in different respective planes. Accordingly, magnetic core first outer surface 2104 faces assembly substrate 2504, and magnetic core second outer surface 2106 faces module substrate 2506. Each first solder tab 2122, 2132 is soldered to a respective pad of assembly substrate 2504, and each second solder tab 2124, 2134 is soldered to a respective pad of module substrate 2506.

Additional conductors 2126(1), 2126(2) are adapted to respectively couple module 2502 to negative and positive nodes of an input power source. Thus, first solder terminal 2132(1), second solder terminal 2134(1), and additional conductor 2126(1) form part of a negative input power node (GND). On the other hand, first solder terminal 2132(2), second solder terminal 2134(2), and additional conductor 2126(2) form part of a positive input power node (Vin). Winding first solder terminals 2122, in turn, are electrically coupled to an output node (Vo), while winding 2116(1) second solder terminal 2124(1) is electrically coupled to a switching node (Vx1) of the first phase, and winding 2116(2) second solder terminal 2124(2) is electrically coupled to a switching node (Vx2) of a second phase.

In some embodiments, at least some of additional conductors 2126(3)-2126(8) are adapted to serve as data conductors electrically coupling analog and/or digital data signals between power supply module 2502 and assembly substrate 2504, such as shown in FIG. 26. Some examples of possible data signals include (1) signals generated by controller 2510 indicating status of power supply module 2502, such as module temperature, module load, and/or module voltage, (2) signals from assembly substrate 2504 to module 2502 providing status of assembly 2500, such as voltage at a node of assembly 2500 or current through a component of assembly 2500, and (3) signals from assembly substrate 2504 to module 2502 controlling one or more aspects of module 2502, such as a module on/off signal, a signal to control switching of switching circuit 2508, or a module output voltage magnitude control signal, such as a voltage-identification ("VID") signal.

Although power supply module 2502 is shown as having a two-phase buck-type topology, module 2502 could be modified to have additional phases. Such alternate embodiments with additional phases include either (i) one or more additional pin coupled inductors to support the additional phases, and/or (ii) a pin coupled inductor with additional windings to support the additional phases, such as discussed below. Alternate embodiments with different topologies, such as a multi-phase boost-type or a multi-phase buck-boost-type topology, are possible. For example, in some alternate embodiments, first solder tabs 2122 are electrically coupled to a positive input power node, and first solder tabs 2132(1), 2132(2) are respectively coupled to a negative input power node and an output power node, such that module 2502 has a boost-type topology. As another example, in some other alternate embodiments, first solder tabs 2122 are electrically coupled to a negative input power node, and first solder tabs 2132(1), 2132(2) are respectively coupled to a positive input power node and an output power node, such that module 2502 has buck-boost-type topology. The number and configuration of additional conductors 2126 may also be varied as a design choice. For example, in certain alternate embodiments, power supply module 2502 does not communicate with assembly substrate 2504, and additional conductors 2126(3)-2126(18) are therefore optionally omitted.

Figure 27:
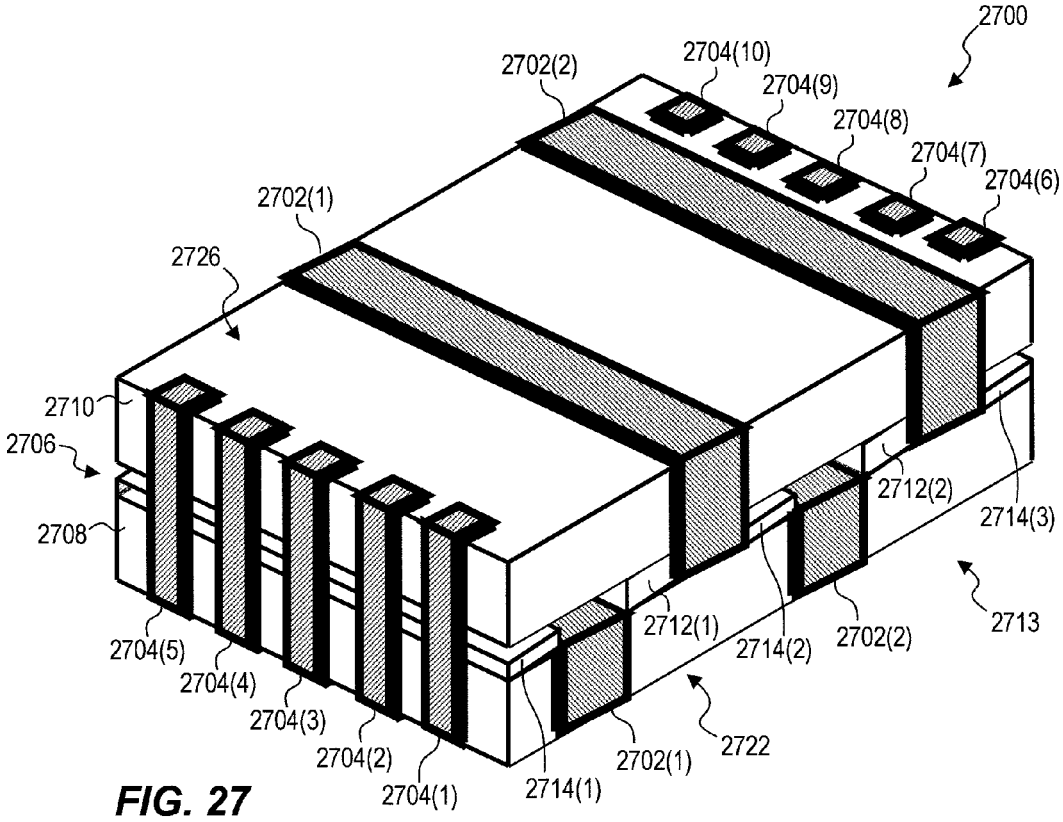
FIG. 27 shows a perspective view of another pin coupled inductor.

FIG. 27 shows a perspective view of a pin coupled inductor 2700. Coupled inductor 2700 is scalable in that it can be adapted to have N windings, where N is an integer greater than one. In following examples, coupled inductor 2700 is shown with two windings (N=2) for illustrative simplicity. Coupled inductor 2700 also optionally includes one or more additional conductors 2704.

Figure 28:
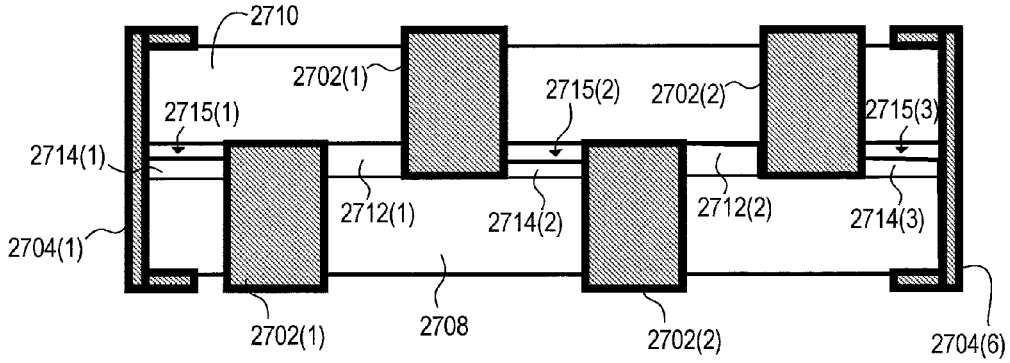
FIG. 28 shows a side plan view of the FIG. 27 pin coupled inductor, according to an embodiment.
Figure 29:
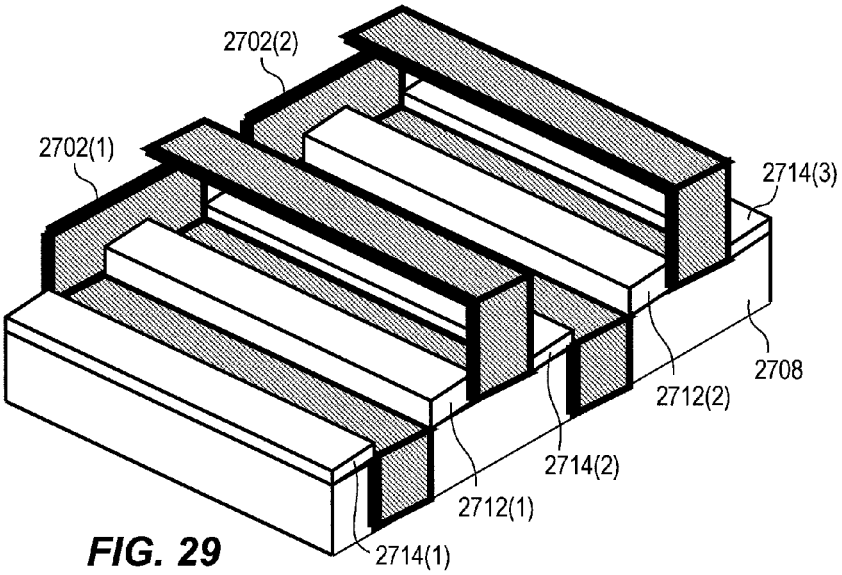
FIG. 29 shows a perspective view of the FIG. 27 pin coupled inductor without its second end magnetic element and without its additional conductors.
Figure 30:
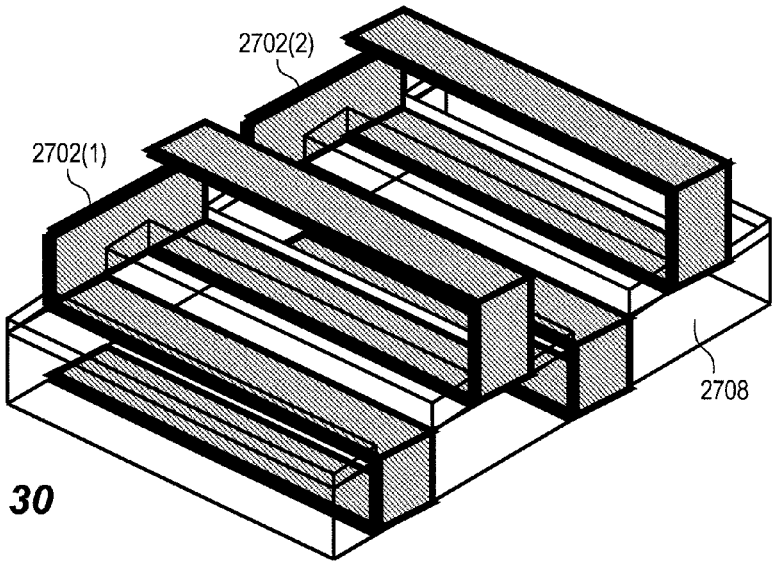
FIG. 30 shows a perspective view of the FIG. 27 pin coupled inductor like that of FIG. 29, but with its magnetic core shown as transparent.
Figure 31:
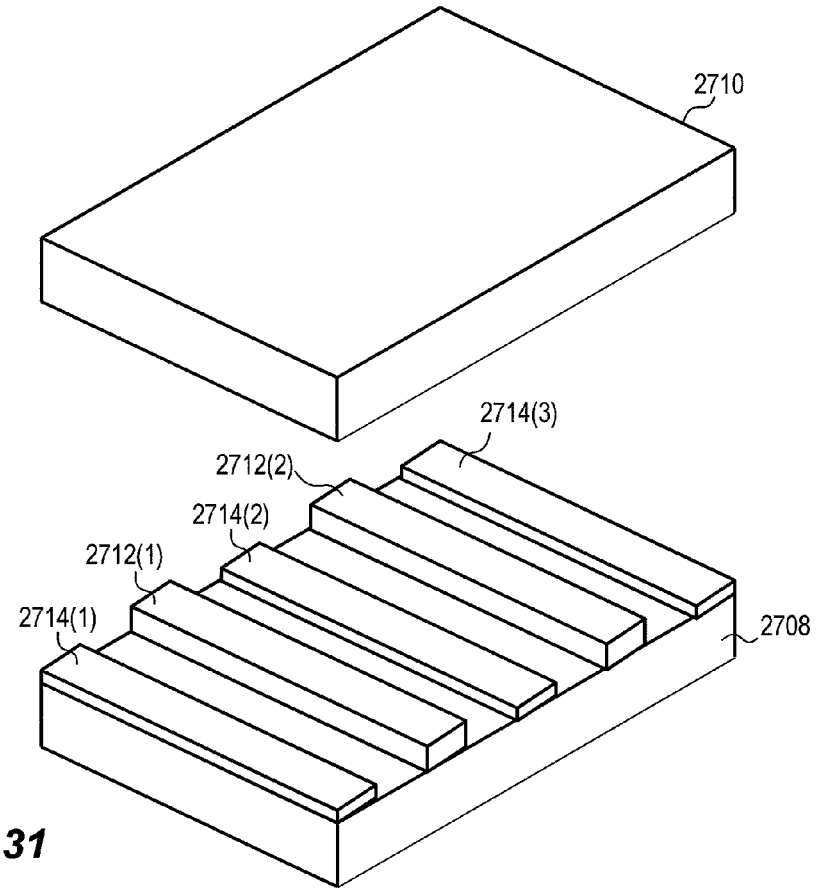
FIG. 31 shows an exploded perspective view of the magnetic core of the FIG. 27 pin coupled inductor.
Figure 32:
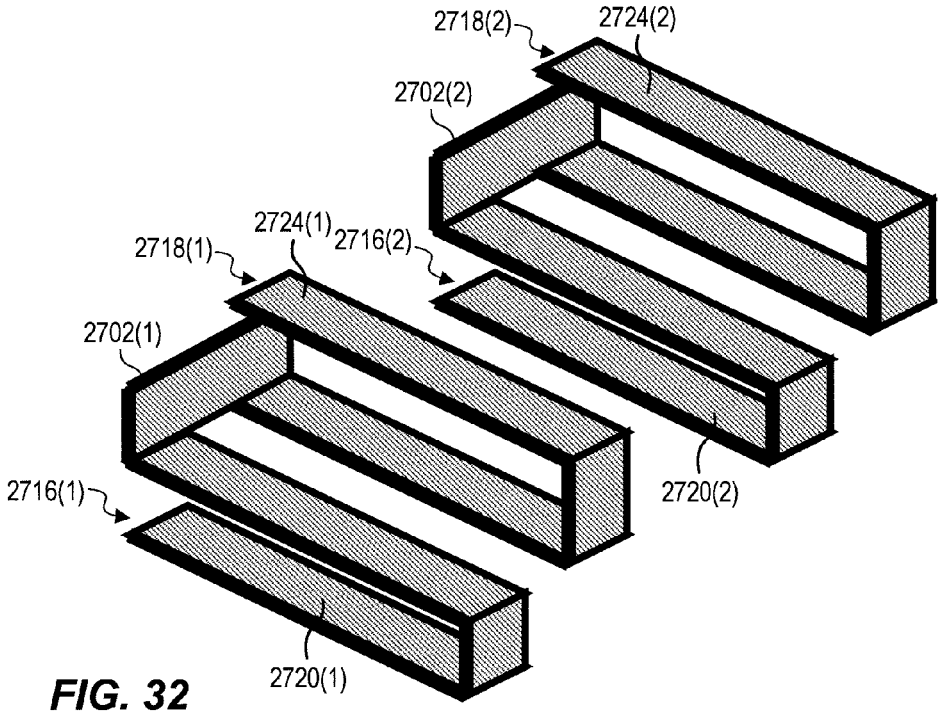
FIG. 32 shows a perspective view of the windings of the FIG. 27 pin coupled inductor.
Figure 33:
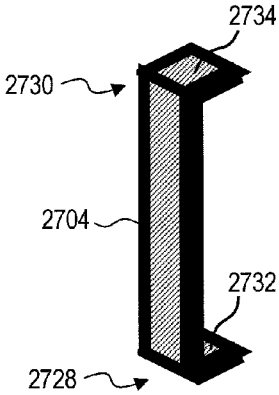
FIG. 33 shows a perspective view of one additional conductor of the FIG. 27 pin coupled inductor.

Pin coupled inductor 2700 further includes a magnetic core 2706. Magnetic core 2706 includes opposing first and second end magnetic elements 2708, 2710 and N coupling teeth 2712 disposed between and connecting first and second end magnetic elements 2708, 2710. FIG. 28 shows a plan view of side 2713 of coupled inductor 2700. FIG. 29 shows a perspective view of coupled inductor 2700 without second end magnetic element 2710 and without additional conductors 2704. FIG. 30 shows a perspective like that of FIG. 28, but with magnetic core 2706 shown as transparent. FIG. 31 shows an exploded perspective view of magnetic core 2706 without windings 2702 and without additional conductors 2704. FIGS. 32 and 33, in turn, respectively show a perspective view of windings 2702 and a perspective view of one additional conductor 2704.

A respective one of the N windings 2702 is wound around each coupling tooth 2712, such that magnetic core 2706 magnetically couples windings 2702. Magnetic core 2706, however, does not form a magnetic path loop around additional conductors 2704. Thus, inductance associated with windings 2702 is typically significantly greater than inductance associated with additional conductors 2704.

Magnetic core 2706 optionally further includes one or more leakage teeth 2714 disposed between first and second end magnetic elements 2708, 2710. Leakage teeth 2714 provide a path for leakage magnetic flux between first and second end magnetic elements 2708, 2710. Leakage magnetic flux is flux generating by a changing current flowing through one winding 2702 that does not magnetically couple the remaining windings 2702. In some embodiments, leakage teeth 2714 form one or more gaps filled with a non-magnetic material, such as air, paper, plastic, and/or adhesive, to control leakage inductance associated with windings 2702. For example, in some embodiments, one or more of leakage teeth 2714 are separated from second end magnetic element 2710 by a respective gap 2715 (see FIG. 28).

Each winding 2702 has opposing first and second ends 2716, 2718 (see FIG. 32). Each winding first end 2716 forms a respective first solder tab 2720 on a first outer surface 2722 of magnetic core 2706, and each winding second end 2718 forms a respective second solder tab 2724 on an opposing second outer surface 2726 of magnetic core 2706. Each additional conductor 2704 also has opposing first and second ends 2728, 2730 (see FIG. 33). Each first end 2728 forms a respective first solder tab 2732 on magnetic core first outer surface 2722, and each second end 2730 forms a respective second solder tab 2734 on magnetic core second outer surface 2726. Thus, each first solder tab 2720, 2732 is adapted for surface mount soldering to a first substrate in a first plane, and each second solder tab 2724, 2734 is adapted for surface mount soldering to a second substrate in a second plane, where the second plane is different from the first plane. The number of additional conductors 2704 could be varied, and each instance of additional conductor 2704 need not necessarily be the same. For example, two or more instances of additional conductor 2704 could alternately be combined into a single relatively wide additional conductor, such as to carry a large current magnitude.

One possible application of pin coupled inductor 2700 is an electrical assembly similar to that of FIG. 25. For example, some alternate embodiments of electrical assembly 2500 (FIG. 25) include pin coupled inductor 2700 in place of pin inductor 2100. In certain of these embodiments, additional conductors 2704(1)-2704(3) couple module 2502 to a negative input power supply node, additional conductors 2704(6) and 2704(7) couple module 2502 to a positive input power supply node, winding 2702(1) is electrically coupled between switching node Vx1 and input power node Vin, and winding 2702(2) is electrically coupled between switching node Vx2 and input node Vin. Some or all of remaining additional conductors 2704 optionally couple data signals between assembly substrate 2504 and module 2502, in these embodiments.

Figure 34:
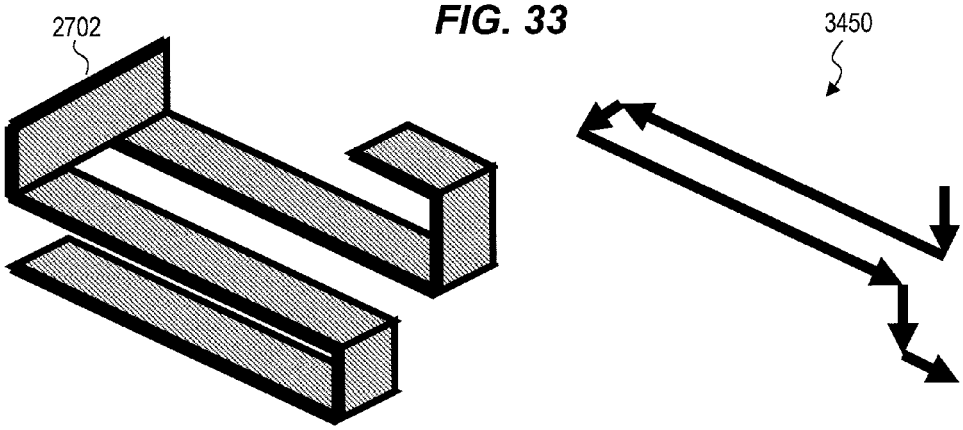
FIG. 34 shows a perspective view of a winding of the FIG. 27 pin coupled inductor and a possible current path through the winding, according to an embodiment.
Figure 35:
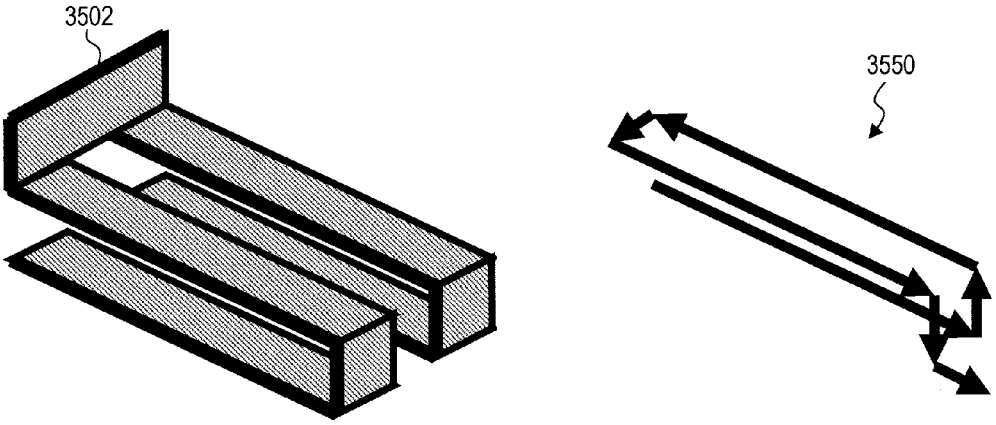
(PRIOR ART) FIG. 35
FIG. 35 shows a perspective view of a prior art winding and a possible current path through the prior art winding.

Certain embodiments of pin coupled inductor 2700 include windings 2702 that are relatively short, thereby promoting low material cost and low winding impedance. For example, FIG. 34 shows a perspective view of one instance of winding 2702, and FIG. 35 shows a perspective view of a winding 3502 from a prior art, scalable coupled inductor. As can be observed, winding 2702 is significantly shorter than prior art winding 3502. Arrows in FIG. 34 approximate one possible current path 3450 through winding 2702, and arrows in FIG. 35 approximate one possible current path 3550 through winding 3502. Length of current path 3450 is only about two-thirds of length of current path 3550, thereby showing impedance reduction potentially achievable by using pin coupled inductor 2700 instead of certain prior coupled inductors.

Figure 36:
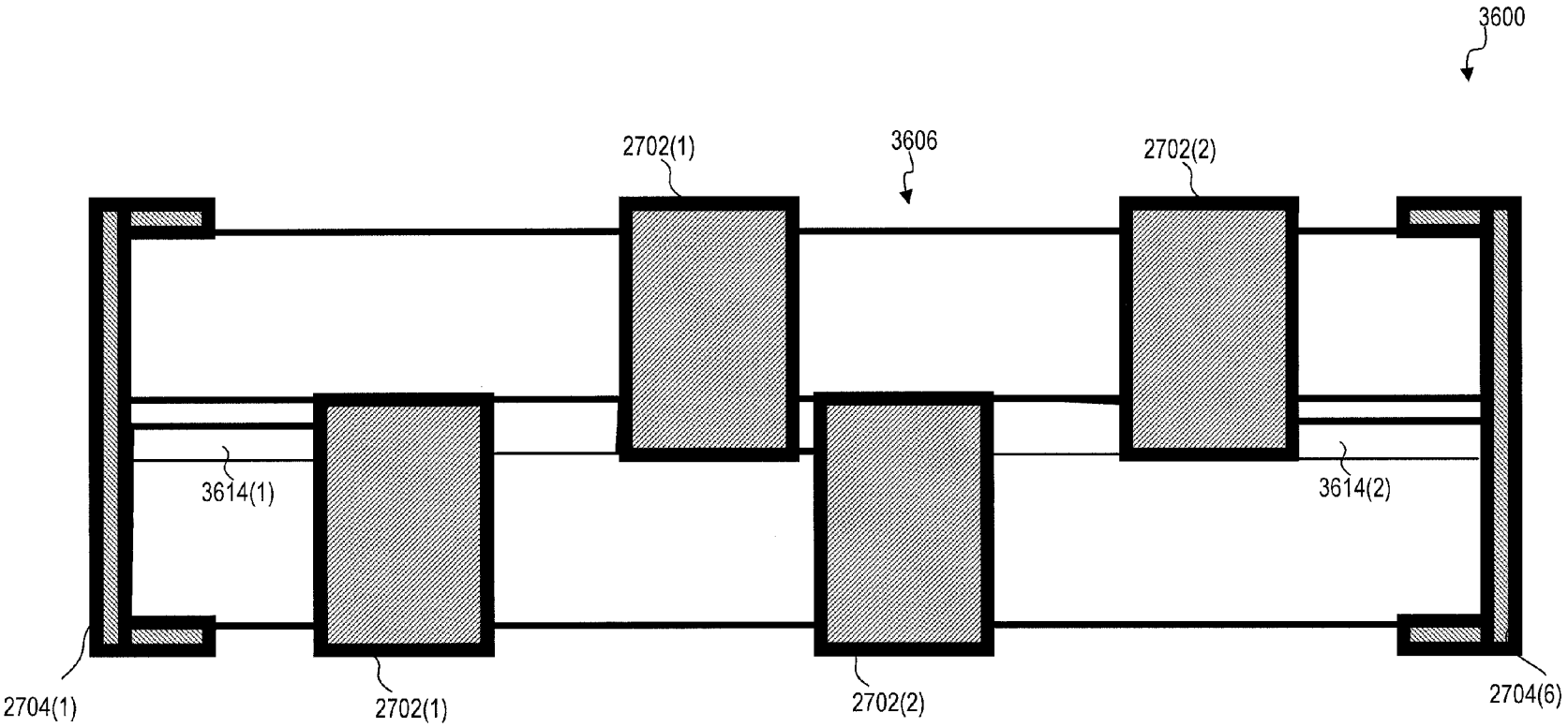
FIG. 36 shows a side plan view of a pin coupled inductor similar to that of FIG. 27, but with a different leakage tooth configuration, according to an embodiment.

FIG. 36 shows a side plan view of a pin coupled inductor 3600, which is similar to pin coupled inductor 2700 (FIG. 27), but with a different leakage tooth configuration. In particular, coupled inductor 3600 includes a magnetic core 3606 similar to that of inductor 2700, but with leakage teeth 3614 only on opposing magnetic core ends. In other words, there are no leakage teeth between windings 2702 in coupled inductor 3600, and windings 2702 can therefore be disposed very close together to promote strong magnetic coupling. However, because there are only two leakage teeth 3614, leakage teeth cross-sectional area may need to be relatively large to achieve desired leakage inductance values. Additionally, the lack of leakage teeth between windings may result in high leakage flux path reluctance in embodiments where N is greater than two.

Figure 37:
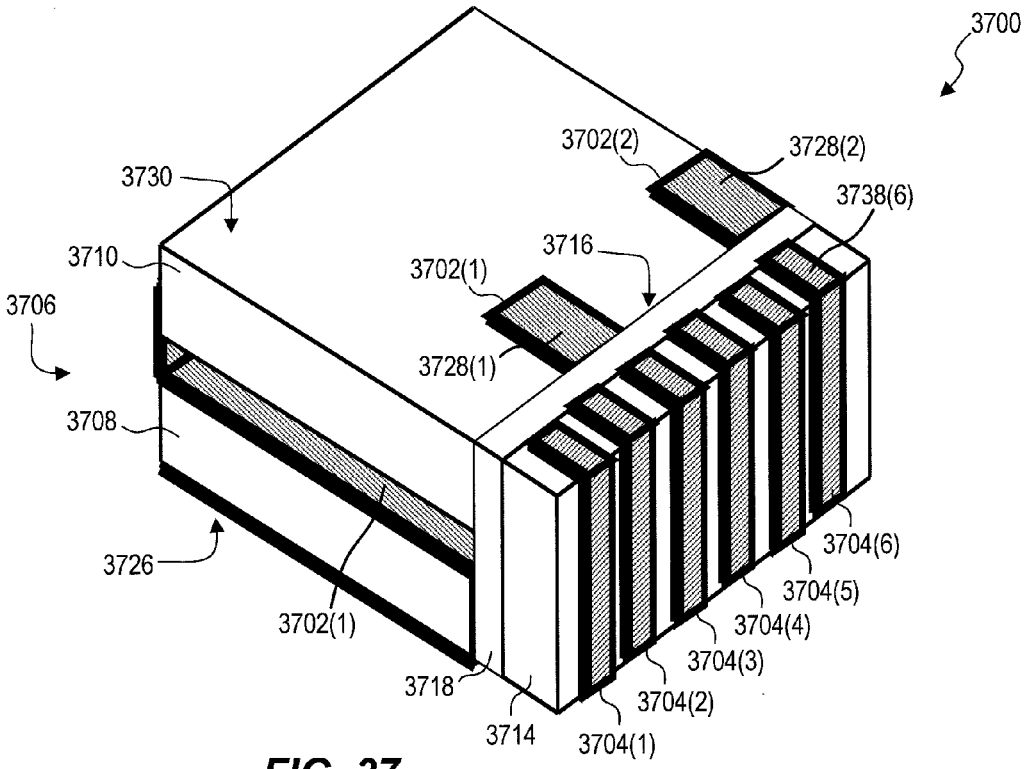
FIG. 37 shows a perspective view of another pin coupled inductor.

FIG. 37 shows a perspective view of a pin coupled inductor 3700. Coupled inductor 3700 is scalable in that it can be adapted to have N windings 3702, where N is an integer greater than one. In following examples, coupled inductor 3700 is shown with two windings (N=2) for illustrative simplicity. Coupled inductor 3700 also optionally includes one or more additional conductors 3704.

Figure 38:
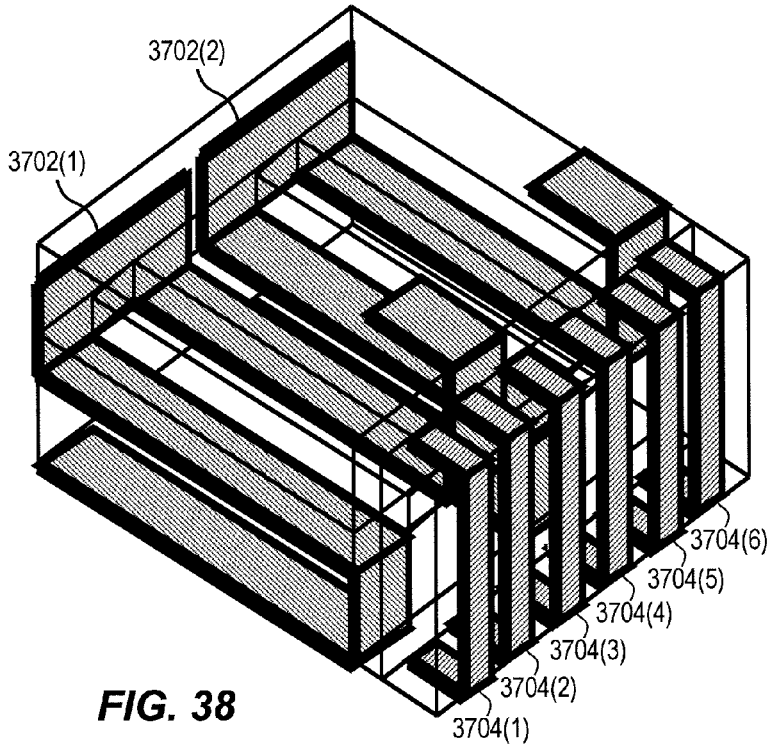
FIG. 38 shows a perspective view of the FIG. 37 inductor with its magnetic core shown as transparent, according to an embodiment.
Figure 39:
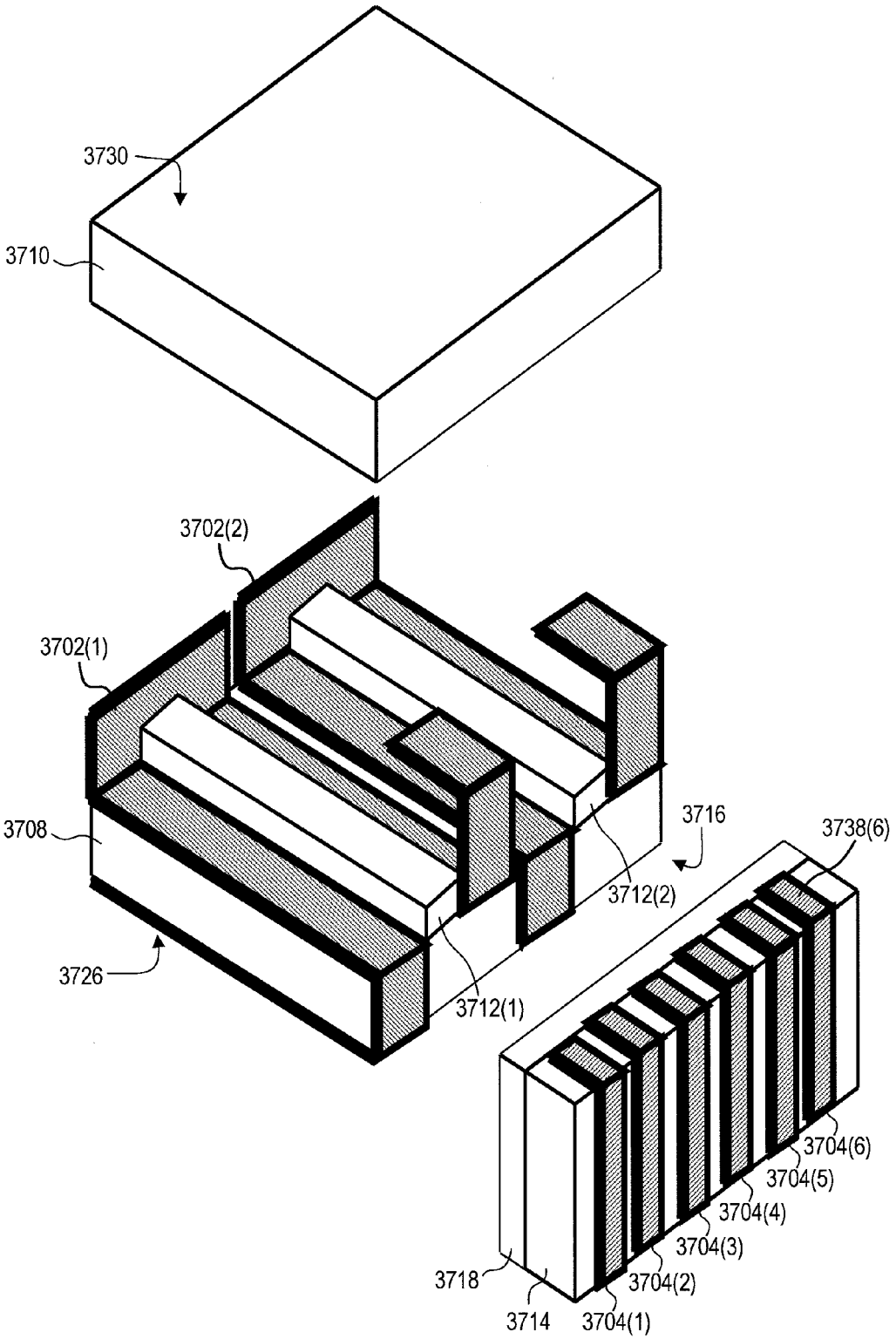
FIG. 39 shows an exploded perspective view of the FIG. 37 pin coupled inductor.
Figure 40:
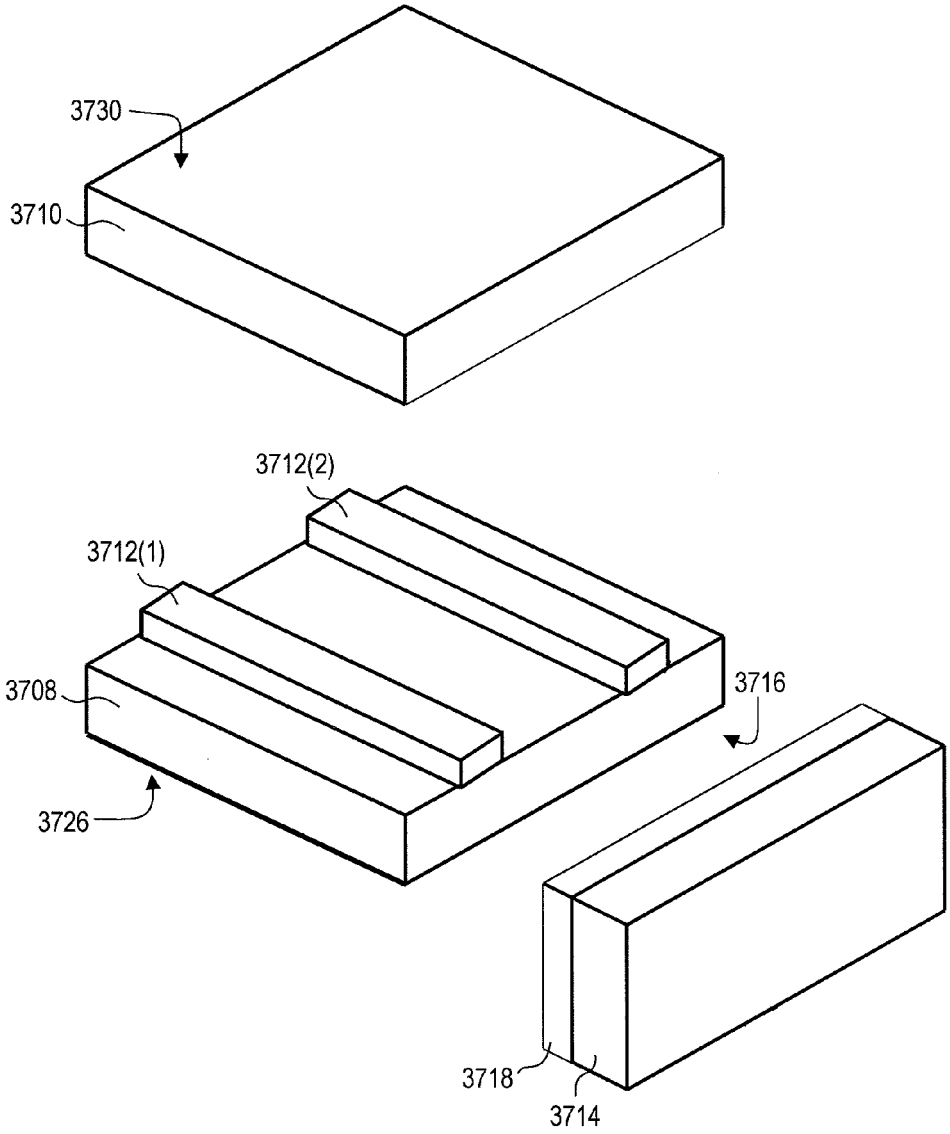
FIG. 40 shows an exploded perspective view of the FIG. 37 pin coupled inductor without windings and without additional conductors.
Figure 41:
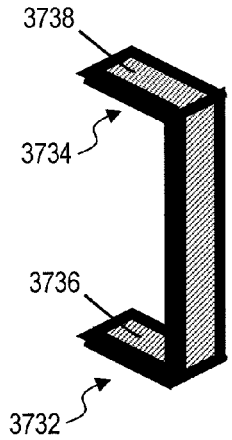
FIG. 41 shows a perspective view of an additional conductor of the FIG. 37 pin coupled inductor.

Pin coupled inductor 3700 further includes a magnetic core 3706. Magnetic core 3706 includes opposing first and second end magnetic elements 3708, 3710 and N coupling teeth 3712 disposed between and connecting first and second end magnetic elements 3708, 3710. FIG. 38 shows a perspective view of pin coupled inductor 3700 with magnetic core 3706 shown as transparent, and FIG. 39 shows an exploded perspective view of inductor 3700. FIG. 40 shows a perspective view of magnetic core 3706 without windings 3702 and without additional conductors 3704. FIG. 41 shows a perspective view of one additional conductor 3704, and FIG. 42 shows a perspective view of windings 3702.

A respective one of the N windings 3702 is wound around each coupling tooth 3712, such that magnetic core 3706 magnetically couples windings 3702. Magnetic core 3706, however, does not form a magnetic path loop around additional conductors 3704. Thus, inductance associated with windings 3702 is typically significantly greater than inductance associated with additional conductors 3704.

Magnetic core 3706 optionally further includes leakage plate 3714 disposed on side 3716 of magnetic core 3706. Leakage plate 3714 provides a path for leakage magnetic flux between first and second end magnetic elements 3708, 3710, where leakage magnetic flux is flux generating by a changing current flowing through one winding 3702 that does not magnetically couple the remaining windings 3702. Leakage plate 3714 is optionally separated from end magnetic elements 3708, 3710 by a spacer 3718, as shown, to control leakage inductance associated with windings 3702. Spacer 3718 is formed of non-magnetic material such as air, paper, plastic, or adhesive. Although spacer 3718 is shown as a single element, spacer 3718 is formed of multiple elements, such as multiple pieces of adhesive, in some alternate embodiments. Additionally, although spacer 3718 is shown as covering essentially all of magnetic core side 3716, in certain alternate embodiments, spacer 3718 covers substantially less than all of side 3716.

Figure 42:
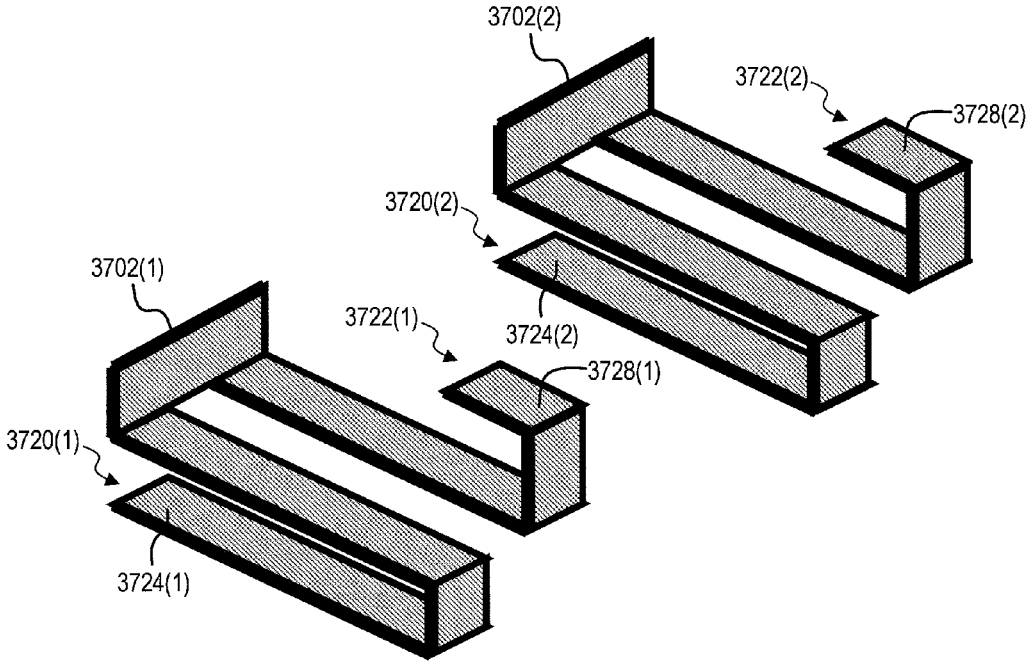
FIG. 42 shows a perspective view of the windings of the FIG. 37 pin coupled inductor.

Each winding 3702 has opposing first and second ends 3720, 3722 (see FIG. 42). Each winding first end 3720 forms a respective first solder tab 3724 on a first outer surface 3726 of magnetic core 3706, and each winding second end 3722 forms a respective second solder tab 3728 on an opposing second outer surface 3730 of magnetic core 3706. Each additional conductor 3704 also has opposing first and second ends 3732, 3734 (see FIG. 41). Each first end 3732 forms a respective first solder tab 3736 on magnetic core first outer surface 3726, and each second end 3734 forms a respective second solder tab 3738 on magnetic core second outer surface 3730. Each first solder tab 3724, 3736 is adapted for surface mount soldering to a first substrate in a first plane, and each second solder tab 3728, 3738 is adapted for surface mount soldering to a second substrate in a second plane, where the second plane is different from the first plane. The number of additional conductors 3704 can be varied, and each instance of additional conductor 3704 need not necessarily be the same. For example, two instances of additional conductor 3704 could alternately be combined into a single relatively wide additional conductor, such as for carrying high current magnitude.

One possible application of pin coupled inductor 3700 is an electrical assembly similar to that of FIG. 25. For example, some alternate embodiments of electrical assembly 2500 (FIG. 25) include pin coupled inductor 3700 in place of pin inductor 2100. In certain of these embodiments, additional conductors 3704(1) and 3704(2) couple module 2502 to a negative input power supply node, additional conductors 3704(3) and 3704(4) couple module 2502 to a positive input power supply node, winding 3702(1) is electrically coupled between switching node Vx1 and input power node Vin, and winding 3702(2) is electrically coupled between switching node Vx2 and input node Vin. Additional conductors 3704(5) and 3704(6) optionally couple data signals between assembly substrate 2504 and module 2502, in these embodiments.

Figure 43:
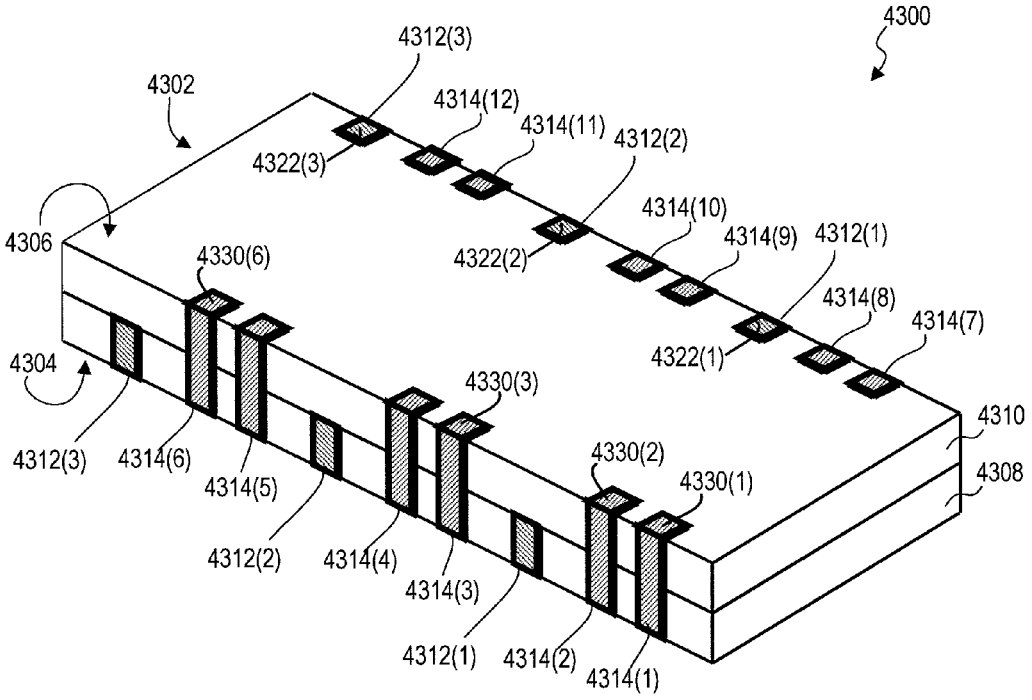
FIG. 43 shows a perspective view of yet another pin coupled inductor.

FIG. 43 shows a perspective view of a scalable pin coupled inductor 4300. Coupled inductor 4300 includes a magnetic core 4302 having opposing first and second outer surfaces 4304, 4306. Magnetic core 4302 is shown as being formed of first and second magnetic elements 4308, 4310, which in some embodiments are ferrite or powder iron magnetic elements. However, the configuration of magnetic core 4302 may vary. For example, in certain alternate embodiments, magnetic core 4302 is a single-piece block core, such as formed of a molded magnetic material. As another example, in some other alternate embodiments, magnetic core 4302 is formed of a number of layers of magnetic film.

Figure 44:
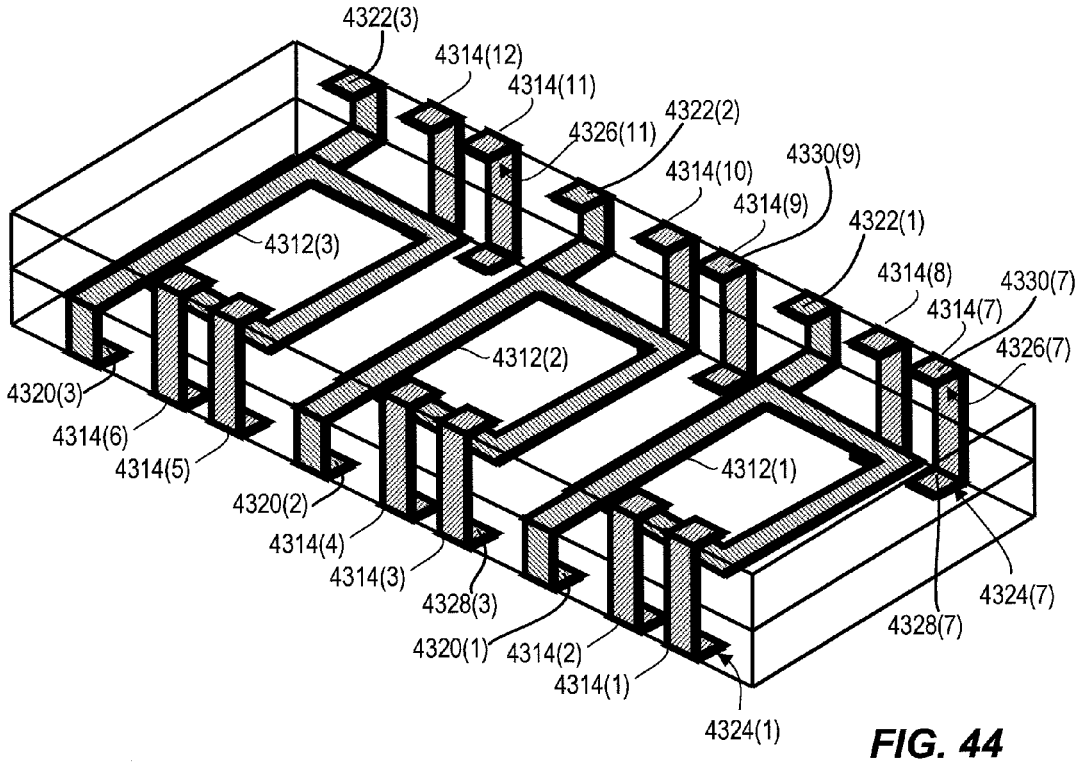
FIG. 44 shows a perspective view of the FIG. 43 inductor with its magnetic core shown as transparent, according to an embodiment.

Coupled inductor 4300 further includes N windings 4312 wound around respective portions of magnetic core 4302, where N is an integer greater than one. In following examples, coupled inductor 4300 is shown with three windings (N=3) for illustrative simplicity. Windings 4312 are best seen in FIGS. 44 and 45, which each show a perspective view of coupled inductor 4300 with magnetic core 4302 shown as transparent.

Coupled inductor 4300 also optionally includes one or more additional conductors 4314. Magnetic core 4302 does not form a magnetic path loop around additional conductors 4314. Thus, inductance associated with windings 4312 is typically significantly greater than inductance associated with additional conductors 4314. Although each additional conductor 4314 is shown as having the same configuration, the configuration of additional conductors 4314 can vary between conductor instances. For example, in some alternate embodiments, two or more additional conductor 4314 instances are combined into a relatively wide additional conductor, such as for high current magnitude applications. Additional conductors 4314 are omitted in FIG. 45 to more clearly show windings 4312.

Figure 45:
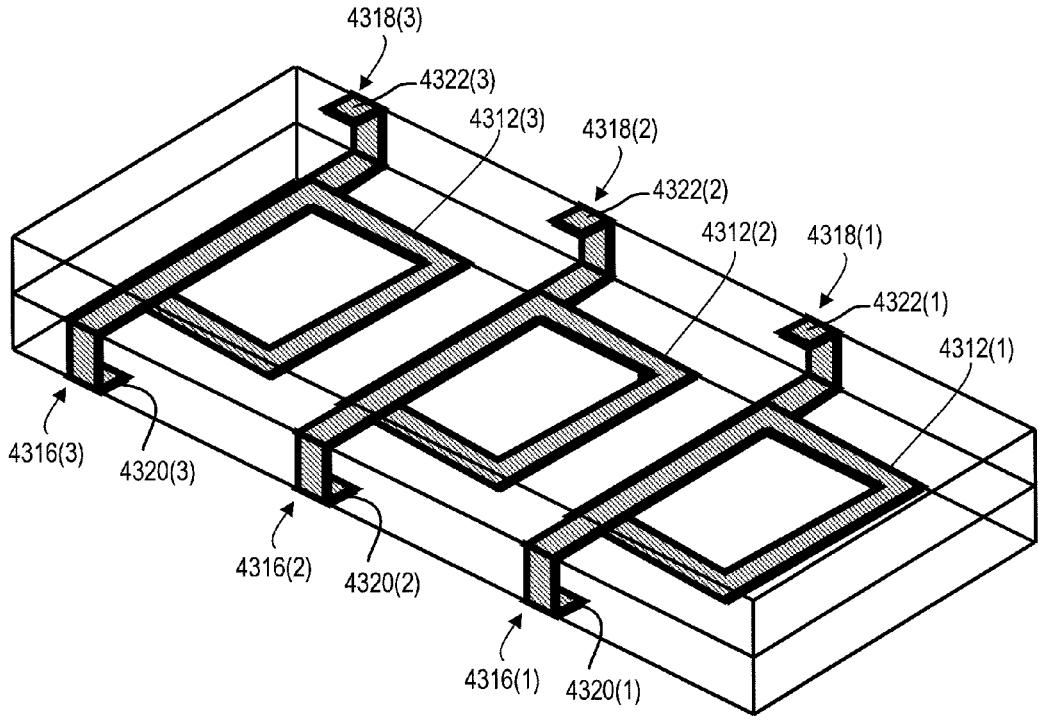
FIG. 45 shows a perspective view like that of FIG. 44, but with the additional conductors omitted.

Each winding 4312 has opposing first and second ends 4316, 4318 (see FIG. 45). Each winding first end 4316 forms a respective first solder tab 4320 on magnetic core first outer surface 4304, and each winding second end 4318 forms a respective second solder tab 4322 on magnetic core second outer surface 4306. Each additional conductor 4314 also has opposing first and second ends 4324, 4326 (see FIG. 44). Each first end 4324 forms a respective first solder tab 4328 on magnetic core first outer surface 4304, and each second end 4326 forms a respective second solder tab 4330 on magnetic core second outer surface 4306. Thus, each first solder tab 4320, 4328 is adapted for surface mount soldering to a first substrate in a first plane, and each second solder tab 4322, 4330 is adapted for surface mount soldering to a second substrate in a second plane, where the second plane is different from the first plane. Only some first and second ends 4324, 4326 and first and second solder tabs 4328, 4330 are labeled to promote illustrative clarity.

One possible application of pin coupled inductor 4300 is an electrical assembly similar to that of FIG. 25. For example, some alternate embodiments of electrical assembly 2500 (FIG. 25) include pin coupled inductor 4300 in place of pin coupled inductor 2100. In certain of these embodiments, additional conductors 4314(1) and 4314(2) couple module 2502 to a negative input power supply node, additional conductors 4314(7) and 4314(8) couple module 2502 to a positive input power supply node, winding 4312(1) is electrically coupled between switching node Vx1 and input power node Vin, winding 4312(2) is electrically coupled between switching node Vx2 and input node Vin, and winding 4312(3) is electrically coupled between a third switching node Vx3 and input node Vin. Additional conductors 4314(3)-4314(6) and 4314(9)-4314(12) optionally couple data signals between assembly substrate 2504 and module 2502, in these embodiments.

Figure 46:
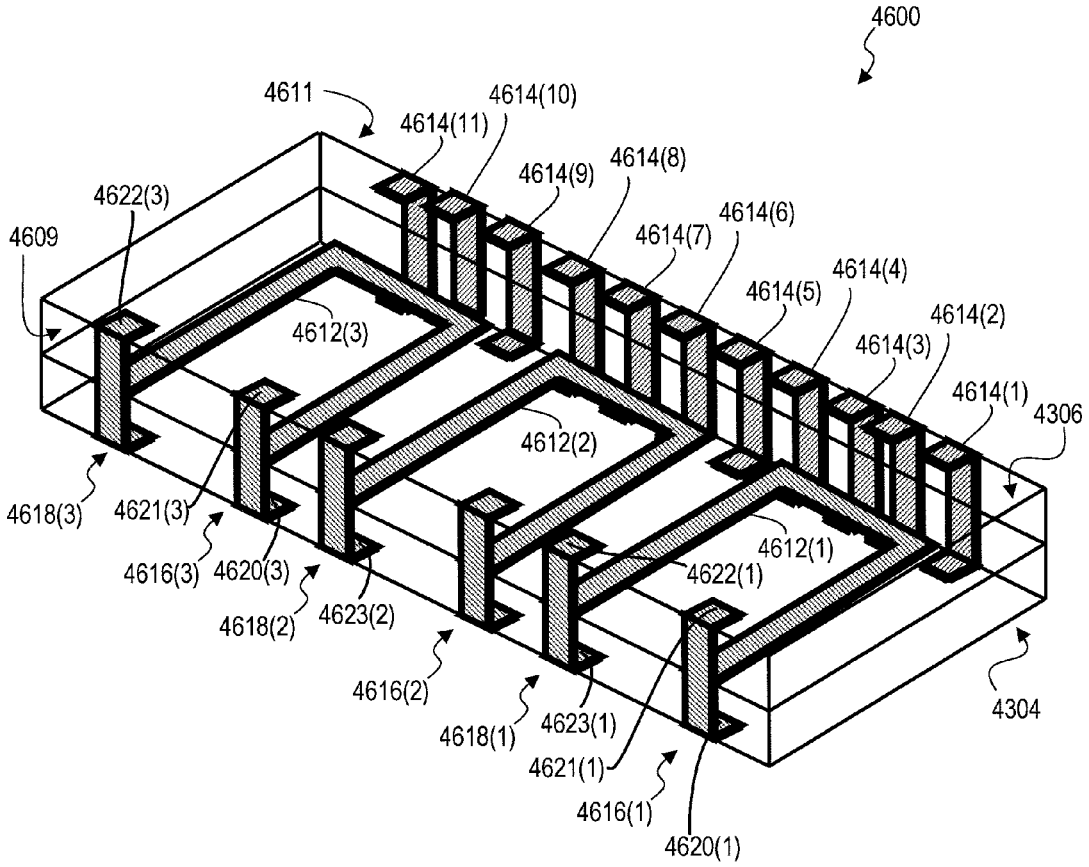
FIG. 46 shows a perspective view of another pin coupled inductor, according to an embodiment.

FIG. 46 shows a perspective view of a scalable pin coupled inductor 4600. Coupled inductor 4600 is similar to coupled inductor 4300 (FIG. 43), but includes winding 4612 in place of windings 4312. Magnetic core 4302 is shown as transparent in FIG. 46 to better show windings 4612.

In contrast to windings 4312 of FIG. 43, both ends of windings 4612 terminate on a common side 4609 of magnetic core 4302. Additionally, each winding end forms a solder tab on both opposing magnetic core outer surfaces 4304, 4306. In particular, each winding 4612 has opposing first and second ends 4616, 4618. Each winding first end 4616 forms (i) a respective first solder tab 4620 on magnetic core first outer surface 4304, and (ii) a respective second solder tab 4621 on magnetic core second outer surface 4306. Similarly, each winding second end 4618 forms (i) a respective first solder tab 4623 on magnetic core first outer surface 4304, and (ii) a respective second solder tab 4322 on magnetic core second outer surface 4306. Only some first solder tabs 4620, 4623 and second solder tabs 4621, 4622 are labeled to promote illustrative clarity. Forming solder tabs on both magnetic core outer surfaces 4304, 4306 may facilitate manufacturing of pin coupled inductor 4600 by allowing outer surfaces 4304, 4306 to be symmetrical.

Pin coupled inductor 4600 is shown with eleven additional conductors 4614, which are similar to additional conductors 4314 (FIG. 43), but disposed only on one side 4611 of magnetic core 4302. However, the number, location, and configuration of additional conductors 4614 could be modified. For example, one or more additional conductors 4614 could alternately be disposed on magnetic core side 4609. Additionally, one or more additional conductors 4614 could alternately be combined, such as into a relatively wide additional conductor for carrying a large current magnitude.

Figure 47:
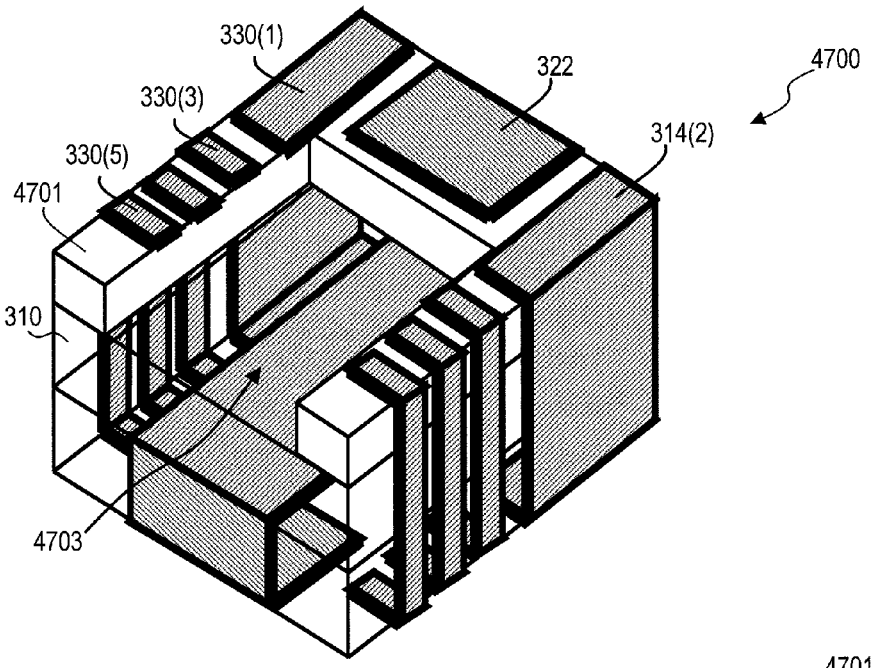
FIG. 47 shows a perspective view of a pin inductor including a spacer, according to an embodiment.
Figure 48:
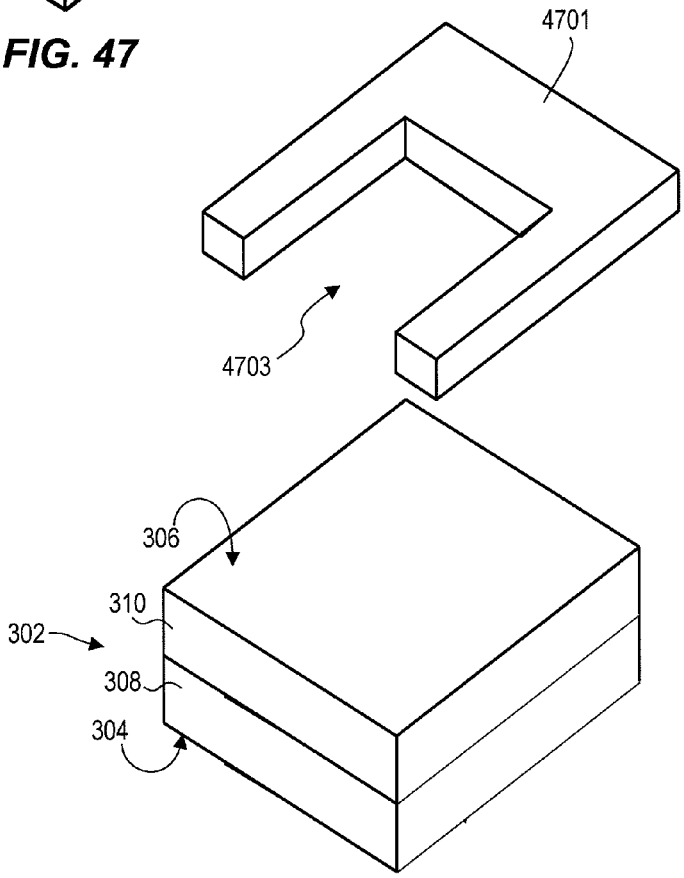
FIG. 48 shows an exploded perspective view of the magnetic core and the spacer of the FIG. 47 pin inductor.

In the pin inductor examples discussed above, solder tabs are disposed on opposing outer surfaces of the magnetic core. However, some alternate embodiments include one or more spacers between a magnetic core outer surface and one or more solder tabs. For example, FIG. 47 shows a perspective view of a pin inductor 4700, which is similar to pin inductor 300 (FIG. 3), but further includes a spacer 4701 disposed between magnetic core second outer surface 306 and second solder tabs 322, 330. Magnetic core 302 is shown as transparent in FIG. 47, and FIG. 48 shows an exploded perspective view of inductor 4700 without winding 312 and without additional conductors 314.

Figure 49:
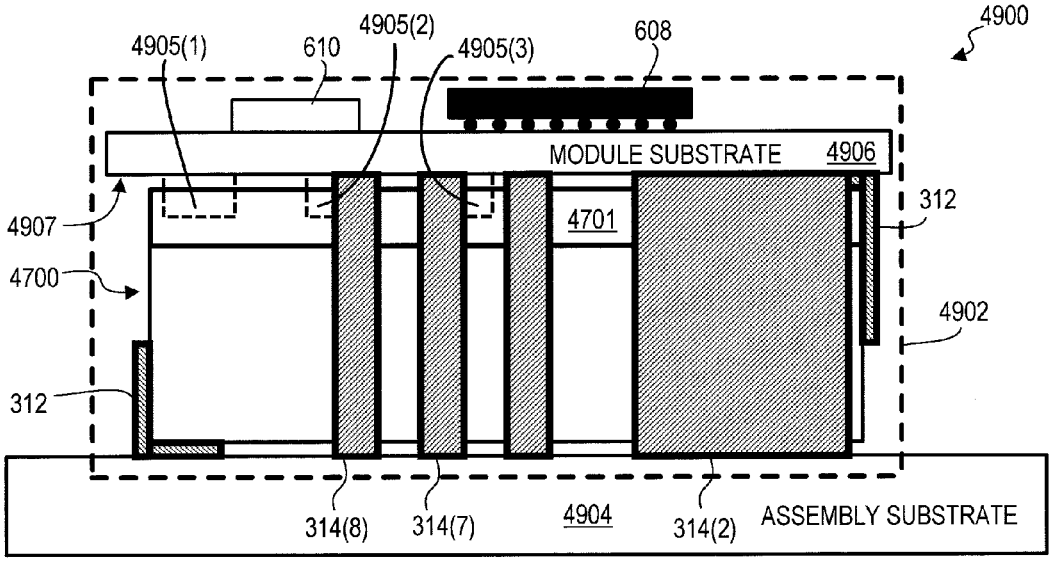
FIG. 49 shows a side plan view of an electrical assembly including an instance of the pin inductor of FIG. 47, according to an embodiment.

Spacer 4701 forms a recess 4703, which in some applications, is at least partially occupied by external components, such as components of a power supply module. For example, FIG. 49 shows a side plan view of an electrical assembly 4900 including a power supply module 4902 coupled to an assembly substrate 4904. Power supply module 4902 is similar to power supply module 602 (FIG. 6), but module 4902 includes an instance of pin inductor 4700 in place of pin inductor 300. Module 4902 further includes additional components 4905 disposed on a bottom surface 4907 of module substrate 4906 and extending into spacer recess 4703. The outlines of additional components 4905 are shown by dashed lines were obscured by spacer 4701. Additional components 4905 are, for example, passive components such as capacitors and/or resistors.

Spacer 4701 is typically formed of one or more pieces of an insulating material, such as plastic, adhesive, ceramic, and/or paper. However, spacer 4701 could instead be formed of a conductive material with an insulator, such as plastic coated metal. Alternately, spacer 4701 could be formed of a conductive material if adjacent conductors and solder tabs are insulated from the spacer. Additionally, in some other alternate embodiments, spacer 4701 is formed of a magnetic material, such as a magnetic material similar to that of magnetic core 302. Although spacer 4701 is shown as a single element, it could alternately include several separate elements, such as two or more isolating pads. Additionally, the other pin inductor embodiments discussed above could also be modified in a similar manner to include one or more spacers.

Figure 50:
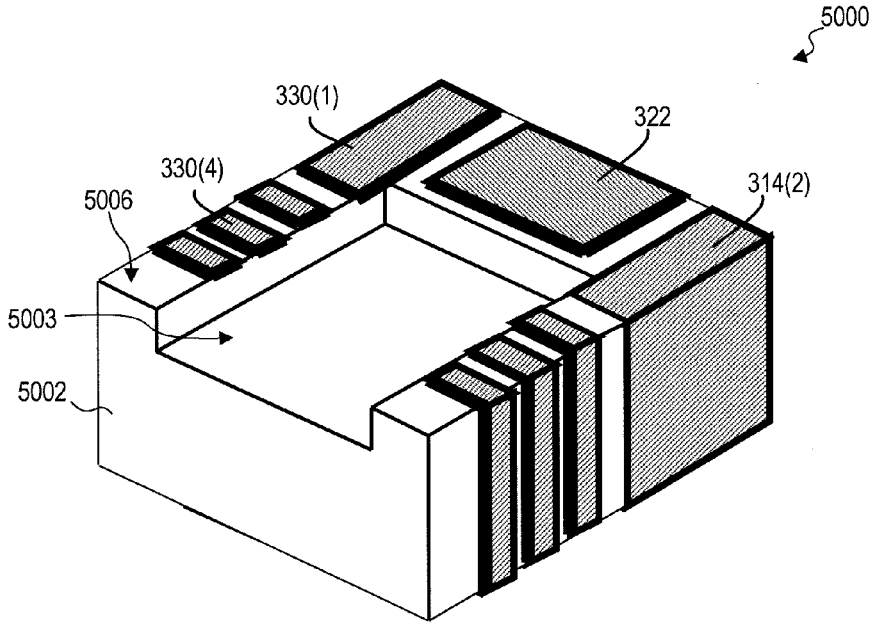
FIG. 50 shows a perspective view of a pin inductor including a magnetic core forming a recess, according to an embodiment.
Figure 51:
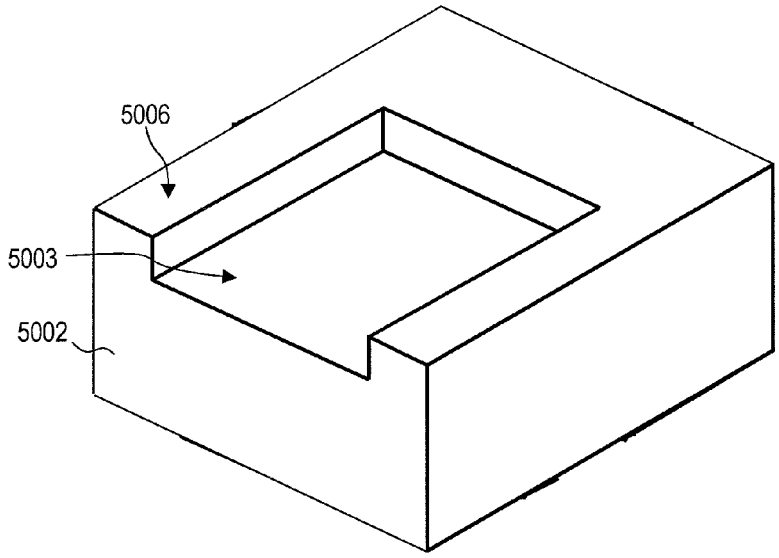
FIG. 51 shows a perspective view of the magnetic core of the FIG. 50 pin inductor.

In certain other alternate pin inductor embodiments, the magnetic core forms one or more recesses. For example, FIG. 50 shows a perspective view of a pin inductor 5000, which is similar to pin inductor 300 (FIG. 3), but includes a magnetic core 5002 which forms a recess 5003 in magnetic core outer surface 5006. FIG. 51 shows a perspective view of magnetic core 5002. In some embodiments, magnetic core 5002 is a single-piece magnetic core, such as a core formed of molded magnetic material. However, magnetic core 5002 could have other configurations. For example, in some other embodiments, magnetic core 5002 is formed of two or more discrete magnetic elements, such as magnetic elements formed of ferrite or a similar magnetic material, which are joined together.

Figure 52:
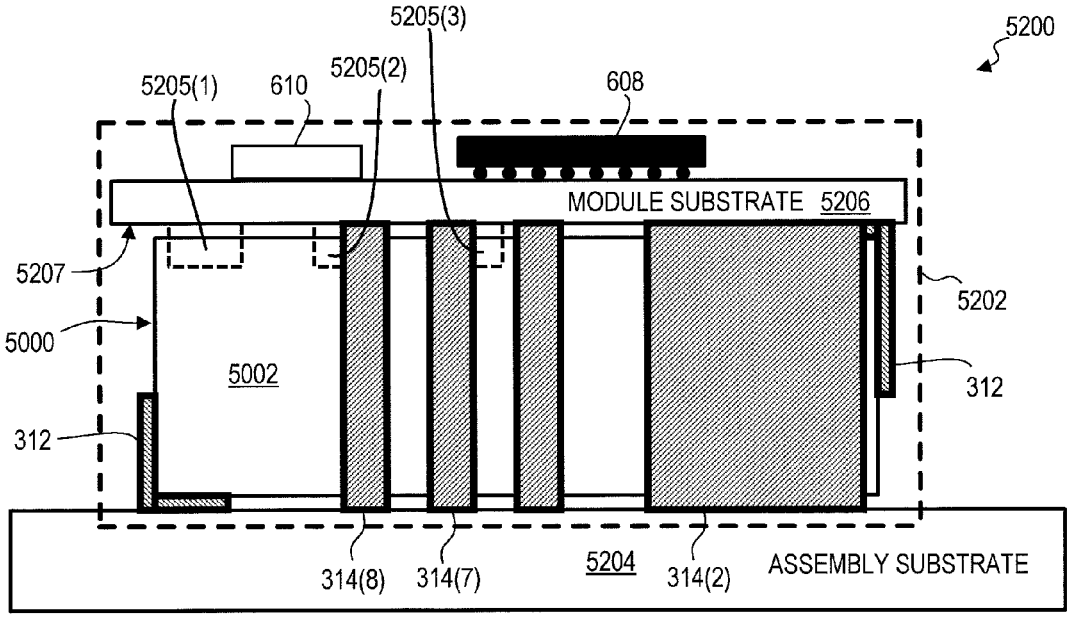
FIG. 52 shows a side plan view of an electrical assembly including an instance of the pin inductor of FIG. 50, according to an embodiment.

In some applications, recess 5003 is at least partially occupied by external components, such as components of a power supply module. For example, FIG. 52 shows a side plan view of an electrical assembly 5200 including a power supply module 5202 coupled to an assembly substrate 5204. Power supply module 5202 is similar to power supply module 602 (FIG. 6), but module 5202 includes an instance of pin inductor 5000 in place of pin inductor 300. Module 5202 further includes additional components 5205 disposed on a bottom surface 5207 of module substrate 5206 and extending into magnetic core recess 5003. The outlines of additional components 5205 are shown by dashed lines were obscured by magnetic core 5002. Additional components 5205 are, for example, passive components such as capacitors and/or resistors. The magnetic cores of the other pin inductors discussed above could also be modified to form one or more recesses.

In many of the examples discussed above, a winding solder tab is disposed between opposing respective portions of additional conductors on a magnetic core outer surface. For example, in pin inductor 300 (FIG. 3), winding second solder tab 322 is disposed between opposing additional conductor second solder tabs 330(1) and 330(2). In certain switching converter applications, this configuration promotes low noise by partially shielding the switching node. For example, as discussed above, in certain applications, such as in assembly 600 (FIG. 6), solder tabs 330(1), 330(2) are electrically coupled to a negative and positive nodes of an input power source, respectively, and second solder tab 322 is electrically coupled to a switching node. In these applications, solder tabs 330(1) and 330(2) are at a relatively constant voltage, thereby forming a shield around the quickly changing switching node voltage at second solder tab 322.

Figure 53:
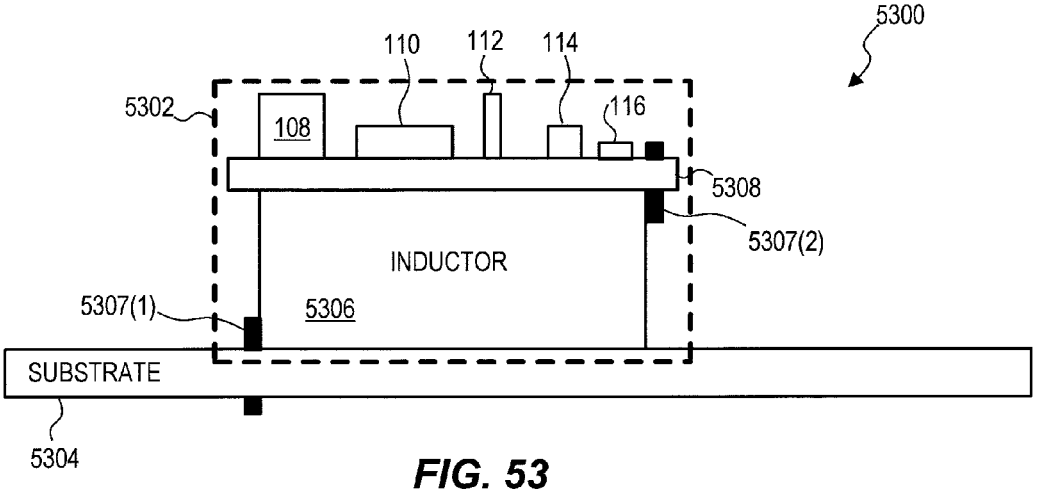
FIG. 53 shows a side plan view of an electrical assembly including a pin inductor having through-hole pins, according to an embodiment.

Many of the examples discussed above include connectors in the form of solder tabs adapted for surface mount soldering. However, pin inductors are not limited to use in surface mount soldering applications, and some other embodiments include one or more alternative connectors, such as through-hole pins or socket pins, in place of surface mount solder tabs. For example, FIG. 53 shows a side plan view of an electrical assembly 5300, which is similar to electrical assembly 200 (FIG. 2), but includes a power supply module 5302 including a pin inductor 5306 having through-hole pins 5307, where each through-hole pin is adapted for coupling to a respective substrate in a different plane. Through-hole pin 5307(1) couples pin inductor 5306 to an assembly substrate 5304, and through-hole pin 5307(2) couples pin inductor 5306 to a module substrate 5308.

Figure 54:
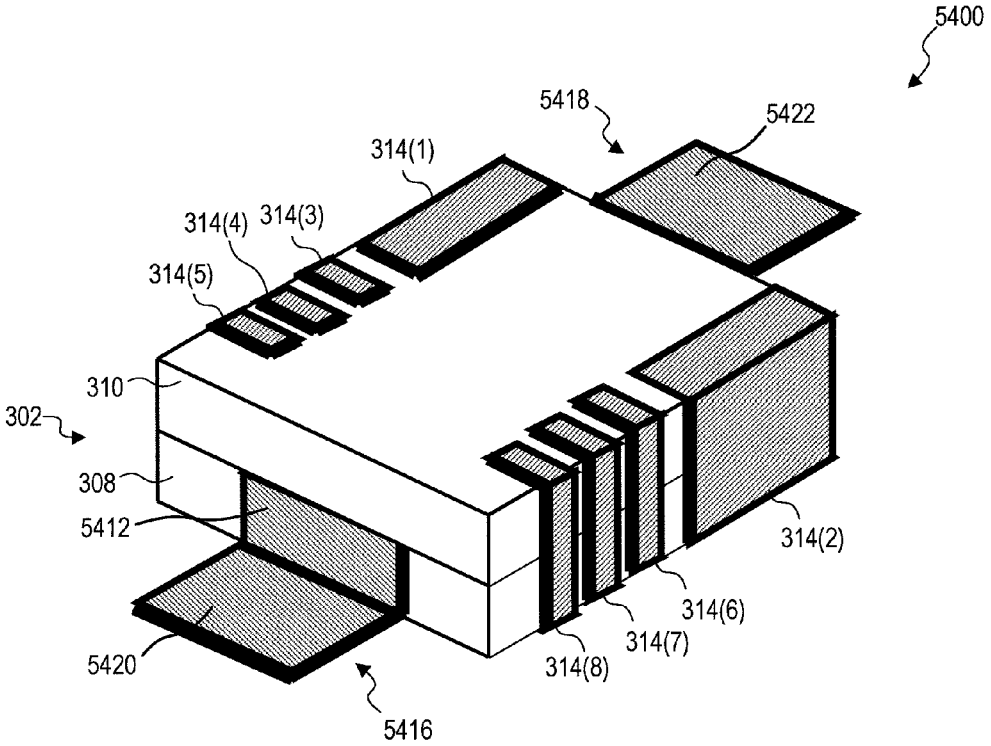
FIG. 54 shows a perspective view of pin inductor including solder tabs extending away from a magnetic core of the inductor, according to an embodiment.

Additionally, many of the examples discussed above show solder tabs disposed on magnetic core outer surfaces. However, is some alternate embodiments, some or all solder tabs are at least partially displaced from magnetic core outer surfaces. For example, FIG. 54 shows a perspective view of a pin inductor 5400, which similar to pin inductor 300 (FIG. 3), but includes winding 5412 in place of winding 312. Opposing first and second ends 5416, 5418 of winding 5412 respectively form solder tabs 5420, 5422. Solder tabs 5420, 5422 are not disposed on magnetic core 302 outer surfaces; instead, solder tabs 5420, 5422 extend away from magnetic core 302. Solder tab 5420 is adapted for surface mount soldering to a first substrate in a first plane, and solder tab 5422 is adapted for surface mount soldering to a second substrate in a second plane, where the second plane is different from the first plane.

Figure 55:
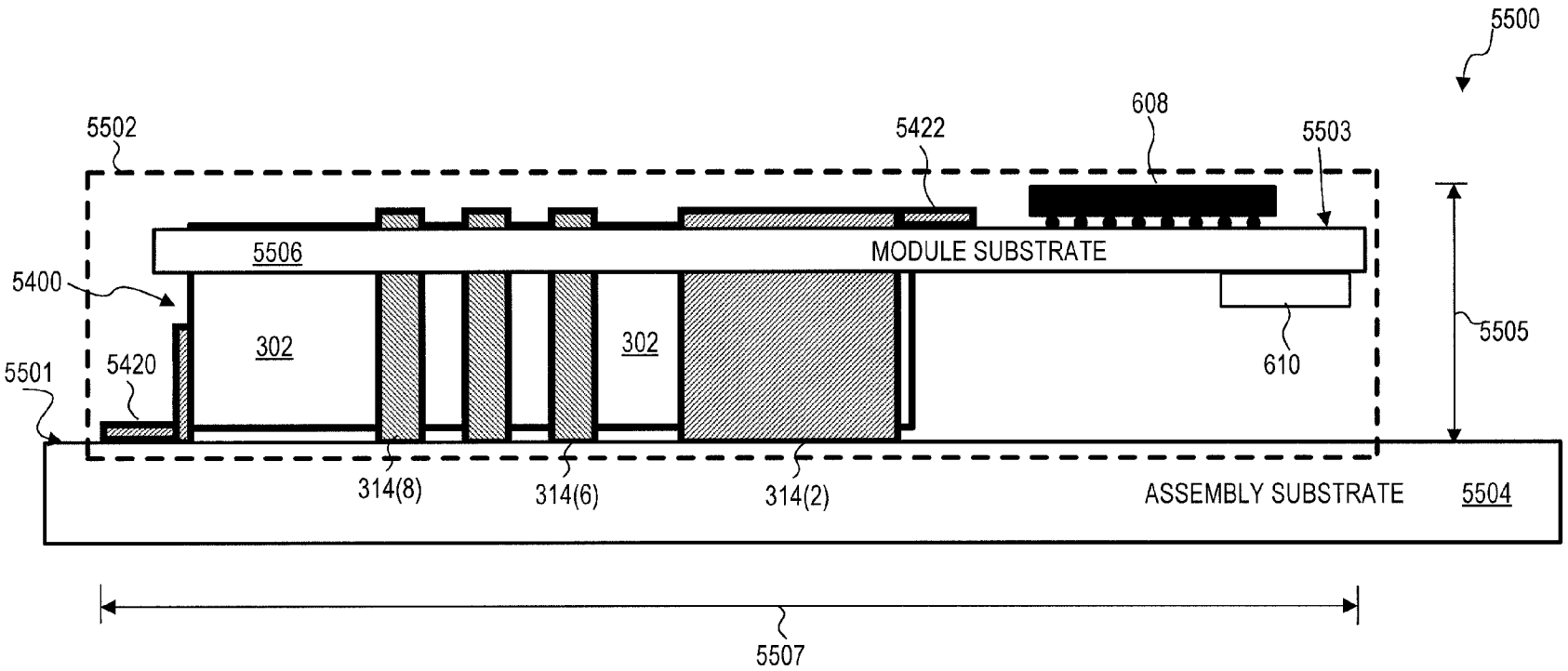
FIG. 55 shows a side plan view of an electrical assembly including an instance of the pin inductor of FIG. 54, according to an embodiment.

One possible application of pin inductor 5400 is in an electrical assembly similar to that of FIG. 6. Another possible application of pin inductor 5400 is in a "drop-in" inductor application, i.e., where an inductor installed in a substrate aperture. For example, FIG. 55 shows a side plan view of an electrical assembly 5500, which includes a power supply module 5502. Power supply module 5502 has a schematic similar to that of FIG. 7, but module 5502 includes an instance of pin inductor 5400 instead of pin inductor 300. Pin inductor 5400 is used as a drop-in inductor in power supply module 5502—i.e., inductor 5400 is disposed in an aperture of a module substrate 5506. First solder tab 5420 is soldered to a pad on top surface 5501 of assembly substrate 5504, and second solder tab 5422 is soldered to a pad on top surface 5503 of module substrate 5506. Use of pin inductor 5400 as a drop-in inductor promotes low height 5505 of module 5502 at the expense of module length 5507. In a similar fashion, an inductor similar to pin inductor 5400 can be installed in an aperture of assembly substrate 5504, or in apertures of both assembly substrate 5504 and module substrate 5506.

Figure 56:
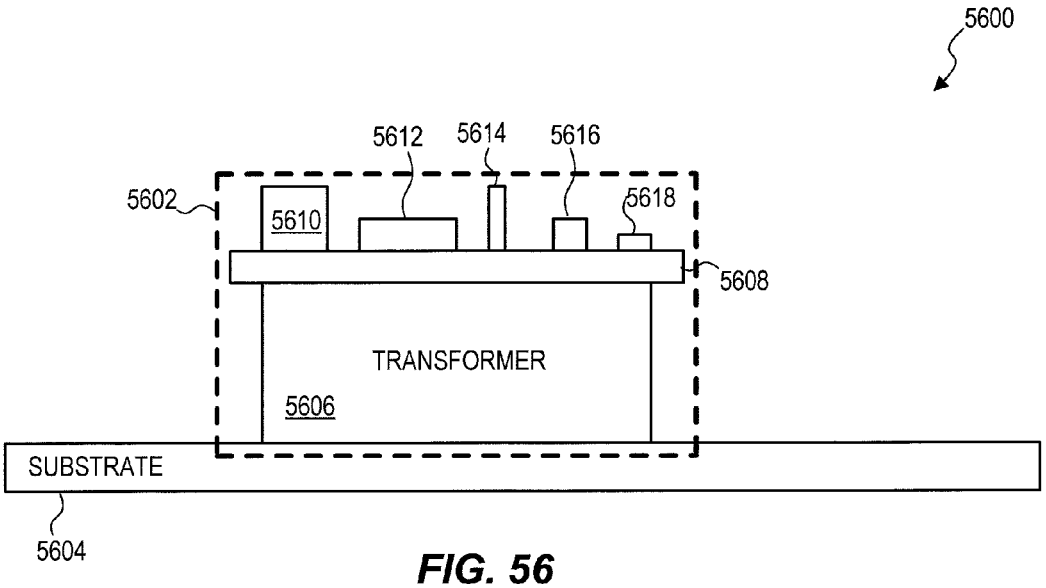
FIG. 56 shows a side plan view of an electrical assembly including a pin transformer, according to an embodiment.

Other magnetic devices, such as transformers, can also be used to electrically couple a power supply module to a substrate. For example, FIG. 56 shows a side plan view of an electrical assembly 5600, including a power supply module 5602 electrically coupled to an assembly substrate 5604 via a transformer 5606. Transformer 5606 includes a magnetic core (not shown) and at least two windings (not shown) wound at least partially around respective portions of the magnetic core. Power supply module 5602 further includes a module substrate 5608, such as a printed circuit board, coupled to transformer 5606. Thus, transformer 5606 is sandwiched between assembly substrate 5604 and module substrate 5608. Additional power supply components 5610-5618, such as switching circuits, controllers, and/or passive components, as required to form at least part of a power supply, are disposed on substrate 5608. The number and type of additional components can be varied, however, without departing from the scope hereof.

Power supply module 5602 includes, for example, one or more of an isolated DC-to-DC converter, an isolated AC-to-DC converter, or an isolated inverter. In some embodiments, power supply module 5602 includes a switching converter having a forward-type or flyback-type topology. Assembly substrate 5604 is, for example, an information technology device printed circuit board, such as a computing device motherboard or a telecommunication device motherboard.

Transformer 5606 performs at least two functions. First, transformer 5606 performs electrical isolating and/or electrical conversion functions for power supply module 5602. Second, transformer 5606 at least partially electrically couples assembly substrate 5604 and power supply module 5602. For example, in some embodiments, transformer 5606 includes a first winding electrically coupled to assembly substrate 5604, and a second winding electrically coupled to module substrate 5608, where the two windings are magnetically coupled by a magnetic core of transformer 5606. As another example, in some embodiments, transformer 506 includes one or more conductors (not shown) to interface module 5602 with a power source and/or a load on assembly substrate 5604, or with a power source and/or or a load electrically coupled to assembly substrate 5604. As yet another example, in certain embodiments, transformer 5606 includes one or more data conductors (not shown) to couple one or more data signals, such as control, status, and/or sense signals, between assembly substrate 5604 and module 5602. Accordingly, transformer 5602 is sometimes referred to as a "pin transformer" to reflect its ability to potentially replace conductive pins electrically coupling a module to a substrate. In some embodiments, such as in embodiments where module 5602 includes a flyback converter, transformer 5606 also performs energy storage functions. Furthermore, in some alternate embodiments, module 5602 extends into an aperture of assembly substrate 5604, such that module 5602 is a drop-in module.

Figure 57:
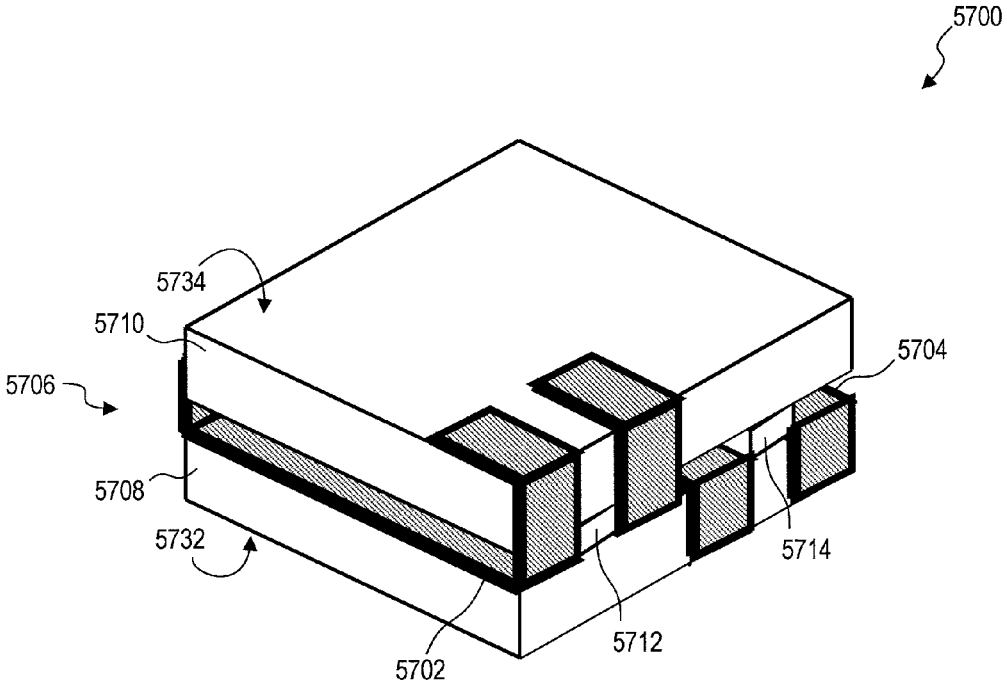
FIG. 57 shows a perspective view of one pin transformer, according to an embodiment.

FIG. 57 shows an example of one possible pin transformer that could be used in assembly 5600 as transformer 5606. In particular, FIG. 57 shows a perspective view of a pin transformer 5700, including first and second windings 5702, 5704 and a magnetic core 5706. It should be understood, however, that assembly 5600 could use pin transformers other than transformer 5700, and pin transformer 5700 is not limited to use in assembly 5600.

Figure 58:
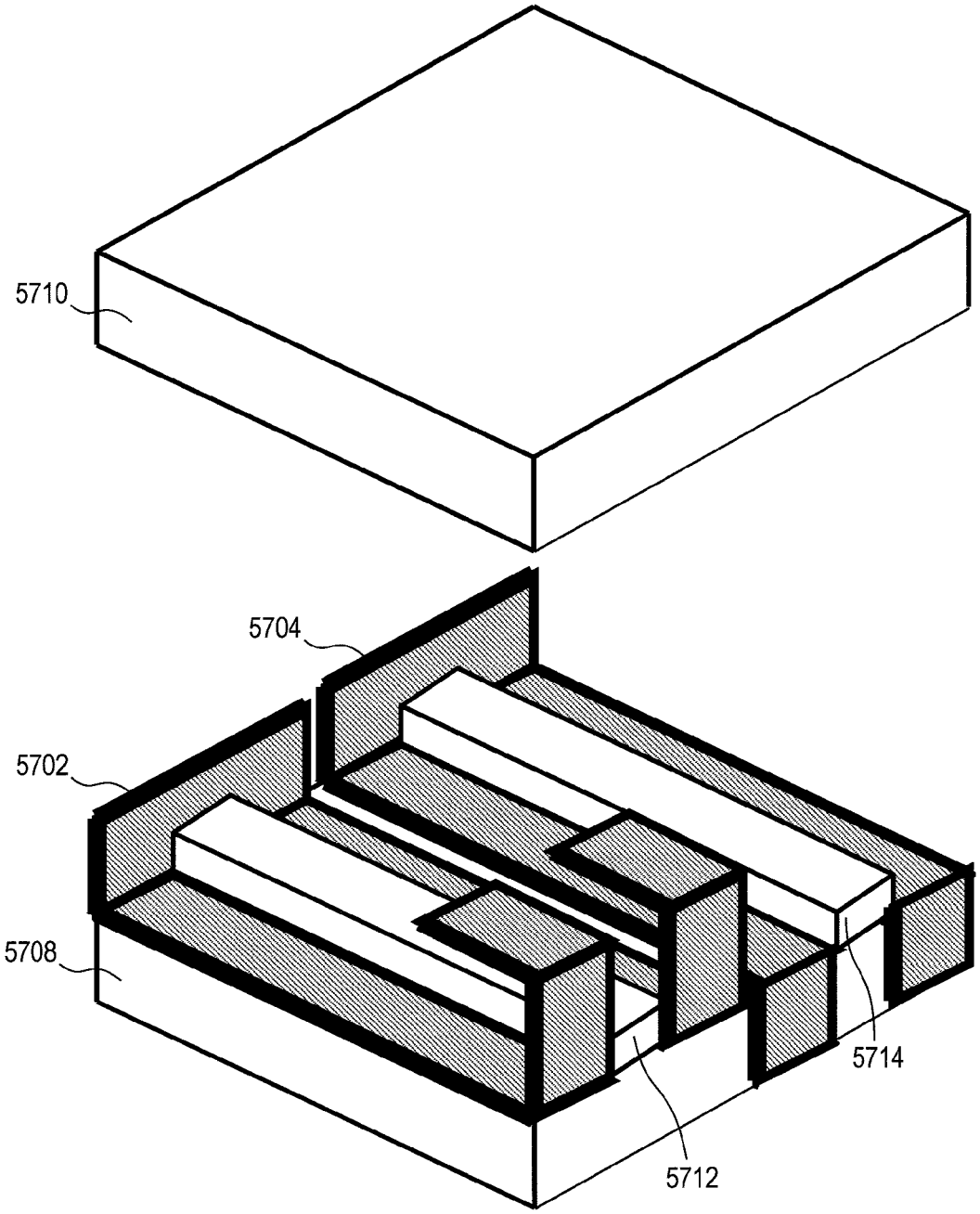
FIG. 58 shows an exploded perspective view of the FIG. 57 pin transformer.

Magnetic core 5706 includes first and second end magnetic elements 5708, 5710 and first and second coupling teeth 5712, 5714 disposed between and connecting first and second end magnetic elements 5708, 5710. Winding 5702 is wound around first coupling tooth 5712, and winding 5704 is wound around second coupling tooth 5714. FIG. 58 shows an exploded perspective view of transformer 5700, and FIG. 59 shows a perspective view of windings 5702, 5704.

Figure 59:
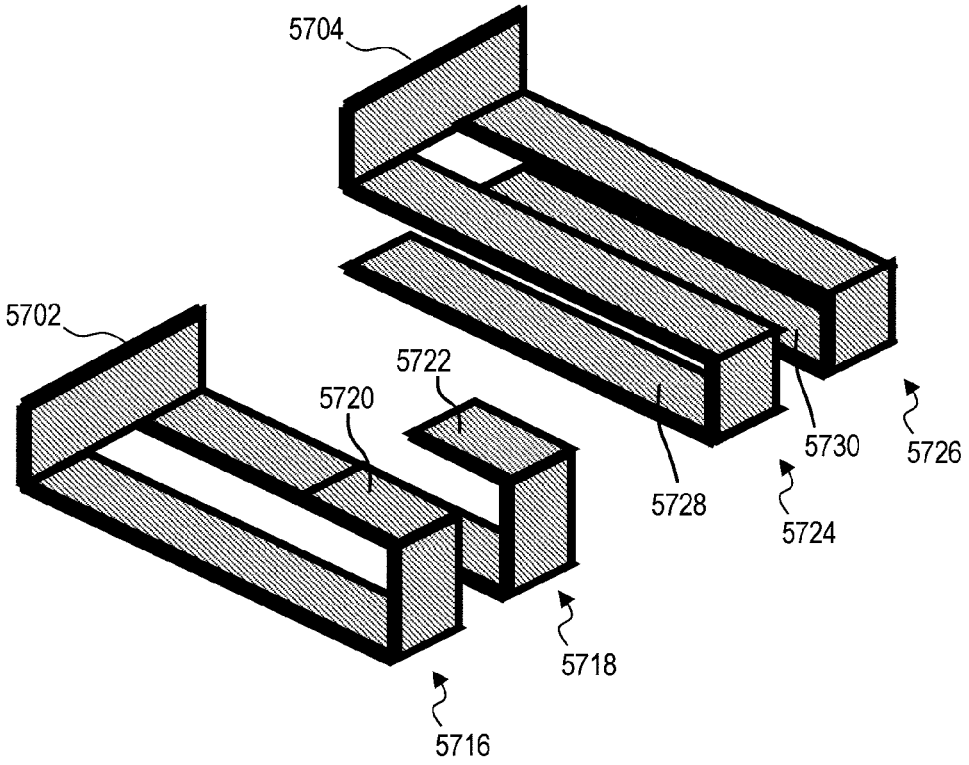
FIG. 59 shows a perspective view of the windings of the FIG. 57 pin transformer.

Winding 5702 has opposing first and second ends 5716, 5718, respectively forming solder tabs 5720, 5722 (see FIG. 59). Similarly, winding 5704 has opposing first and second ends 5724, 5726, respectively forming solder tabs 5728, 5730. Solder tabs 5728, 5730 are disposed on a first outer surface 5732 of magnetic core 5706, and solder tabs 5720, 5722 are disposed an opposing second outer surface 5734 of magnetic core 5706. Thus, solder tabs 5728, 5730 are adapted for surface mount soldering to a first substrate in a first plane, and solder tabs 5720, 5722 are adapted for surface mount soldering to a second substrate in a second plane, where the second plane is different from the first plane. Certain embodiments of transformer 5700 include one or more additional conductors (not shown), such as similar to additional conductors 3704 of FIG. 37, where magnetic core 5706 does not form a magnetic path loop around the additional conductors.

Transformer 5700 could be modified to have additional windings by adding one or more coupling teeth and associated windings. Additionally, the configuration of solder tabs 5720, 5722, 5728, 5730 could be modified. For example, in some alternate embodiments, one or more of solder tabs 5720, 5722, 5728, 5730 extend away from magnetic core 5706, instead of being disposed on magnetic core outer surfaces 5732, 5734. Furthermore, in some alternate embodiments, one or more of solder tabs 5720, 5722, 5728, 5730 are replaced with an alternative connector, such as a through-hole or socket pin. Moreover, the configuration of the windings could be varied. For example, the windings could be modified to have a configuration similar to that of windings 1702 of FIG. 17, thereby promoting use in multi-turn applications. As another example, the windings could be modified to form differing numbers of turns, thereby enabling transformer 5700 to perform voltage level transformation.

A magnetic device having both transformer and inductor functionality can also be used to electrically couple a power supply module to a substrate. For example, some alternate embodiments of pin transformer 5700 further include an additional magnetic structure and one or more additional windings to form a combination transformer and inductor pin magnetic device.

Combinations of Features

Features described above as well as those claimed below may be combined in various ways without departing from the scope hereof. The following examples illustrate some possible combinations:

(A1) An electrical assembly may include opposing first and second substrates and an inductor. The inductor may include a magnetic core and N windings wound at least partially around respective portions of the magnetic core, where each of the N windings has opposing first and second ends, and where N is an integer greater than zero. Each first end may be electrically coupled to the first substrate, and each second end may be electrically coupled to the second substrate.

(A2) In the electrical assembly denoted as (A1), the magnetic core may include opposing first and second outer surfaces. Additionally, the inductor may be disposed between the first and second substrates such that the first outer surface of the magnetic core faces the first substrate, and the second outer surface of the magnetic core faces the second substrate.

(A3) In the electrical assembly denoted as (A2), the magnetic core may form a recess in the second outer surface.

(A4) The electrical assembly denoted as (A3) may further include at least one component affixed to the second substrate and extending into the recess.

(A5) In the electrical assembly denoted as (A2), the second end of each of the N windings may form a respective second solder tab soldered to the second substrate, and the inductor may further include a spacer disposed between the second outer surface of the magnetic core and at least one of the second solder tabs.

(A6) In the electrical assembly denoted as (A5), a portion of the spacer may form a recess.

(A7) The electrical assembly denoted as (A6) may further include at least one component affixed to second substrate and extending into the recess.

(A8) In any of the electrical assemblies denoted as (A5) through (A7), the first end of each of the N windings may form a respective first solder tab soldered to the first substrate.

(A9) In any of the electrical assemblies denoted as (A1) through (A4), the first end of each of the N windings may form a respective first solder tab soldered to the first substrate, and the second end of each of the N windings may form a respective second solder tab soldered to the second substrate.

(A10) Any of the electrical assemblies denoted as (A1) through (A9) may further include one or more switching devices disposed on the second substrate, where each of the one or more switching devices is operable to repeatedly switch the second end of a respective one of the N windings between at least two different voltage levels, at a frequency of at least 1 kilohertz.

(A11) The electrical assembly denoted as (A10) may further include a controller disposed on the second substrate, where the controller is adapted to control switching of the one or more switching devices.

(A12) In any of the electrical assemblies denoted as (A1) through (A9), the inductor may further include M additional conductors, where M is an integer greater than zero. Each of the M additional conductors may have opposing first and second ends electrically coupled to the first and second substrates, respectively. The magnetic core optionally does not form a magnetic path loop around the M additional conductors.

(A13) The electrical assembly denoted as (A12) may further include one or more switching devices disposed on the second substrate, where each of the one or more switching devices is operable to repeatedly switch the second end of a respective one of the N windings between at least two different voltage levels, at a frequency of at least 1 kilohertz.

(A14) The electrical assembly denoted as (A13) may further include a controller disposed on the second substrate, where the controller is adapted to control switching of the one or more switching devices.

(A15) In the electrical assembly denoted as (A14), the M additional conductors may include at least one data conductor adapted to communicatively couple one or more data signals between the controller and the first substrate, where each of the one or more data signals include at least one of (a) a signal used by the controller to control switching of the switching N devices, and (b) a signal indicating status of one or more aspects to the electrical assembly.

(A16) In the electrical assembly denoted as (A14), the M additional conductors may include at least one data conductor adapted to communicatively couple to the controller a signal representing one of or more of (a) voltage on a node in the electrical assembly, and (b) current flowing through a component of the electrical assembly.

(A17) In any of the electrical assemblies denoted as (A13) through (A16), the inductor and the one or more switching devices may collectively form part of at least one DC-to-DC converter, and the M additional conductors may include first and second power conductors adapted to electrically couple the at least one DC-to-DC converter to an input power source.

(A18) In the electrical assembly denoted as (A17), the at least one DC-to-DC converter may include one or more of a buck DC-to-DC converter, a boost DC-to-DC converter, and a buck-boost DC-to-DC converter.

(A19) In either of the electrical assemblies denoted as (A17) or (A18), the second end of at least one of the N windings may form a solder tab disposed between opposing respective portions of the first and second power conductors on the second outer surface of the magnetic core.

(A20) In any of the electrical assemblies denoted as (A1) through (A19), at least one of the first and second substrates may include a printed circuit board.

(A21) In any of the electrical assemblies denoted as (A1) through (A20), N may be greater than one.

(A22) In the electrical assembly denoted as (A21), the N windings may be wound at least partially around respective portions the magnetic core in alternating opposing directions.

(A23) In either of the electrical assemblies denoted as (A21) or (A22), first ends of at least two of the N windings may be electrically coupled on the first substrate.

(A24) In any of the electrical assemblies denoted as (A21) through (A23), second ends of at least two the N windings may be electrically coupled on the second substrate.

(B1) An electrical assembly may include a first substrate and a power supply module including a magnetic device, where the magnetic device is either an inductor, a transformer, or a combination of an inductor and a transformer. The magnetic device may at least partially electrically couple the power supply module to the first substrate.

(B2) In the electrical assembly denoted as (B1), the power supply module may include a second substrate, and the magnetic device may be sandwiched between the first substrate and the second substrate.

(B3) In either of the electrical assemblies denoted as (B1) or (B2), the magnetic device may be adapted to electrically couple the power supply module to an input power source on the first substrate.

(B4) In any of the electrical assemblies denoted as (B1) through (B3), the magnetic device may be adapted to electrically couple a data signal between the first substrate and the power supply module, where the data signal includes at least one (a) a signal to control the power supply module, and (b) a signal indicating status of one more or more aspects to the electrical assembly.

(B5) In any of the electrical assemblies denoted as (B1) through (B4), the power supply module may extend into an aperture of the first substrate.

(C1) A magnetic device may include a magnetic core having opposing first and second outer surfaces and N windings wound at least partially around respective portions of the magnetic core, where N is an integer greater than zero. Each of the N windings has opposing first and second ends. Each first end may form a first solder tab along the first outer surface, and each second end may form a second solder tab along the second outer surface.

(C2) The magnetic device denoted as (C1) may further include M additional conductors, where the magnetic core does not form a magnetic path loop around the M additional conductors, and where M is an integer greater than zero.

(C3) In the magnetic device denoted as (C2), each of the M additional conductors may have opposing first and second ends respectively forming first and second additional solder tabs.

(C4) In the magnetic device denoted as (C3), each first additional solder tab may be disposed on the first outer surface, and each second additional solder tab may be disposed on the second outer surface.

(C5) In either of the magnetic devices denoted as (C3) or (C4), M may be greater than one, and at least one second solder tab may be disposed between opposing respective portions of a pair of the M additional conductors, on the second outer surface of the magnetic core.

(C6) In any of the magnetic devices denoted as (C1) through (C5), the magnetic core may form a recess in the second outer surface.

(C7) Any of the magnetic devices denoted as (C1) through (C5) may further include a spacer disposed between the second outer surface of the magnetic core and at least one of the second solder tabs.

(C8) In the magnetic device denoted as (C7), a portion of the spacer may form a recess.

(C9) In any of the magnetic devices denoted as (C1) through (C8), N may be greater than one.

(C10) In the magnetic device denoted as (C9), the N windings may be wound at least partially around respective portions of the magnetic core in alternating opposing directions.

(D1) A magnetic device may include a magnetic core and N windings wound at least partially around respective portions of the magnetic core, where N is an integer greater than zero. Each of the N windings has opposing first and second ends. Each first end may form a first connector, and each second end may form a second connector. Each first connector may be adapted for coupling to a first substrate in a first plane, and each second connector may adapted for coupling to a second substrate in a second plane that is different from the first plane.

(D2) In the magnetic device denoted as (D1), each first connector may include a solder tab adapted for surface mount soldering to the first substrate, and each second connector may include a solder tab adapted for surface mount soldering to the second substrate.

(D3) In the magnetic device denoted as (D2), the magnetic core may have opposing first and second outer surfaces, each first solder tab may be disposed on the first outer surface, and each second solder tab may be disposed on the second outer surface.

(D4) The magnetic device denoted as (D3) may further include a spacer disposed between the second outer surface of the magnetic core and at least one of the second solder tabs.

(D5) In the magnetic device denoted as (D4), a portion of the spacer may form a recess.

(D6) Any of the magnetic devices denoted as (D1) through (D5) may further include M additional conductors, where the magnetic core does not form a magnetic path loop around the M additional conductors, and where M is an integer greater than zero.

(D7) In the magnetic device denoted as (D6), each of the M additional conductors may have opposing first and second ends respectively forming first and second additional connectors.

(D8) In the magnetic device denoted as (D7), each first additional connector may be adapted for coupling to the first substrate in the first plane, and each second additional connector may be adapted for coupling to the second substrate in the second plane.

(D9) In any of the magnetic devices denoted as (D1) through (D8), the magnetic core may form a recess in an outer surface of the magnetic core.

(D10) In any of the magnetic devices denoted as (D1) through (D9), each first connector may include a first through-hole pin, and each second connector may include a second through-hole pin.

Changes may be made in the above methods and systems without departing from the scope hereof. For example, single-turn windings may be replaced with multiple-turn windings in many embodiments. Therefore, the matter contained in the above description and shown in the accompanying drawings should be interpreted as illustrative and not in a limiting sense. The following claims are intended to cover generic and specific features described herein, as well as all statements of the scope of the present method and system, which, as a matter of language, might be said to fall therebetween.

What is claimed is:

1. An electrical assembly, comprising:

opposing first and second substrates; and an inductor, including:

a magnetic core having opposing first and second sides, and first and second windings each wound through the magnetic core from the first side of the magnetic core to the second side of the magnetic core, each of the first and second windings having opposing first and second ends, each first end electrically coupled to the first substrate, each second end electrically coupled to the second substrate, the first end of the first winding being wound around the first side of the magnetic core, and the first end of the second winding being wound around the second side of the magnetic core.

2. The electrical assembly of claim 1, wherein:

the magnetic core comprises opposing first and second outer surfaces; and the inductor is disposed between the first and second substrates such that the first outer surface of the magnetic core faces the first substrate and the second outer surface of the magnetic core faces the second substrate.

3. The electrical assembly of claim 2, the magnetic core forming a recess in the second outer surface.

4. The electrical assembly of claim 3, further comprising at least one component affixed to the second substrate and extending into the recess.

5. The electrical assembly of claim 2, wherein:

the first end of each of the first and second windings forms a respective first solder tab soldered to the first substrate; and the second end of each of the first and second windings forms a respective second solder tab soldered to the second substrate.

6. The electrical assembly of claim 5, the inductor further including a spacer disposed between the second outer surface of the magnetic core and at least one of the second solder tabs.

7. The electrical assembly of claim 6, a portion of the spacer forming a recess.

8. The electrical assembly of claim 7, further comprising at least one component affixed to second substrate and extending into the recess.

9. The electrical assembly of claim 2, wherein:

the inductor further includes M additional conductors;

the magnetic core does not form a magnetic path loop around the M additional conductors;

each of the M additional conductors has opposing first and second ends electrically coupled to the first and second substrates, respectively; and M is an integer greater than zero.

10. The electrical assembly of claim 9, further comprising one or more switching devices disposed on the second substrate, each of the one or more switching devices operable to repeatedly switch the second end of a respective one of the first and second windings between at least two different voltage levels, at a frequency of at least 1 kilohertz.

11. The electrical assembly of claim 10, further comprising a controller disposed on the second substrate, the controller adapted to control switching of the one or more switching devices.

12. The electrical assembly of claim 11, the M additional conductors comprising at least one data conductor adapted to communicatively couple one or more data signals between the controller and the first substrate, each of the one or more data signals including at least one of (a) a signal used by the controller to control switching of the switching N devices, and (b) a signal indicating status of one or more aspects to the electrical assembly.

13. The electrical assembly of claim 11, the M additional conductors comprising at least one data conductor adapted to communicatively couple to the controller a signal representing one of or more of (a) voltage on a node in the electrical assembly, and (b) current flowing through a component of the electrical assembly.

14. The electrical assembly of claim 10, the inductor and the one or more switching devices collectively forming part of at least one DC-to-DC converter, the M additional conductors comprising first and second power conductors adapted to electrically couple the at least one DC-to-DC converter to an input power source.

15. The electrical assembly of claim 14, the at least one DC-to-DC converter comprising one or more of a buck DC-to-DC converter, a boost DC-to-DC converter, and a buck-boost DC-to-DC converter.

16. The electrical assembly of claim 14, wherein the second end of at least one of the first and second windings forms a solder tab disposed between opposing respective portions of the first and second power conductors on the second outer surface of the magnetic core.

17. The electrical assembly of claim 1, at least one of the first and second substrates comprising a printed circuit board.

18. The electrical assembly of claim 1, the first and second windings being wound at least partially around respective portions the magnetic core in alternating opposing directions.

19. A magnetic device, comprising:

a magnetic core having first, second, third, and fourth outer surfaces, the first outer surface opposing the second outer surface, and the third outer surface opposing the fourth outer surface; and first and second windings each wound through the magnetic core from the third outer surface to the fourth outer surface, each of the first and second windings having opposing first and second ends, each first end forming a first solder tab along the first outer surface, each second end forming a second solder tab along the second outer surface, the first end of the first winding being wound around the third outer surface, and the first end of the second winding being wound around the fourth outer surface;

the magnetic device further comprising M additional conductors, wherein:

the magnetic core does not form a magnetic path loop around the M additional conductors;

each of the M additional conductors has opposing first and second ends respectively forming first and second additional solder tabs;

each first additional solder tab is disposed on the first outer surface;

each second additional solder tab is disposed on the second outer surface; and

M is an integer greater than zero.

20. The magnetic device of claim 19, M being greater than one, at least one second solder tab being disposed between opposing respective portions of a pair of the M additional conductors, on the second outer surface of the magnetic core.

21. The magnetic device of claim 19, the magnetic core forming a recess in the second outer surface.

22. The magnetic device of claim 19, further comprising a spacer disposed between the second outer surface of the magnetic core and at least one of the second solder tabs.

23. The magnetic device of claim 22, a portion of the spacer forming a recess.

24. The magnetic device of claim 19, the first and second windings being wound at least partially around respective portions of the magnetic core in alternating opposing directions.

25. A magnetic device, comprising:

a magnetic core having opposing first and second outer surfaces; and first and second windings each wound through the magnetic core from the first outer surface to the second outer surface, each of the first and second windings having opposing first and second ends, each first end forming a first connector, each second end forming a second connector, each first connector being adapted for coupling to a first substrate in a first plane, each second connector being adapted for coupling to a second substrate in a second plane that is different from the first plane, the first end of the first winding being wound around the first outer surface, and the first end of the second winding being wound around the second outer surface.

26. The magnetic device of claim 25, each first connector comprising a first solder tab adapted for surface mount soldering to the first substrate, each second connector comprising a second solder tab adapted for surface mount soldering to the second substrate.

27. The magnetic device of claim 26, wherein:

the magnetic core further has opposing third and fourth outer surfaces;

each first solder tab is disposed on the third outer surface; and each second solder tab is disposed on the fourth outer surface.

28. The magnetic device of claim 27, further including a spacer disposed between the fourth outer surface of the magnetic core and at least one of the second solder tabs.

29. The magnetic device of claim 28, a portion of the spacer forming a recess.

30. The magnetic device of claim 25, further comprising M additional conductors, wherein:

the magnetic core does not form a magnetic path loop around the M additional conductors;

each of the M additional conductors has opposing first and second ends respectively forming first and second additional connectors;

each first additional connector is adapted for coupling to the first substrate in the first plane;

each second additional connector is adapted for coupling to the second substrate in the second plane; and M is an integer greater than zero.

31. The magnetic device of claim 25, the magnetic core forming a recess in an outer surface of the magnetic core.

32. The magnetic device of claim 25, each first connector comprising a first through-hole pin, each second connector comprising a second through-hole pin.

* * * * *